US012496503B2

(12) United States Patent
Johnson

(10) Patent No.: US 12,496,503 B2
(45) Date of Patent: Dec. 16, 2025

(54) PROJECTILE PARTY GAME

(71) Applicant: Sven Johnson, Denver, CO (US)

(72) Inventor: Sven Johnson, Denver, CO (US)

( * ) Notice: Subject to any disclaimer, the term of this patent is extended or adjusted under 35 U.S.C. 154(b) by 0 days.

(21) Appl. No.: 18/896,346

(22) Filed: Sep. 25, 2024

(65) Prior Publication Data

US 2025/0025758 A1 Jan. 23, 2025

Related U.S. Application Data

(63) Continuation-in-part of application No. 18/500,550, filed on Nov. 2, 2023, now Pat. No. 12,129,101.

(Continued)

(51) Int. Cl.

| | |
|---|---|
| ***A63B 67/06*** | (2006.01) |
| ***A63F 9/00*** | (2006.01) |
| ***B65D 81/36*** | (2006.01) |
| ***B65D 81/38*** | (2006.01) |
| *A63B 67/187* | (2016.01) |

(52) U.S. Cl.

CPC ..... *A63B 67/06* (2013.01); *A63F 9/001* (2013.01); *B65D 81/365* (2013.01); *B65D 81/3876* (2013.01); *A63B 2067/061* (2013.01); *A63B 2067/063* (2013.01); *A63B 67/187* (2016.01);

(Continued)

(58) Field of Classification Search

CPC ... A63B 67/06; A63B 67/187; A63B 2209/10; A63F 9/001; B65D 81/3876; B65D 81/365

See application file for complete search history.

(56) References Cited

U.S. PATENT DOCUMENTS 2,706,571 A 4/1955 Ryan
2,853,991 A * 9/1958 Mclain ..... F41B 11/66 124/64

(Continued)

FOREIGN PATENT DOCUMENTS

CN 303529261 S 12/2015
CN 304312402 S 10/2017

(Continued)

OTHER PUBLICATIONS

The Over-Engineered Koozie, retrieved from https://web.archive.org/web/20230328025030/https://rp-moto.com/products/the-over-engineered-koozie, on Apr. 9, 2024 (5 Pages).

(Continued)

*Primary Examiner* — Steve Rowland
(74) *Attorney, Agent, or Firm* — Nixon Peabody LLP

(57) ABSTRACT

A collapsible game piece and methods of using the same are disclosed. The collapsible game piece can have one or more collapsible zones, each of which can move between a collapsed state and an expanded state, optionally including partially collapsed states in-between. The collapsible game piece can have a projectile end with a projectile opening sized to receive a projectile (e.g., a ping pong ball). The collapsible game piece can have a nose end and optionally a nose piece. The collapsible game piece can optionally include a tail and fins. When thrown or tossed, the collapsible game piece can fly until it lands, potentially collapsing one or more of the collapsible zones, which results in ejection of the projectile from the projectile opening. Various games can be played using the collapsible game piece.

56 Claims, 37 Drawing Sheets

Related U.S. Application Data

(60) Provisional application No. 63/687,200, filed on Aug. 26, 2024, provisional application No. 63/507,731, filed on Jun. 12, 2023, provisional application No. 63/382,037, filed on Nov. 2, 2022.

(52) U.S. Cl.
CPC ... *A63B 2209/10* (2013.01); *A63F 2009/0012* (2013.01)

(56) References Cited

U.S. PATENT DOCUMENTS

| | | | | | |
|---|---|---|---|---|---|
| 2,891,795 | A * | 6/1959 | Glintz | F41B 7/08 | 124/31 |
| 3,087,481 | A * | 4/1963 | Foster | F41B 11/66 | 124/52 |
| 3,236,521 | A * | 2/1966 | Knott | A63B 60/38 | 124/52 |
| 4,186,927 | A * | 2/1980 | Breslow | A63F 9/0079 | 273/357 |
| 4,548,190 | A * | 10/1985 | Megargee | F41B 11/00 | 124/56 |
| 4,892,081 | A * | 1/1990 | Moormann | F41B 11/641 | 124/63 |
| D307,850 | S | 5/1990 | Aoki | | |
| 5,058,561 | A * | 10/1991 | Starr | F41B 11/641 | 124/64 |
| 5,205,773 | A * | 4/1993 | Koepcke | A63H 3/003 | 124/64 |
| 5,377,656 | A * | 1/1995 | Lewinski | F41B 9/0037 | 124/63 |
| 5,417,327 | A | 5/1995 | Saumure | | |
| 7,654,402 | B2 | 2/2010 | Kusuma | | |
| 7,938,110 | B2 * | 5/2011 | Udwin | F41A 21/32 | 124/65 |
| 8,517,004 | B2 * | 8/2013 | Walterscheid | F41B 11/642 | 124/64 |
| 9,278,269 | B2 * | 3/2016 | Chen | A63B 47/002 | |
| D832,370 | S * | 10/2018 | Chen | D21/573 | |
| 10,390,644 | B1 | 8/2019 | Lachinian | | |
| 10,928,154 | B1 * | 2/2021 | Kam | F41B 11/646 | |
| 12,122,205 | B2 * | 10/2024 | Marking | F16F 9/185 | |
| 2003/0089361 | A1 * | 5/2003 | Christensen | F41B 11/57 | 124/77 |
| 2005/0056646 | A1 | 3/2005 | Gary | | |
| 2005/0230586 | A1 | 10/2005 | Gary | | |
| 2007/0075488 | A1 * | 4/2007 | Pececnik | G07C 15/001 | 273/145 E |
| 2009/0114657 | A1 | 5/2009 | Hsu | | |
| 2014/0209621 | A1 | 7/2014 | Irish | | |
| 2021/0259446 | A1 | 8/2021 | Smith | | |
| 2024/0068768 | A1 * | 2/2024 | Kam | F41B 11/89 | |

FOREIGN PATENT DOCUMENTS

| | | | |
|---|---|---|---|
| GB | 6159837 | S | 10/2021 |
| JP | 1992102544 | A | 4/1992 |
| JP | 4352695 | B2 | 10/2005 |

OTHER PUBLICATIONS

The Flip Game; retrieved from https://www.youtube.com/watch?v=3bMI1ynhv3A, on Apr. 9, 2024 (3 Pages).

* cited by examiner

PROJECTILE PARTY GAME

CROSS-REFERENCE TO RELATED APPLICATIONS

The present application claims benefit of U.S. Provisional Patent Application No. 63/687,200 filed Aug. 26, 2024. The present application is also a continuation-in-part of U.S. patent application Ser. No. 18/500,550 filed Nov. 2, 2023, which claims the benefit of and priority to U.S. Provisional Patent Application No. 63/382,037 filed Nov. 2, 2022, and U.S. Provisional Application No. 63/507,731 filed Jun. 12, 2023 , each of which is hereby incorporated by reference herein in its entirety.

TECHNICAL FIELD

The present disclosure relates generally to party games, and more specifically to throwing or tossing party games.

BACKGROUND

Of the beverage insulation methods, not many are built in a way where the unit itself can support multiple beverage container sizes without modification to the device or even at all. Many beverage insulators are also large and not compact because they are made of metal and cannot be reduced to a smaller size. These factors limit the number of beverage insulators that can fit within a volume of space (e.g., a vehicle or a bag) and limit the range of beverage containers that fit inside the insulator.

In many instances where beverage insulators may be used, such as parties and gatherings, guests engage in games, such as tabletop games and yard games. Yard games often require additional equipment that must be brought to the party and collected at the end of the party. Tabletop games often require additional equipment or make use of existing materials, such as cups. In such cases, it is not uncommon for individuals to play tabletop games with the same cups from which they are drinking, which can often lead to unsanitary conditions. For example, the drinking game known as "flip cup" traditionally involves an individual drinking from a cup and then placing that same cup upside-down on a table and repeatedly attempting to flip it right side up. Not only does this action result in leftover beverage spilling onto the table, but also puts the rim of the cup in direct contact with the table, which may increase the risk of spreading infectious diseases. Further, there is a need for new party games for entertaining guests.

There is a need for apparatuses and methods that cure these and other deficiencies.

SUMMARY

In one aspect, a collapsible game piece includes a main body. The main body having a projectile end, a nose end, and a sidewall. The sidewall coupling the projectile end and the nose end. The main body having an interior volume. The collapsible game piece further including a projectile opening in the projectile end for retaining a projectile. The projectile opening being elastically deformable to facilitate receiving the projectile and forming a substantially fluid-sealed interface around the projectile. The sidewall including at least one collapsible zone being movable between a collapsed state and an expanded state, wherein movement of the at least one collapsible zone from the expanded state to the collapsed state decreases a volume of the interior volume.

In one aspect, a collapsible beverage insulator, includes a first end having a first opening, a second end having a second opening, a sidewall coupling the first end and the second end, the first end, the second end, and the sidewall defining an interior volume, the sidewall including at least one collapsible zone being moveable between a collapsed state and an expanded state, where movement of the at least one collapsible zone from the expanded state to the collapsed state decreases a volume of the interior volume.

In one aspect, a method of using a collapsible beverage insulator, includes providing a collapsible beverage insulator having a first end coupled to a second end by a sidewall, the first end having a first opening, the second end having a second opening, and the sidewall having at least one collapsible zone, placing a beverage at least partially within the collapsible beverage insulator to provide insulation between the beverage and an exterior environment, removing the beverage from the collapsible beverage insulator, employing the collapsible beverage insulator to play a game, where employing the collapsible beverage insulator to play a game includes moving the at least one collapsible zone between a collapsed state and an expanded state.

BRIEF DESCRIPTION OF THE DRAWINGS

To easily identify the discussion of any particular element or act, the most significant digit or digits in a reference number refer to the figure number in which that element is first introduced.

DETAILED DESCRIPTION

Figure 1:
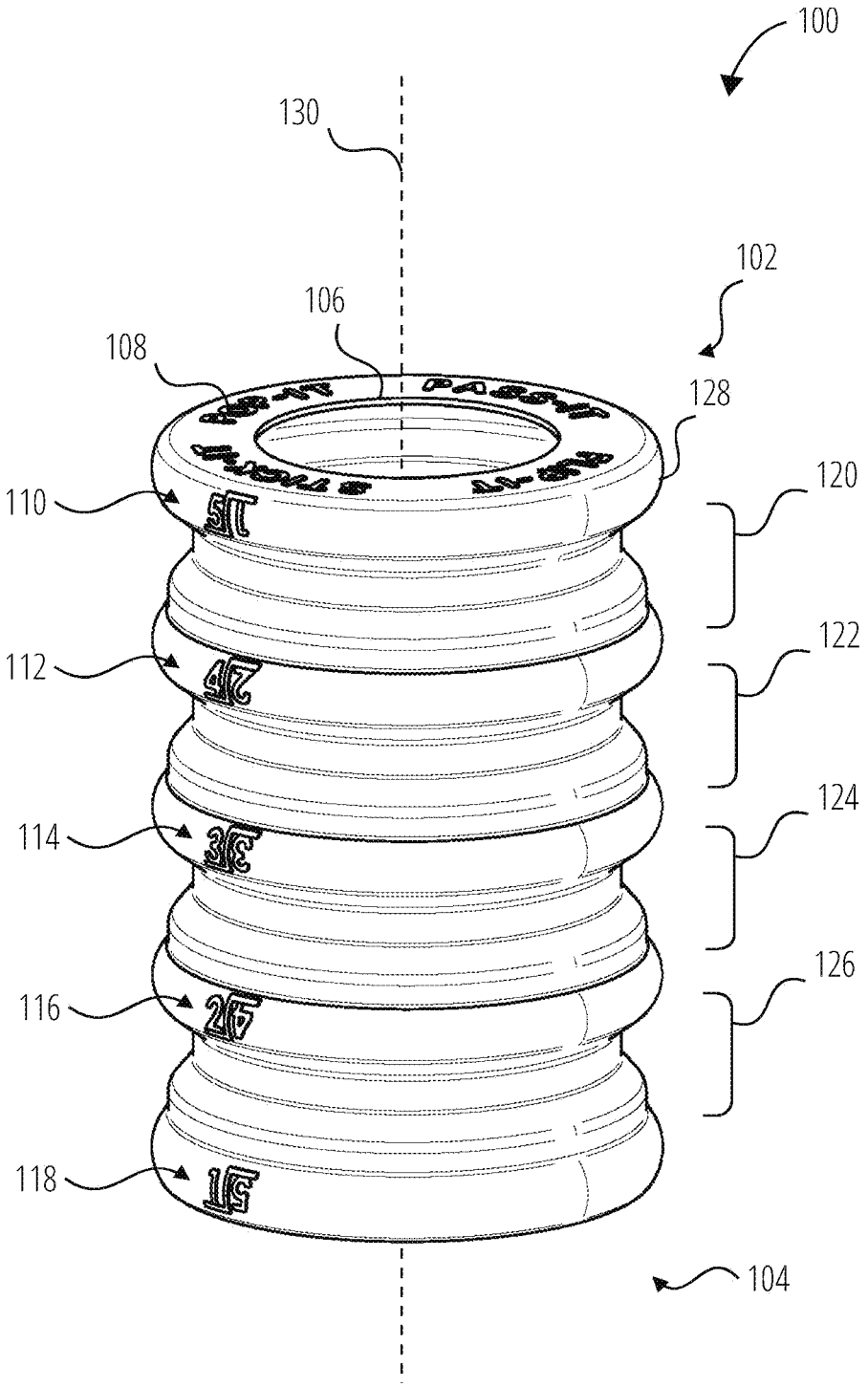
FIG. 1 is a view of a collapsible beverage insulator, according to certain aspects of the present disclosure.

Certain aspects and features of the present disclosure relate to a collapsible beverage insulator and methods of using the same. The collapsible beverage insulator can have one or more collapsible zones, each of which can move between a collapsed state and an expanded state, optionally including partially collapsed states in-between. The collapsible beverage insulator can have a first end with a first opening sized to receive common beverage containers. The collapsible zones can be manipulated to fit the collapsible beverage insulator to the beverage container being used. The collapsible beverage insulator can be separated from the beverage container to be used in games (e.g., tabletop or lawn games). The collapsible beverage insulator can be tossed and the way the collapsible beverage insulator lands (e.g., on an end, on a particular end, or on its side) and how the collapsible zones collapse can be used to determine points to be awarded to the player. The collapsible beverage insulator can include markings to facilitate certain gameplay, including indicators associated with different collapsible zones and hidden designs that are only readily visible when an associated collapsible zone is not in a collapsed state.

Certain aspects of the present disclosure relate to collapsible beverage insulators and methods of using the for tabletop and/or yard games that combine elements of strategy, skill, and excitement. Certain aspects of the present disclosure enable fun games that can be played by multiple players and in different versions. Such games can provide new and exciting challenges for tabletop and yard game enthusiasts.

Certain aspects of the present disclosure enable variations of games that make use of a collapsible beverage insulator that can be tossed into the air or otherwise maneuvered to cause the collapsible beverage insulator to land on a surface. As used herein, the term "toss" is intended to be inclusive of throwing, flipping, and dropping. As the collapsible beverage insulator lands, the force of landing can cause one or more collapsible zones (e.g., collapsible ribs) to collapse (e.g., partially or fully) depending on how high the collapsible beverage insulator was tossed and the position in which it lands. Players can earn points based on how and/or where the collapsible beverage insulator lands, as well as how the one or more collapsible zones collapse. For example, landing on a first end may award a player a point, with additional points awarded for each collapsible zone that collapses upon landing. In some cases, points and scoring can be reflected using a game board and/or score board. In some cases, players can race to achieve a set number of points and/or for a score token to reach a desired end zone. In some cases, a projectile can be used in combination with the collapsible beverage insulator allowing the projectile to be temporarily fit into the collapsible beverage insulator until one or more collapsible zones collapse, causing the projectile to be shot out of the collapsible beverage insulator. In some cases, such a projectile can be used for scoring or other gameplay.

As used herein, the term insulator, such as used with reference to a collapsible beverage insulator, can also be denoted a "caddy" or "sleeve." Generally, a collapsible beverage insulator refers to a device used to both insulate a beverage (e.g., directly insulate and contain a beverage or insulate a beverage container) and play tabletop and/or yard games. As used herein, insulating a beverage need not fully insulate the beverage, such as how a traditional koozie may provide insulation to only the walls and bottom surface of a beverage can. A collapsible beverage insulator is generally a tube that is cylindrical, hourglass, or spherical in shape, although other shapes and/or combinations of shapes can be used. Generally, a collapsible beverage insulator includes one or more collapsible zones (e.g., collapsible bellows) and one or more ends with openings (e.g., flanged flat gasket ends).

While various aspects and features of the present disclosure relate to a collapsible beverage insulator capable of playing certain tabletop and/or yard games as disclosed herein, in some cases, where appropriate, a collapsible sleeve can be used in place of a collapsible beverage insulator, in which case the collapsible sleeve may provide little or no insulation to a beverage. In other words, wherever used herein, as appropriate (e.g., where beverage insulation is not necessary or not desired), a collapsible beverage insulator can be replaced with a collapsible sleeve. Such a collapsible sleeve can also be referred to as a collapsible game piece or a collapsible game sleeve.

As used herein, the term collapsible zone can refer to a region of the collapsible beverage insulator that is able to move between an expanded state and a collapsed state, optionally including one or more partially collapsed states in-between. The collapsible zone can include segments that act as inner or outer joints that allow the sidewall of the collapsible beverage insulator to collapse. In some cases, such segments can be referred to as "bellows" or "ribs." These segments can collapse on top of or within each other to move the collapsible zone into a collapsed state. A collapsible zone can be made from any suitable material, including the same material as the remainder of the sidewall. In some cases, the collapsible zone is made from an elastomeric material, such as silicone. In some cases, at least portions of the collapsible zone (e.g., joints between adjacent segments) can be made of an elastomeric material.

As used herein, the term "spool" can refer to a secondary device generally having the shape of a spool (e.g., a wire spool) that can be inserted into an opening at an end of the collapsible beverage insulator. The spool can be used to partially or fully seal the opening, such as to permit air pressure to build within the collapsible beverage insulator when an opposite opening is occluded by an object (e.g., a projectile) and one or more collapsible zones collapse. For example, if the collapsible beverage insulator is used on a landing surface that is not smooth, use of a spool can help ensure a projectile fit to the collapsible beverage insulator is expelled as expected when a collapsible zone collapses. In cases where the landing surface is smooth, a spool may not be necessary, as the end of the collapsible beverage insulator may create a sufficient seal to allow pressure to build within the collapsible beverage insulator to expel the projectile. The spool can be held in the collapsible beverage insulator by an opening, and can optionally move freely in an axial direction with minimal pressure to let air in and out. When landing on a surface, one of the flanges of the spool can press up against the end of the collapsible beverage insulator to create an airtight seal, in turn pushing the projectile out of the other end. In some cases, an external face of a spool may be shaped in the form of a suction cup. The use of such a suction base can aid in landing the collapsible beverage insulator on its end and/or can aid in keeping the collapsible beverage insulator in an upright and steady position when used to insulate beverage containers. In some cases, a spool may have first and second flanges separated by a spool body, allowing two collapsible beverage insulators to be connected end-to-end to the same spool, thus axially coupling two collapsible beverage insulators together. In some cases, the aforementioned features of a spool, as appropriate, can be used instead with an alternate attachment mechanism instead of a spool. For example, an axial coupler can connect to a collapsible beverage insulator using a threaded connection, a snap fit connection, or the like.

As used herein, the term "projectile" can include a ball, a spherical object, a cubic object, or any other shaped object that can generally fit within an opening of an end of the collapsible beverage insulator to create an airtight or substantially airtight seal. The projectile can match the diameter and shape of an opening in an end of the collapsible beverage insulator. The projectile may optionally include small ribs, rings, indentations, or other features to help retain the object in place within the opening of the collapsible beverage insulator. The projectile can create an airtight (or sufficiently airtight) seal between the collapsible beverage insulator's internal volume and an exterior environment. Then, when air pressure within the internal volume of the collapsible beverage insulator increases past a threshold value (e.g., by collapsing one or more collapsible zones), the projectile can by expelled (e.g., shot out) from the collapsible beverage insulator. Examples of suitable projectiles include balls, ping pong balls, golf balls, cubes, dice, and the like. In an example, a die can be expelled from a collapsible beverage insulator and, upon coming to rest, can be read as a traditional hand-thrown die.

According to certain aspects of the present disclosure, the collapsible beverage insulator uses collapsible and expandable side walls (e.g., like an accordion) between flanged ends to let the collapsible beverage insulator collapse in a compact manner or expand to fit various size beverages using an airtight seal and may also be used for games. Certain aspects and features of the present disclosure relate to a sleeve with collapsible side walls and at least one flanged end, and can be used for games without necessarily being used as a beverage insulator.

Connection/Modular Insulation

The need to insulate beverages is very common and is generally done using single can beverage insulators or large coolers. Coolers can be cumbersome to insulate multiple drinks, and an individual insulator does not insulate multiple drinks. In some cases, a "beer sleeve" can be used, where cans are stacked on top of each other in a long sleeve used for insulation. The issue with such a product, however, is that once a beverage is removed for consumption, another product is needed to insulate the removed beverage, and the now-empty space within the "beer sleeve" can interfere with the insulation of the remaining beverages.

However, certain aspects and features of the present disclosure enable multiple collapsible beverage insulators to be axially connected to create a larger sleeve (e.g., a multi-insulator assembly) for insulating multiple beverages at once in a modular manner. In such implementations, a user can simply remove a single collapsible beverage insulator from the larger sleeve to enjoy a beverage, thus leaving the removed beverage insulated in the removed collapsible beverage insulator and leaving the remaining beverages insulated in their respective collapsible beverage insulators. Collapsible beverage insulators can act as modular building blocks to create larger sleeves of any suitable size. In some cases, one or more end caps or couplers can be axially coupled to a collapsible beverage insulator or between collapsible beverage insulators and can include a sling, handle, or other similar element to facilitate carrying the larger sleeve.

Game in Hand

Many games played while drinking beverages socially are large or have many pieces to a set, such as corn hole, spike ball, or beer pong. Many of these games also result in unsanitary use of cups when playing games, such as "flip cup."

However, certain aspects and features of the present disclosure enable enjoyable games to be played using the same collapsible beverage insulators used to keep beverages insulated. Thus, players can either use the collapsible beverage insulator from their own beverage or a collection of similar or identical collapsible beverage insulators can be provided to be used in games or as beverage insulators. In an example, when a player desires to play a game (e.g., when starting a game or when it is the player's turn), the player can simply slide the collapsible beverage insulator off the beverage container and use it to play against others in simple, yet adrenaline rushing games of tossing the collapsible beverage insulator in an attempt to land it in a fashion that would gain the player points (e.g., landing on a particular end, tossing sufficiently high to collapse multiple collapsible zones, and/or tossing sufficiently high to eject a projectile). In some cases, additional gaming elements, such as projectiles, game targets, score boards, and the like can be used to expand gameplay. In some cases, such additional gaming elements can be coupled to one or more collapsible beverage insulators when not in use (e.g., one or more projectiles, game board, game targets, score tokens, and the like may fit within an empty collapsible beverage insulator, such as one coupled to one or more collapsible beverage insulators insulating beverage containers).

Universal Beverage Insulator

Certain aspects and features of the present disclosure include a collapsible beverage insulator that is able to conform to different size beverages using at least one, and preferably multiple, collapsible zones and optionally flanged ends to create an airtight seal. In some cases, the entire collapsible beverage insulator or at least portions thereof can be made from an elastomeric insulating material, such as silicone or rubber, which can provide good insulation to beverages within the collapsible beverage insulator and can facilitate collapsing of collapsible zones. Other materials can be used. In some cases, the collapsible beverage insulator is formed monolithically, although that need not always be the case.

The shape of the collapsible beverage insulator is designed to collapse and expand to give the user a variety of options of air insulation across a beverage container. Since many beverage containers differ in size, traditionally a user would have different insulation sleeves for different beverage types (e.g., a standard beverage can, a slim can, a tall can, a bottle, and the like). However, certain aspects and features of the present disclosure provide a collapsible beverage insulator that can be expanded or collapsed by the user to make it taller or shorter to fit the different beverage containers. Further, the flanged ends (e.g., the ends of the collapsible beverage insulator having openings therein) being made of an elastomeric material can flex and stretch to accommodate different circumferences of containers.

Additionally, since the user is able to pick and choose which collapsible zones to expand or collapse, the user can adjust the center of gravity of the collapsible beverage insulator as desired. For example, if the user wanted to have more weight near the bottom of the beverage container, they could collapse collapsible zones near the bottom of the collapsible beverage insulator, which may beneficially make the collapsible beverage insulator more stable when resting on a surface. A user may instead choose to collapse different collapsible zones to more evenly distribute weight of the collapsible beverage insulator or for other reasons.

Additionally, a user may selectively collapse or expand different collapsible zones as a way to distinguish their collapsible beverage insulator from those of others. For example, for a collapsible beverage insulator having four collapsible zones, a total of sixteen different unique combinations of collapsed collapsible zones exist, allowing for sixteen different users to distinguish their collapsible beverage insulator based solely on collapsed collapsible zones. In some cases, additional distinguishing features can be used to further expand the number of unique combinations, such as color of collapsible beverage insulator, type of beverage in collapsible beverage insulator, additional elements coupled to the collapsible beverage insulator (e.g., a suction base), and the like.

Additionally, the ability for collapsible beverage insulators to fully collapse allows a large quantity of collapsible beverage insulators to occupy less space than they otherwise would, which can be especially desirable in various situations, such as occupying less room in a backpack or vehicle, or otherwise facilitating transport or storage of larger quantities of collapsible beverage insulators.

When used as an insulator, the collapsible beverage insulator can be collapsed as necessary to fit the height of the beverage container within. A first or top end of the collapsible beverage insulator can include a top or first opening through which the beverage container may be inserted into the collapsible beverage insulator. This first end can be made of an elastomeric material, thus flexing and stretching to fit the circumference of the beverage container. The second or bottom end can be with or without an opening (e.g., a second or bottom opening). When the second end includes a second opening, the second end can be shaped to engage a lower surface of the beverage container. In some cases, the second end can include a lip that extends into the collapsible beverage insulator to engage the lower concave surface of certain beverage containers (e.g., beverage cans). Thus, the collapsible beverage insulator is able to create an airtight seal or substantially airtight seal around the beverage container, thus trapping the volume of air adjacent the walls of the beverage container. The same way double pane windows are used in houses for insulation, this trapped volume of air acts to more efficiently insulate the beverage container by reducing heat loss due to convection. In some optional cases, one or more flanges can extend from the sidewall of the collapsible beverage insulator to contact the wall of the beverage container, such as at or between collapsible zones. These flanges can create airtight or substantially airtight seals, which can further reduce heat loss due to convection by separating the trapped volume of air between the collapsible beverage insulator and the beverage container into multiple component volumes of trapped air that are not in fluid communication (or have no substantial fluid communication) with one another. In some cases, the user can potentially push some air out and use the ends of the collapsible beverage insulator to create a negative pressure of insulation, which can further improve insulation.

In some implementations, the collapsible beverage insulator may include an annular space (e.g., an annular space between an outer portion of the sidewall and an inner portion of the sidewall). This annular space can be filled in any suitable fashion, such as with a liquid, a gas, a fluid, a solid, or a vacuum. In some cases, the annular space can be filled to improve insulation. In some cases, the material (e.g., liquid, such as water) in the annular space can be heated or cooled to help keep the beverage hot or cold, respectively, for a longer amount of time. In some cases, the annular space can be filled with a weighted material (e.g., a liquid) to affect the weight and rotation of the collapsible beverage insulator when tossed or otherwise manipulated when playing a game with the collapsible beverage insulator. In some cases, material (e.g., water) in the annular space can be frozen, allowing it to melt over time, which can be used as an element of a game. In some cases, the annular space includes one or more scalable openings to permit access to the annular space, such as to add or remove filling material.

In some cases, the inner surface of the collapsible beverage insulator, such as at least the inner surface of the sidewall, can be made of or can include a reflective layer, which can provide additional insulation.

Devices used for Games That May or May Not Insulate Beverages

When the collapsible beverage insulator is separated from a beverage container, it can be used to flip/toss and potentially land on one end indicating a point or negative point for the person flipping/tossing the sleeve against other players.

The ability to collapse collapsible zones and have them remain collapsed until a user pulls the ends apart to expand the collapsed collapsible zones can improve the ability for a collapsible beverage insulator to land in a stable fashion when playing games. For example, when the collapsible beverage insulator is tossed and lands on a surface, energy that might otherwise have caused the collapsible beverage insulator to tip over or bounce away from the surface would instead cause one or more collapsible zones to collapse. This function also helps define point scoring and when landing, as the extent to which the collapsible zones are collapsed can be used to assign a score or otherwise affect gameplay. This type of collapsible zone that can remain collapsed is thus different than an elastic zone that can be compressed but will bounce back to its original shape. In some cases, a collapsible zone that remains collapsed until external force (e.g., a user pulling on the ends of the collapsible beverage insulator) is applied to expand the collapsible zone can be referred to as a retaining collapsible zone, whereas a temporarily collapsible zone that will revert to an expanded state without application of external force can be referred to as a reverting collapsible zone.

In some implementations, reverting collapsible zones can be used. In such cases, the reverting collapsible zones can allow a collapsible beverage insulator to shoot projectiles upon landing as the collapsible zone collapses, even if the reverting collapsible zone does not remain collapsed after the projectile is expelled.

In some implementations, the collapsible beverage insulator can include identifying marks (e.g., indicators or designs) on or near the various collapsible zones to help a user identify which collapsible zones have been collapsed. The indicator can be any suitable mark, such as a number, a letter, a shape, a color, or another identifying mark. The indicator can be placed on the valley or outer portion of the collapsible zone to indicate which collapsible zones have or have not collapsed. In some cases, certain indicators or designs can be placed on segments of the collapsible zone that are hidden when the collapsible zone is collapsed. These indicators or designs that become hidden when the collapsible zone is collapsed can be referred to as hidable design elements. In some case, such hidable design elements can be used in some games to help a user identify a variable number of points earned when playing games and collapsing. The user may pick a top or a bottom number that is exposed to identify a number of points, or may choose to add, multiply, divide, etc. to calculate a score. There may also be differing marks on the same collapsible zone to identify a different point meaning depending on which end lands facing up. When another mark is on the same collapsible zone, it can be useful for that mark to have a natural orientation to an end, so the user is able to distinguish it from another. For example, if the collapsible beverage insulator has numbers on each of the collapsible zones that start with 1 through 5 from the bottom to the top, and on the other side, there is a set of numbers on the same collapsible zones that start with 5 through 1 from the bottom to the top, the orientation of the numbers would look upside down to one another depending on whether the top of the collapsible beverage insulator is up or not. Flipping one set of numbers and adding an underline mark would help a user to reference the number that is upright instead of the number that is upside down. To help with this orientation of reading and interpreting, the mark may use arrows, an underline, or other common marks.

In some cases, hidable design elements or indicators can be used, optionally along with non-hidable design elements or indicators. Depending on which, if any, of the collapsible zones are collapsed, a number of possible combinations exist for any design elements or indicators remaining visible. In some cases, the particular combination remaining visible can inform a player how to take an action or generate a score.

In an example, a collapsible beverage insulator may have the indicators “1”, “2”, “3”, “4”, “5”, “6”, and “7” located at various places on the sidewall, including segments of collapsible zones. All indicators may be visible while all collapsible zones are expanded. The game may proceed by players tossing their collapsible beverage insulators with the goal of collapsing as many collapsible zones as possible while still landing on an end. If a collapsible beverage insulator lands on its side, the player may get no points. If the collapsible beverage insulator lands on its end, the player may receive 10 points for landing on an end, but then remove points based on the sum of the indicators remaining visible. The more collapsible zones that are collapsed, the fewer indicators will remain visible. In this example, a player may toss their collapsible beverage insulator such that it lands on its end and collapses a number of collapsible zones, leaving only the indicators "1" and "2" visible. This player would score 7 points (10 minus 3). In other examples, the indicators can be combined to spell words, spell sentences, or otherwise form logical combinations.

In another example, the indicators can be words, symbols, or phrases instructing the player to perform certain actions (e.g., tell a truth, perform a dare, have a drink, or the like). A game can be played where players toss their collapsible beverage insulators and the player must perform whichever indicator(s) remain visible. Thus, to avoid, performing actions, players can attempt to collapse as many collapsible zones as possible, thus hiding some or all of the indicators.

In some cases, users can use one or more indicators (e.g., a particular combination of visible indicators or a particular indicator associated with a particular collapsed zone) to look up an action to take. For example, a collapsible beverage insulator may use indicators that take the form segments of collapsible zones having different colors, and depending on how the collapsible beverage insulator is tossed, one or more colors will be selected. The user may then look up an action to take based on the one or more selected colors. For example, the user may find the selected color(s) on an instruction sheet, which may list an action to take associated with each color or combination of colors. In another example, a set of card decks can be provided (e.g., with the collapsible beverage insulator) such that each possible color or combination of colors can correspond to a particular deck. Thus, based on the selected color(s), the user would pick a card from the corresponding deck(s). For example, a user may toss their collapsible beverage insulator such that the colors blue and red are visible. The user can then pull a card from each of the red and blue decks.

In some implementations, the collapsible beverage insulator may include differing colors of marks that correlate to an additional object for gameplay. For example, different inner segments of collapsible zones can have different color marks that are shown or hidden depending on if the collapsible zone is collapsed or expanded. When visible, the color can be correlated with a colored card that has text on it identifying a number of points or words to describe an action a user needs to take when the color is visible. Examples of such actions include answer a question truthfully, perform a dare, take a drink, and the like.

In another example, the collapsible beverage insulator may include a set of indicators that include multiple subsets of repeated indicators. A game may be played that involves tossing the collapsible beverage insulator and performing an action based on which of the subsets of repeated indicators contains the most visible indicators. For example, a collapsible beverage insulator may include three "truth" indicators and three "dare" indicators. If the toss ends up with one "truth" indicator and two "dare" indicators remaining visible, the player may be instructed to perform a "dare" action.

In some cases, the collapsible beverage insulator may include a set of indicators that include at least a subset of indicators that are hidden from view when the at least one collapsible zone is in the collapsed state. The collapsible beverage insulator may be able to exist in a number of different states of being collapsed based on how collapsed the collapsible beverage insulator may be. For each, or at least some of, the different states, the combination of indicators remaining visible can interact to form a cohesive design.

In some cases, the sidewall can include one or more separable indicators (e.g., one or more separable designs). Each separable indicator can include a first sub-indicator and a second sub-indicator separated by a portion of a collapsible zone. When the collapsible zone is collapsed, the first sub-indicator and second sub-indicator can be positioned adjacent to one another to create a particular indication or design (e.g., a "+1" used to indicate the user should add one to a score). When the collapsible zone is expanded, the first sub-indicator and second sub-indicator can be separated from one another, thus no longer forming the particular indication or design that would otherwise be formed when the collapsible zone is collapsed. In the aforementioned example, the first sub-indicator and second sub-indicator may be the top half and bottom half of a "+1", respectively. In some cases, the first sub-indicator and second sub-indicator, respectively, are top and bottom portions (e.g., top and bottom halves) of a particular indication or design, although that need not always be the case. In some cases, the first sub-indicator and second sub-indicator, respectively, are left and right portions (e.g., left and right halves) of a particular indicator or design. In some cases, the first sub-indicator and second sub-indicator are any two designs that, when combined, form a particular indication or design.

In some implementations, the surface of the collapsible beverage insulator, or at least a portion thereof, can be made of a non-porous material (e.g., silicone) such that it may be drawn and written on using non-permanent ink and remain easily erasable similar to a whiteboard. Thus, players can customize their collapsible beverage insulator with their own point scoring marks or action marks to customize their game. Such customization can be done within each expanding and collapsing collapsible zone, or across collapsible zones.

In some implementations, the collapsible beverage insulator may have differing colors or indicators on each half of the collapsible beverage insulator. The color or indication such as a differing texture, etc. may be split down a vertical axis or a horizontal axis. This implementation may make it easier for game variations to score differently based on a team or player associated with that identifier. For example, if the top half of the collapsible beverage insulator is a different color, then a player can claim that is "their side" indicating that when a collapsible beverage insulator is used in a game, that when their colored end faces up, points are awarded to that player. This concept extends to the other colored end for another player. Similarly, the divide of indication, color, etc. can be split down a vertical axis and be correlated to another identifier such as the mark on an inner or outer segment of a collapsible zone to indicate a player's scoring method or different game version. For example, the mark on the inner or outer segment of a collapsible zone may be a series of numbers 1 through 4 from top to bottom on the half of the collapsible beverage insulator that is blue. On the other half of the collapsible beverage insulator (e.g., red), another set of number marks 4 through 1 from top to bottom with a specific orientation, indicating that because the marks are on a different colored half of the collapsible beverage insulator, they are used in another form such as a player's claimed color.

In some implementations, the opening (e.g., hole) on the bottom of the collapsible beverage insulator generally matches and is slightly smaller in diameter than a common ping pong ball (e.g., at or approximately 40 mm), although that need not always be the case. In this form, a ping pong ball can be inserted into the collapsible beverage insulator to be used as a projectile that can be propelled out of the collapsible beverage insulator due to an increase in internal air pressure when collapsing a collapsible zone. The diameter of the opening can be the same size or slightly smaller than the diameter of the ball to create sufficient pressure to retain the ball and eject the ball with the increase in air pressure attributable to collapsing of one or more collapsible zones. Similarly, the opening may be not significantly smaller than the diameter of the ball to avoid requiring too much force to eject the ball.

This opening can include an internal lip that extends inward, such as at about 3-6 mm deep. This lip can have a thickness of about 1 to 2 mm thick. The lip may be of uniform thickness or may vary in thickness across the depth of the lip. The lip may have a mixture of thicknesses to provide a portion that engages and retains the ball (or other projectile) and a portion that directs and cradles the ball (or another projectile). An example of such a lip would be a lip that extends inward about 1 to 2 mm deep with a uniform thickness, then tapers off towards a point for creating a slant in the remainder of the lip. The about 1 to 2 mm of uniform thickness gives sufficient surface area to hold the ball in place when pressed slightly into the hole directly. The slanted portion of the lip can guide and cradle the ball in place of the opening when dropped in and not pressed into the opening directly because the slant is creating a shape that generally matches the difference in diameter across a sphere.

In some implementations, the ball referenced as a projectile object does not have to be a common ping pong ball. The projectile can have a shape other than a sphere. For example, the projectile can be in the shape of a cube, such as a dice, with a corresponding square-shaped opening in the end of the collapsible beverage insulator. The relationship of the projectile and the opening shape and size can be set to ensure the projectile can be properly propelled as desired in response to collapsing of one or more collapsible zones. Similarly, the projectile and/or the opening may have small ridges, indents, or other elements that match one another to create a better hold or fit.

In some implementations, each end of the collapsible beverage insulator can include an opening. In some cases, each opening is the same in size. In such cases, the same projectile can be used in both ends and/or two projectiles can be used at the same time. In some cases, two or more collapsible beverage insulators can be connected together to create a larger cavity of air for pressure when collapsing.

In some implementations where there is an opening at both ends of the collapsible beverage insulator, the user can insert a projectile in either end. When the user tosses the collapsible beverage insulator and it lands on a smooth surface with the projectile on top, the flat surface in combination with the end of the collapsible beverage insulator can create an air seal and any collapsible zones that collapse can increase air pressure within the collapsible beverage insulator, resulting in ejection of the projectile.

In some implementations, the projectile can move freely within the internal volume of the collapsible beverage insulator. When the collapsible beverage insulator is flipped, centrifugal force can move the projectile into an opening (e.g., guided by a tapered internal lip), where the projectile can be retained until it is ejected out through collapsing of one or more collapsible zones.

In some implementations, the projectile can sit in an opening in an end of a collapsible beverage insulator where it can be manually pressed through the opening into the internal volume of the collapsible beverage insulator.

In some implementations, when the projectile (e.g., ball, such as a ping pong ball) is pressed through an opening (optionally with a lip), the amount of force needed to overcome the friction of the opening's diameter and geometry of the opening and, if used, the lip combination, can be at or approximately 0.15-1.0 kgf. In other words, the opening can receive the projectile such that a force of at or approximately 0.15 to 1.0 kgf is needed to eject the projectile. In some cases, the amount of force is at or approximately 0.1 to 1.5 kgf. In some cases, the amount of force is at or approximately 2 kgf.

In addition, the geometry of the lip holding the projectile in place can flex to conform to the projectile, creating slightly more friction and holding pressure (similar to a pinch due to the opening's diameter becoming smaller) when being propelled out, helping guide the projectile out of the inner volume of the collapsible beverage insulator, resulting in the projectile being propelled at a higher rate of speed. In addition, the material on the end of the collapsible beverage insulator and where the opening and lip are located can be flexible to help create pressure and release when enough pressure is met. If this surface were not flexible, the projectile may not be able to flex out of the hole sufficiently and may not eject properly.

In some implementations, the projectile can sit in the opening in an end of a collapsible beverage insulator where it cannot be pressed through the opening into the collapsible beverage insulator (e.g., because the opening is too small for the outer diameter of the projectile). In this implementation, if an opening and projectile are used in both ends, when the collapsible beverage insulator lands, the projectile on the landing end can create an airtight seal for the opposing side's projectile to be ejected with pressure from the collapsing collapsible zones.

In some implementations, the material of the collapsible beverage insulator can be flexible and the wall structure can be kept so the material can flex and compress in other directions. For example, when the collapsible beverage insulator lands, if it lands on its side or at an angle that is not directly on an end, a material can be selected such that the collapsible beverage insulator would still compress to force air out of an opening in an end and shoot the projectile. This flexibility in the wall structure and material can allow for the collapsible beverage insulator to compress in a direction that does not result in collapsing collapsible zones, but does create sufficient air pressure within the collapsible beverage insulator to eject the projectile at a sufficiently high rate of speed.

Because of the collapsing structure, the energy from the collapsible beverage insulator falling with gravity is absorbed by each collapsible zone on impact when it the collapsible beverage insulator lands on an end. When the collapsible beverage insulator makes first impact, the weight of the collapsible beverage insulator and material above the impact point continues to accelerate, causing the bottom collapsible zone to collapse, and continue collapsing collapsible zones up the structure. But because each collapsible zone is collapsed, and the remaining weight still accelerating is reduced by what is already collapsed, the weight and force needed to collapse each consecutive collapsible zone is increased exponentially. In other words, the amount of energy needed to collapse two collapsible zones may be substantially more than the amount of energy needed to collapse one collapsible zone, and similarly for any number of collapsible zones. Thus, for more collapsible zones to collapse, the collapsible beverage insulator may need to fall from an exponentially greater height, making it exponentially more difficult to do so, especially when playing games with the collapsible beverage insulator. Thus, in games where the more collapsible zones collapsed increases points, but landing accuracy is important, a high-risk and high-reward scenario is created whereby a player must decide whether or not to attempt to collapse more collapsible zones at the potential cost of landing accuracy. Such scenarios are not easily replicated in other games.

An example of the drop heights required to collapse each collapsible zone are as follows for a collapsible beverage insulator made from 65A durometer silicone and weighting 3.4 oz; 1 collapsible zone requires about a 6" drop or about 1.44N of energy, 2 collapsible zones require about 13.5" or about 3.8N force, 3 collapsible zones require a 32" drop or about 7.68N force, and 4 collapsible zones require about a 60.5" drop or about 14.5N force. These values can change depending on the durometer and material make up, diameter of the collapsible beverage insulator, among other factors, but the exponential amount of energy required when dropping for impact will remain. For example, the same collapsible beverage insulator made with 55A durometer material will require less height to collapse each collapsible zone, but will still need to be dropped from an exponentially higher point to collapse each consecutive collapsible zone.

In cases where the collapsible beverage insulator has an opening at each end, the collapsible beverage insulator will be able to collapse when landing on either end. If the collapsible beverage insulator only has one end with an opening, the collapsible beverage insulator can only efficiently collapse when it lands with the opening face up. Both implementations of collapsible beverage insulators can be useful in playing games.

In some implementations, the collapsible beverage insulator may not have an opening on the bottom end, which may take the form of a solid face, optionally with a suction cup extending downward. The suction cup base can be useful in making sure that when the user is using the collapsible beverage insulator as a game or as an insulator and places or lands the collapsible beverage insulator on a smooth surface, it adheres to the surface through suction.

In some implementations, one or more of the ends does not have to be flat and can still use flanged gasket ends.

In some implementations, the collapsible beverage insulator may have a suction cup flange on the top and the bottom. The ends of the collapsible beverage insulator may have gasket flanges in addition to cone shaped flanges extended downward from the end of the collapsible beverage insulator.

In some implementations, both ends of the collapsible beverage insulator may have a suction cup flange and an opening on each end. The openings in each end may be the same or different sizes, as well as same or different shapes. The general idea is that the openings will complement the shape and size of the projectile if used.

In some implementations of the collapsible beverage insulator that have a hole on the top or bottom, a secondary spool device can be inserted into both holes individually to create an airtight seal when coming in contact with a surface with downward pressure. This device is a spool-like shape that consists of an upper plate (e.g., upper flange), a vertical core (e.g., spool body), and a lower plate (e.g., lower flange). The vertical core has a smaller diameter than the diameter of the opening of the collapsible beverage insulator, thus allowing air in when the spool is able to move axially (e.g., when in a relaxed and not pressured position). The plates of the spool have a generally larger diameter than the opening and do not exceed the inner diameter of the collapsible beverage insulator sidewall. This spool device can be used in game variations to create the airtight seal when the collapsible beverage insulator lands on the end with the spool in it. Upon landing, the lower flange of the spool is forced against the end of the collapsible beverage insulator, thus creating an airtight (or substantially airtight) seal. In such cases, collapsing of a collapsible zone can create sufficient air pressure to push a projectile out of the opposing opening.

In some implementations, the spool device may have a suction cup on one or both ends instead of the flat ends. This suction cup serves to create the airtight seal when pressed up against the collapsible beverage insulator's end as well as creating a suction attachment to a surface on the external face of the spool.

In some implementations, the spool device may have a center opening or other shaped opening for receiving and retaining a projectile. This opening would generally match the shape of the projectile and create an airtight seal between the spool and projectile.

In some implementations, the spool can use a collar that is threaded or snap-lock, etc. to pinch and squeeze the collapsible beverage insulator's gasket end and create an airtight seal. This collar and seal can be useful in connecting collapsible beverage insulators together to prevent the gasket from slipping out around the spool faces. This connection also creates an airtight seal for insulation. This spool and collar assembly can also be used in the collapsible beverage insulator when playing games on uneven surfaces. Users can insert this spool and collar in an airtight or non-airtight position to create a surface that the gasket presses against when landing, in turn, allowing the air in the internal volume of the collapsible beverage insulator to push a projectile out of the other side when collapsing. The added weight to an end where this spool is used can also aid in the flipping and changes of the collapsible beverage insulator landing on that end.

In some implementations, the collapsible zones can partially collapse across the length and/or height of the collapsible beverage insulator. Doing so can change the direction of the opening with the projectile, which can make the projectile eject in different directions.

In some implementations, the device may include alternate versions of the collapsible zones for yard games as well as the connection methods for transportation. These implementations do not require an airtight seal and insulation of a beverage. Most other yard games involve a ball, disc, bag, or some other common shape as an object to toss. This yard game can use a unique shape for the distinct purposes of collapsibility along with a spring force that creates a sense of randomness that you do not see in other common objects or games.

Methods of Use for Simple Game Variations

Certain aspects and features of the present disclosure can enable various game variations to be played. The main elements of most game variations make use of the collapsible beverage insulator's ability to collapse upon impact. Such collapsing action can be leveraged for point scoring (e.g., via markings associated with collapsible zones), can be used to expel projectiles, or can be otherwise used in a game.

In some game variations, a point is scored when the player flipping/tossing the collapsible beverage insulator lands the collapsible beverage insulator on an end (e.g., not on its side). In some advanced variations, different ends of the collapsible beverage insulator can result in different outcomes when facing up or facing down. For example, a first player or team can be associated with a first end, whereas a second player or team can be associated with a second end. If the first end lands face up, points can be added to the first player or team, however if the second end lands face up, points may be added to the second player or team or deducted from the first player or team. In some variations, no points are given or deducted when the collapsible beverage insulator does not land on one of the ends.

In some game variations, if the collapsible beverage insulator lands with sufficient force to collapse one or more collapsible zones, the collapsible zone(s) collapsed can affect scoring or gameplay. For example, a number of collapsible zones collapsed can be added to the number of points associated with the collapsible beverage insulator landing on an end (e.g., added and/or deducted, depending on the gameplay variation). Thus, there may be an incentive to toss the collapsible beverage insulator higher with the goal of achieving more points, however doing so may require more skill to ensure the collapsible beverage insulator lands on an end (or a desired end, such as to avoid losing extra points). In some variations, partially collapsed collapsible zones may indicate another variable set of points. In some variations, partially collapsed collapsible zones that result in the collapsible beverage insulator leaning in a direction may indicate another variable set of points.

In some cases, ends of the collapsible beverage insulator can be weighted to help guide the collapsible beverage insulator to land on an end rather than its sidewall. Additionally, since silicone has a significant elastic response, the shape of the collapsible zones can provide a natural "spring" response, which can provide a sense of "randomness" and counteract the weighted ends when the collapsible beverage insulator is tossed and lands on a surface. Such a rebound effect can make the landing on one end harder unless there is enough pressure to collapse collapsible zones, this requiring more skill to achieve consistent results.

In some game variations, the collapsible beverage insulator can be used in place of a beverage container for "flip cup" style drinking games, thus avoiding various drawbacks with using drinking containers (e.g., contamination concerns, spilled liquids, cleanliness concerns, and the like). The collapsible beverage insulator can be used to hold the beverage container while drinking, then the player can take it off of the beverage container to flip/toss it for points on their team.

In some game variations, the collapsible beverage insulator may be rolled to a destination or landing zone for points. In some cases, collapsible zones can be intentionally collapsed or expanded by the player to selectively control the directionality of the roll, thus providing an additional degree of strategy and skill to the game.

In some game variations, partial collapsing of collapsible zones can create a directional indication of a collapsible beverage insulator that has been tossed and has landed on one end. This directional indication can be used for various gameplay purposes, such as scoring points.

In some game variations, the ability to connect multiple collapsible beverage insulators together axially can be leveraged for "wizard staff" style drinking games where a number of a player's consumed beverages is indicated by a number of collapsible beverage insulators coupled to the collapsible beverage insulator currently in use by the player for the player's active beverage.

In some game variations, players can be instructed to take actions instead of awarding or deducting of points, such as answering questions truthfully, performing dares, taking sips or drinks, or the like. In some game variations, additional drinks, tokens, or coupons may be earned instead of points.

In some game variations, points can be represented by collapsible zones being expanded instead of being collapsed. In some cases, one or more collapsible beverage insulators can be used to keep score of another game (e.g., foosball), such as by manually collapsing or expanding one or more collapsible zones. For example, each goal in foosball may result in collapsing another collapsible zone, with a winner being announced once all of that player's collapsible zones have been collapsed.

In an example of a game variation, the gameplay may include scoring a point if the player lands a collapsible beverage insulator on end in the landing zone. In some cases, the player must land the collapsible beverage insulator with a specific end facing up to gain points. In some cases, if the player lands the collapsible beverage insulator with their specific end facing down, points are deducted from the player. In some cases, additional points are added for each collapsible zone that has been collapsed. In some cases, additional points are added if the collapsible beverage insulator lands around a target pole. Scoring can occur on the fly or at the end of a round of multiple tosses (e.g., using cancellation scoring). In some cases, players can knock already landed collapsible beverage insulators out of the landing zone or off of an end to affect scoring. Any suitable end point can be used. In an example, the game can end by the first person to reach at last 21 points and surpass the opponent(s) by at least 2 points.

Certain aspects of the present disclosure enable advanced strategies, which can greatly improve the gameplay experience. If an opponent has a collapsible beverage insulator in scoring position, it may be wise for a player to toss theirs in a way that knocks the opponent's off their end or bumps it out of the landing zone. If a player knocks another player's collapsible beverage insulator, moving it to a position where the player's identifying end is face up, the player will get the additional point.

As described above, in some cases, instead of a collapsible beverage insulator, certain aspects of the present disclosure can take the form of a collapsible game piece. In such cases, the collapsible game piece may or may not have openings at both ends. The collapsible game piece includes at least a projectile opening in which the projectile can be placed and from which the projectile will be expelled upon collapsing of the collapsible game piece. When the collapsible game piece includes an opening opposite the projectile opening, such an opening can be used in the attachment of accessories, such as a nose piece. Such an opening can be known as an accessory opening. The accessory opening and second opening can be the first opening and second opening of the collapsible beverage insulator.

The collapsible game piece includes a main body, which includes a collapsible sidewall, a nose end, and a projectile end. Often, the sidewall, nose end, and projectile end are monolithically formed, although that need not be the case. The projectile opening is located in the projectile end. An optional accessory opening can be located at the nose end. In some cases, the collapsible game piece can include a tail and/or a set of fins. Any of the sidewall, nose end, projectile end, accessory (e.g., a nose piece), tail, fins, or other components of the collapsible game piece can be individually made and assembled together (e.g., via threaded couplings, interference fit, fasteners, adhesives, snaps, magnets, and the like) or can be made monolithically. Various combinations of these collapsible game piece components can be used.

In some cases, certain components of the collapsible game piece are separable (e.g., a sidewall with integral nose end and projectile end, fins, and a nose piece), thus allowing the user to assemble or disassemble the collapsible game piece as desired. In some cases, a set of components can be packaged together that includes multiple options for any given component. For example, different versions of the sidewall may be provided, each of which is made from a different material or made to exhibit a different durometer measurement. A user can select which version of the sidewall they wish to use for a particular game. In some cases, one version of the sidewall may increase the difficulty of the game more than another version. For example, a collapsible game piece with a harder sidewall will need to be tossed higher to eject a projectile upon landing than would a collapsible game piece with a softer sidewall. Different versions of any component of the collapsible game piece can be used, including made from different materials, shaped differently, or including different features (e.g., a suction cup nose piece and a hook and loop nose piece). In some cases, an interchangeable projectile end or portion thereof (e.g., lip) can permit a collapsible game piece to be configured for different sized projectiles and/or to retain a given projectile with different amounts of force. In some cases, variations of a component can be in different colors and/or have different markings or identifiers. In such cases, users on a common team may be able to select the same variation for a given component. For example, all users on a first team may select a sidewall that is red, whereas all users on a second team may select a sidewall that is blue.

Additionally, when the collapsible game piece is modular in nature, it can allow a user to build different versions of the collapsible game piece with different combinations of components. For example, a user may initially have a collapsible game piece with no nose piece and a simple projectile end with a projectile opening This collapsible game piece may be a collapsible beverage insulator that takes the form of a traditional beverage insulator, allowing a beverage to be inserted through the accessory opening. Such a collapsible game piece can be used for certain games, but may be inefficient or improper for other games. The user may then insert a conical nose piece into the accessory opening in the nose end and replace the simple projectile end with a tail having a new projectile end and fins. This newly configured collapsible game piece may be especially suited for additional games for which the originally configured collapsible game piece was not suitable.

The projectile end includes a projectile opening into which a projectile can be placed. The projectile opening can be elastically deformable to aid in receiving the projectile at least partially therein. The projectile opening can be configured to form a generally sealed interface around the projectile inserted therein.

The projectile opening for a particular collapsible game piece can be sized to fit a particular sized projectile, such as a ping pong ball. The collapsible game piece can include a lip at the projectile opening. The lip can be formed as part of the projectile end. The lip can retain the projectile when it is inserted into the projectile opening. The lip can be configured (e.g., via adjusting the elasticity or durometer hardness, diameter, profile, or other features of the lip) to require different amounts of pressure to be applied (e.g., via collapsing the collapsible game piece) before the projectile is expelled. The amount of pressure needed to expel the projectile affects how the projectile travels once expelled from projectile opening. For example, high pressure will cause the projectile to travel further and/or faster than if the pressure were lower. The amount of pressure needed to expel the projectile can be known herein as expulsion pressure. The expulsion pressure can be controlled by adjusting properties of the lip and/or properties of the projectile. Example properties that can be adjusted include elasticity or durometer hardness of the material making up the lip or projectile, the size (e.g., diameter, circumference, or analogous measurements for non-circular features) of the lip or projectile), or the profile of the lip or projectile. The profile of the projectile refers to the external features of the projectile that contact the lip, such as a smooth surface of a ping pong ball or ribs of a ribbed ball.

In some implementations of the present disclosure, the projectile opening, or lip thereof, is made of a relatively soft material (e.g., flexible silicone), permitting the projectile opening to elastically deform to accept a projectile (e.g., a projectile that is made from a relatively hard material, such as, for example, plastic used in standard ping pong balls). Hardness and softness can be measured in any suitable technique, such as durometer hardness. In some cases, however, the projectile opening, or lip thereof, can be made of a relatively hard material (e.g., a hard plastic) that retains its shape when a projectile of a relatively soft material (e.g., a felt ball) is inserted therein. In some cases, the projectile opening, or lip thereof, and the projectile can both be made of soft materials. In some cases, the projectile opening, or lip thereof, and the projectile can both be made of hard materials. In such cases, additional components, such as moving components (e.g., spring-biased clamps) can be used to facilitate retaining the projectile within the projectile opening, creating a generally sealed interface between the projectile opening and the projectile, and permitting the projectile to be expelled when sufficient pressure builds within the game piece.

During gameplay, the collapsible game piece can be tossed or thrown. To improve the likelihood that the collapsible game piece will land with the projectile opening facing upwards (e.g., exactly upwards or generally upwards), the collapsible game piece can have (i) a center of gravity closer to the nose end than the projectile end; (ii) stabilizing features to keep the nose end pointing downwards; or (iii) both (i) and (ii). To affect a center of gravity closer to the nose end than the projectile end, the nose end can be weighted, such as through the use of heavier and/or thicker material at the nose end, through the use of a weight inserted into the collapsible game piece, and/or through the use of a weighted nose piece. In some cases, the collapsible game piece can make use of a tail, which can be an elongated region extending from the collapsible sidewall opposite the nose end, thus offsetting the projectile end further from the collapsible sidewall than the nose end. The tail can optionally support fins.

Optional stabilizing features can be used to improve flight of the collapsible game piece and ensure the collapsible game piece will land with the projectile end facing upwards. The use of stabilizing features can push the center of pressure of the collapsible game piece in flight towards the projectile end. When used to ensure the collapsible game piece lands with the projectile end facing upwards, the stabilizing features can put the center of pressure of the collapsible game piece closer to the projectile end than the center of gravity of the collapsible game piece. For example, one or more fins can be positioned adjacent the projectile end to create sufficient drag to stabilize the collapsible game piece during flight. To ensure the fins do not interfere with collapsing of the collapsible game piece, the fins can be coupled to or formed as part of the projectile end, or can be coupled to or formed as part of a tail.

The nose end can include an optional accessory opening, which can receive one or more accessories. To improved ejection of the projectile, an accessory used in the accessory opening can either seal the accessory opening when inserted or can seal the accessory opening when the collapsible game piece lands on the ground (e.g., lands on the accessory). Sealing the accessory opening can include restricting fluid flow out of the interior volume, such as fully or substantially restricting the flow of air out of the interior volume. In some cases, the accessory can be weighted to promote the collapsible beverage insulator landing with the projectile opening facing upwards. An accessory can fit within the accessory opening, such as via an interference fit that keeps the accessory in place within the accessory opening. An accessory can be coupled to the collapsible game piece at accessory opening in any suitable fashion, such as those described in further detail herein.

In some cases, the accessory can be a nose piece on which the collapsible game piece can land when used during gameplay. The nose piece can be conic, flat, truncated spherical or spheroid (e.g., a spherical segment), truncated paraboloid, or any other suitable shape. The nose piece can be made of a sturdy material that can withstand many landings, such as a hard plastic material or the like. A conic or truncated spheroid nose piece can be especially useful for games in which consistent aerodynamics and landing accuracy is needed. A flat nose piece creates additional drag and helps the collapsible game piece land and stay in an upright (e.g., nose-down) position, which can be especially useful for games in which it is desirable for the collapsible game piece to stay upright and/or to stay where it lands (e.g., when landing within a target area). A pointed nose piece can be especially useful in games where there is a desire for the collapsible game piece to pierce an object or to remain in the orientation in which it lands when tossed towards a suitable target, such as sand, dirt, or grass. A suction cup nose piece can be especially useful when there is a desire for the collapsible game piece to stick to a place on a smooth surface where the collapsible game piece lands. A hook and loop nose piece can be especially useful to stick to a place on a target with corresponding hook and loop features. In some cases, a collapsible game piece can be packaged in a set along with multiple nose pieces of different styles, thus allowing a user to select the desired nose piece for the game they wish to play or for the location in which they are playing the game (e.g., outside on grass versus inside on carpet).

While the different styles of nose pieces are described as being an accessory that can be attached at an accessory opening, the same styles of nose pieces can be incorporated into the nose end itself, with or without the nose end including an accessory opening.

In some cases, a surface of the collapsible game piece other than the nose end or nose piece can include coupling features designed to couple to a nose piece or nose end of another collapsible game piece. Such coupling features can be especially useful in collapsible game pieces with tails. For example, the tail can include a flat, smooth surface for receiving the suction cup nose piece, or a suction cup surface for attaching to a flat nose piece, or a hook and loop surface for receiving a corresponding hook and loop nose piece. The use of such coupling features enables a collapsible game piece to couple to another collapsible game piece, thus opening up additional possibilities for gameplay and scoring.

In some cases, the collapsible game piece can include a sidewall without collapsible zones, but with bellows-like zones instead. Each bellows-like zone can flex to permit compression of the sidewalls (e.g., upon landing), thus ejecting the projectile, then spring back to its original form.

In some implementations, instead of a collapsible game piece, a compressible game piece can be used. The compressible game piece includes a sidewall without collapsible zones or bellows, and instead relies on the elasticity of the sidewall itself to permit the sidewall to be compressed (e.g., upon landing), thus ejecting the projectile, then spring back to its original form.

In some implementations, a game piece can include both collapsible and compressible aspects. For example, a game piece can include a movable zone that is (i) a collapsible zone; (ii) a compressible zone; or (iii) a combination of (i) and (ii). Primarily collapsible game pieces have been described herein for illustrative purposes. However, one or more compressible zones can replace any collapsible zones of the implementations disclosed herein to create mixed collapsible/compressible game pieces or entirely compressible game pieces. Thus, any reference to a collapsible game piece or collapsible zones can be replaced by a compressible game piece or compressible zones, as appropriate, to describe additional implementations of the present disclosure.

The collapsible game piece can, where applicable, be used in any way as described herein with reference to a collapsible beverage insulator.

In some cases, the collapsible game piece can be distributed as part of a kit containing the collapsible game piece and multiple alternative components that can be swapped out for components already part of the collapsible game piece. For example, a kit may include (i) one or more projectile ends having different properties (e.g., different colors, different size projectile openings, different elasticities or durometer hardnesses, etc.); (ii) one or more sidewalls having different properties (e.g., different colors, different elasticities or durometer hardnesses, different number of collapsible zones, etc.); (iii) one or more nose ends having different properties (e.g., different colors, different elasticities or durometer hardnesses, with or without an accessory opening, etc.); (iv) one or more nose pieces with different shapes and/or properties; (v) one or more tails (e.g., a tail with its own projectile end that can replace another projectile end); (vi) one or more sets of fins (e.g., a set of fins couplable to the sidewall and/or a set of fins with its own projectile end that can replace another projectile end); or (vii) any combination of (i)-(vi).

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative implementations but, like the illustrative implementations, should not be used to limit the present disclosure. The elements included in the illustrations herein may not be drawn to scale.

FIG. 1 is a view of a collapsible beverage insulator 100, according to certain aspects of the present disclosure. The collapsible beverage insulator 100 can be a collapsible beverage insulator as described in further detail herein.

The collapsible beverage insulator 100 includes a sidewall 128 coupling a first end 102 to a second end 104. As depicted in FIG. 1, the first end 102 is a "top" end and the second end 104 is a "bottom" end. The sidewall 128, first end 102, and second end 104 can define an interior volume of the collapsible beverage insulator 100. An axial axis 130 can pass through the axial center of the collapsible beverage insulator 100 (e.g., through the center of the first end 102 and the center of the second end 104 as depicted in FIG. 1).

The first end 102 has an outer surface upon which a first end design element 108 can be located. The first end design element 108 can be any suitable design element, such as a brand name or logo, gameplay instructions, a player indicator, and the like.

The first end 102 has a first opening 106. The first opening 106 can be a hole that is circular in shape or otherwise shaped as disclosed in further detail herein. The first opening 106 can be sized to accept a beverage container, such as a beverage can. The first end 102 can be made from an elastomeric material, thus enabling the first opening 106 to flex and stretch to accommodate different circumferences of beverage containers.

As described in further detail herein, the collapsible beverage insulator 100 can include a number of collapsible zones. As depicted in FIG. 1, the collapsible beverage insulator 100 includes a first collapsible zone 120, a second collapsible zone 122, a third collapsible zone 124, and a fourth collapsible zone 126.

Optional indicators 110, 112, 114, 116, 118 can be located on the sidewall 128 at locations associated with each of the collapsible zones 120, 122, 124, 126, respectively. Thus, as one or more of the collapsible zones 120, 122, 124, 126 are collapsed during use, the indicators 110, 112, 114, 116, 118 can be used to easily identify how many collapsible zones 120, 122, 124, 126 are collapsed and/or how many points are to be scored.

As depicted in FIG. 1, each of the collapsible zones 120, 122, 124, 126 has an hourglass-shaped profile, although other profiles can be used.

Figure 2:
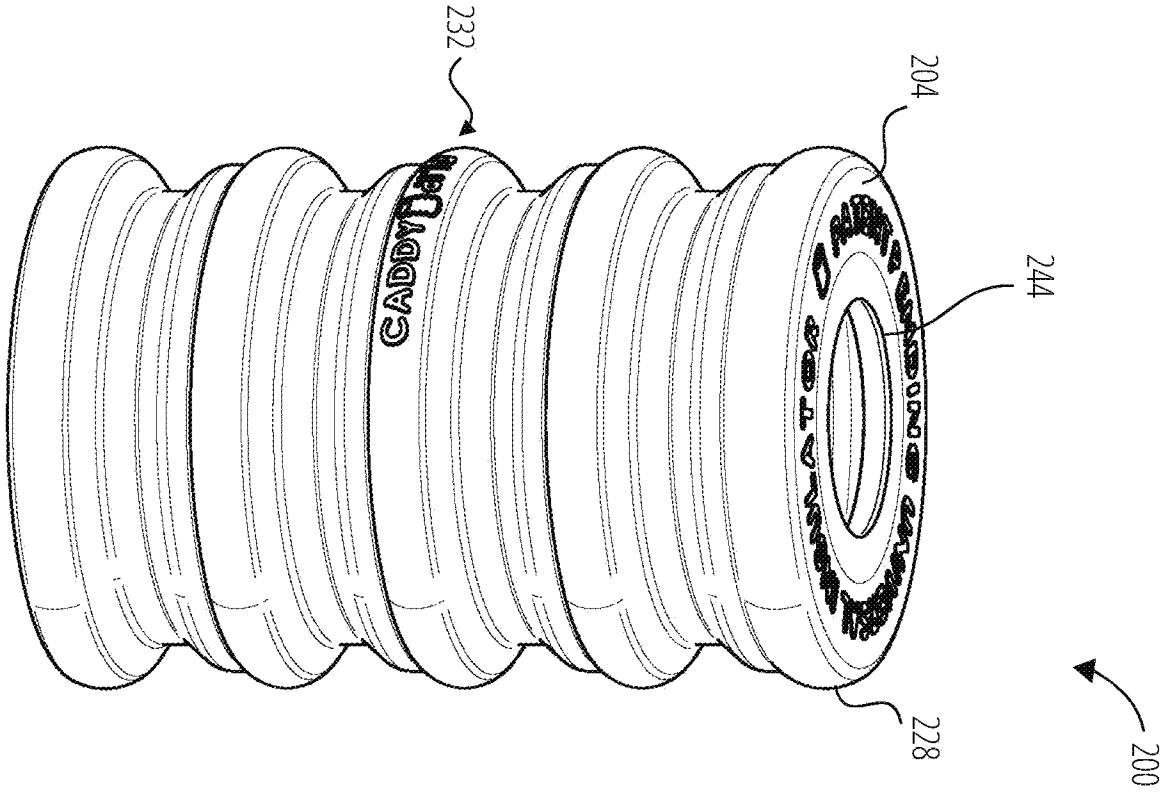
FIG. 2 is a view of a collapsible beverage insulator with a sidewall design, according to certain aspects of the present disclosure.

FIG. 2 is a view of a collapsible beverage insulator 200 with a sidewall design 232, according to certain aspects of the present disclosure. The collapsible beverage insulator 200 can be similar to the collapsible beverage insulator 100 of FIG. 1. The sidewall 228 can include a sidewall design 232. The sidewall design 232 can be located in any suitable location on the sidewall 228, such as between collapsible zones. As depicted in FIG. 2, the sidewall design 232 is located approximately centered along the length of the sidewall 228.

The collapsible beverage insulator 200 is depicted in FIG. 2 with the second end 204 facing up (e.g., towards the top of FIG. 2). The second end 204 includes a second opening 244. The second opening 244 can be any suitable size, although is often a smaller size than the first opening (e.g., first opening 106 of FIG. 1). The second opening 244 can be any suitable shape, such as circular, square, or otherwise as disclosed herein. In some cases, the second opening 244 is sized to accept a projectile (e.g., a ping pong ball, a die, or the like).

In some case, collapsible beverage insulator 200 can be the same as collapsible beverage insulator 100 of FIG. 1, with the sidewall design 232 visible as facing towards viewer and the indicators (e.g., indicators 110, 112, 114, 116, 118 of FIG. 1) not visible as facing away from the viewer.

Figure 3:
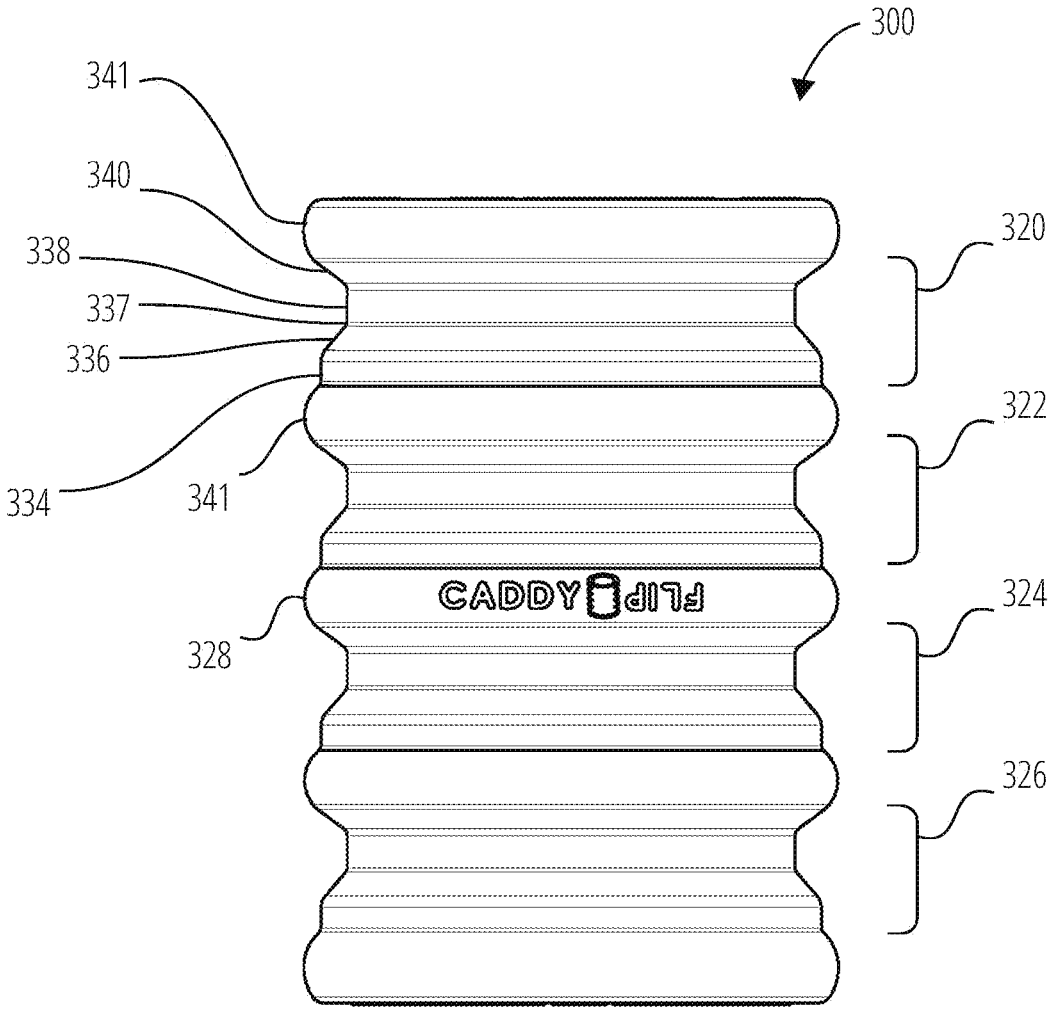
FIG. 3 is a front view of a collapsible beverage insulator, according to certain aspects of the present disclosure.

FIG. 3 is a front view of a collapsible beverage insulator 300, according to certain aspects of the present disclosure. Collapsible beverage insulator 300 can be the same as or similar to collapsible beverage insulator 200 of FIG. 2.

The sidewall 328 of the collapsible beverage insulator 300 can include multiple collapsible zones 320, 322, 324, 326. Each collapsible zone 320, 322, 324, 326 can be made of multiple segments also known as wall portions. As depicted in FIG. 3, each collapsible zone 320, 322, 324, 326 includes a second wall portion 334, a third wall portion 336, a fifth wall portion 338, a sixth wall portion 340, and optionally a first wall portion 341. Any suitable number of wall portions can be used.

When in an expanded state, as depicted in FIG. 3, each of the wall portions 334, 336, 338, 340 are arranged axially spaced apart (e.g., not overlapping). When a collapsible zone is collapsed, one or more of the wall portions 334, 336, 338, 340 can be folded over such that at least one wall portion 334, 336, 338, 340 overlaps another. For example, when collapsed, third wall portion 336 can fold behind second wall portion 334, fifth wall portion 338 can fold behind third wall portion 336, and sixth wall portion 340 can optionally fold behind first wall portion 341. In some cases, first wall portion 341 can be considered as part of the collapsible zone, however in some cases first wall portion 341 can be considered as part of the sidewall 328 adjacent a collapsible zone.

Figure 4:
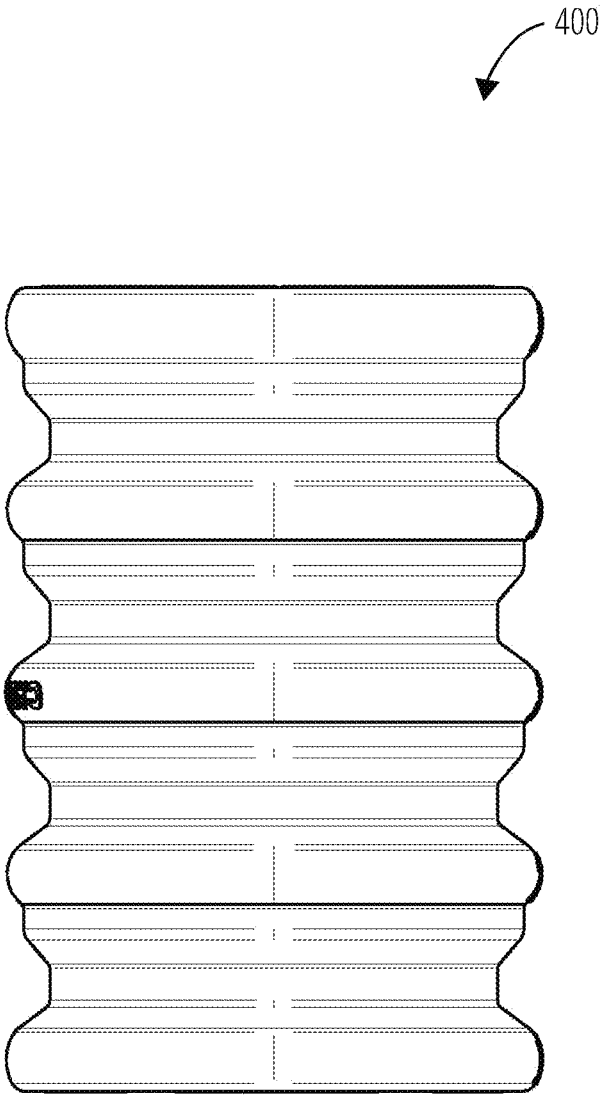
FIG. 4 is a side view of a collapsible beverage insulator with a sidewall design, according to certain aspects of the present disclosure.

FIG. 4 is a side view of a collapsible beverage insulator 400, according to certain aspects of the present disclosure. Collapsible beverage insulator 400 can be the same as or similar to collapsible beverage insulator 300 of FIG. 3, but shown inverted and partially rotated along its axial axis.

Figure 5:
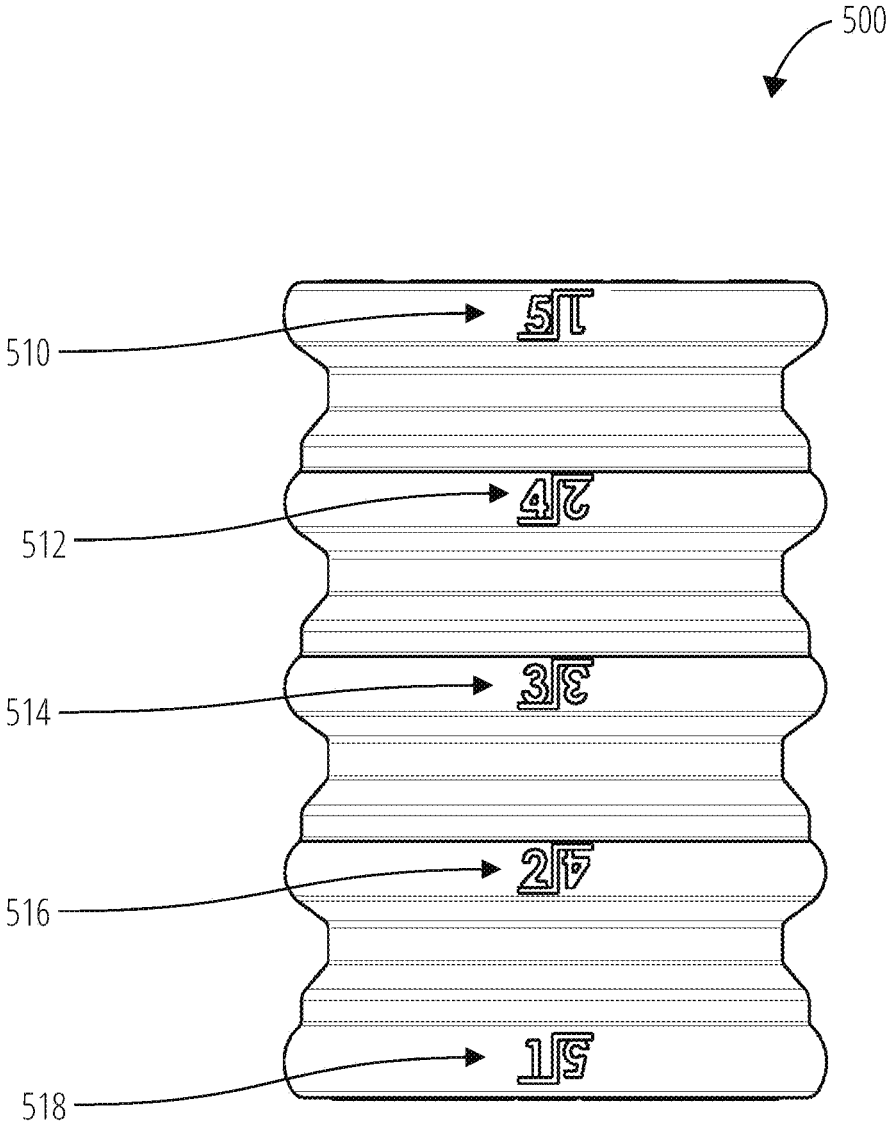
FIG. 5 is a front view of a collapsible beverage insulator with scoring indicators, according to certain aspects of the present disclosure.

FIG. 5 is a front view of a collapsible beverage insulator 500 with scoring indicators 510, 512, 514, 516, 518, according to certain aspects of the present disclosure. Collapsible beverage insulator 500 can be similar to or the same as collapsible beverage insulator 100 of FIG. 1.

Each of the indicators 510, 512, 514, 516, 518 can indicate a score associated with a number of collapsed zones. In some cases, indicators 510, 512, 514, 516, 518 can include text or images that are oriented in an upright fashion when a particular end of the collapsible beverage insulator 500 is facing up. In some cases, alternate text or images can be included that are oriented in an upright fashion when an opposite end of the collapsible beverage insulator 500 is facing up.

For example, first indicator 510 shows a "5" when the collapsible beverage insulator 500 is in an upright orientation as depicted in FIG. 5, but shows a "1" if the collapsible beverage insulator 500 were inverted. First indicator 510 includes an underline design that underlines the appropriate text depending on the orientation of the 500. For example, when the collapsible beverage insulator 500 is in the upright orientation, the underline is below the "5", whereas when the collapsible beverage insulator 500 is in an inverted orientation, the underline will be below the "1."

Figure 6:
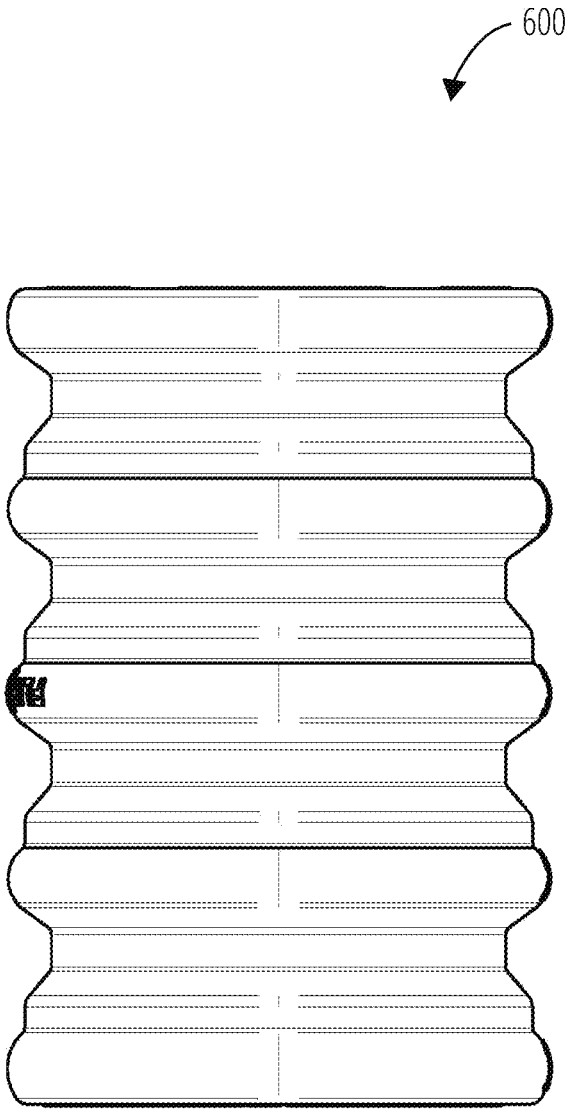
FIG. 6 is a side view of a collapsible beverage insulator with a sidewall design, according to certain aspects of the present disclosure.

FIG. 6 is a side view of a collapsible beverage insulator 600, according to certain aspects of the present disclosure. Collapsible beverage insulator 600 can be the same or similar to collapsible beverage insulator 400 of FIG. 4, but shown inverted.

Figure 7:
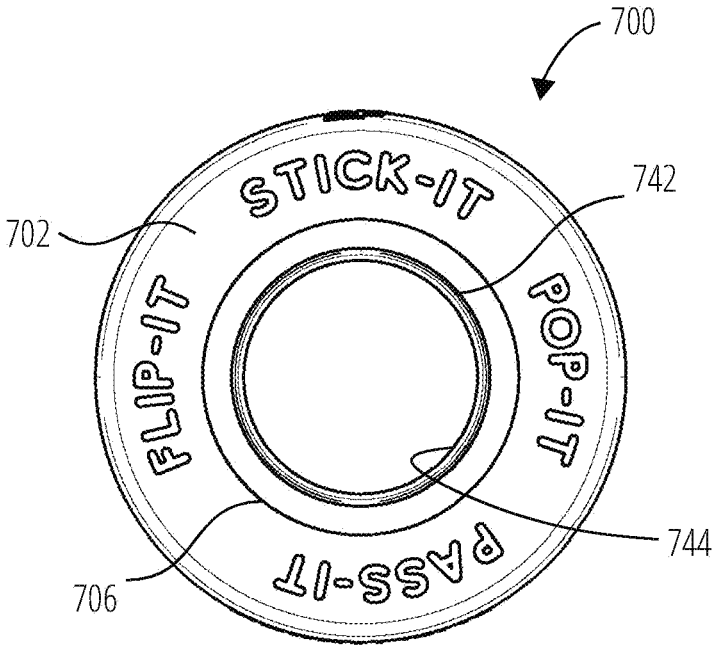
FIG. 7 is a top view of a collapsible beverage insulator, according to certain aspects of the present disclosure.

FIG. 7 is a top view of a collapsible beverage insulator 700, according to certain aspects of the present disclosure. The collapsible beverage insulator 700 can be the same as or similar to collapsible beverage insulator 100 of FIG. 1.

When viewed from the top, the first end 702 is seen, with its first opening 706. Since the first opening 706 is larger in diameter than the second opening 744, the second opening 744 can be seen through the 706. Additionally, the lip 742 at the edge of the second opening 744, described in further detail herein, is seen through the first opening 706.

In some examples, the second opening 744 can be smaller than an outer diameter of a common beverage container (e.g., less than two inches in diameter). In some examples, the second opening 744 can be larger than at or approximately (e.g., just less than) the diameter of a projectile (e.g., greater than at or approximately 1.5 inches for a standard ping pong ball).

Figure 8:
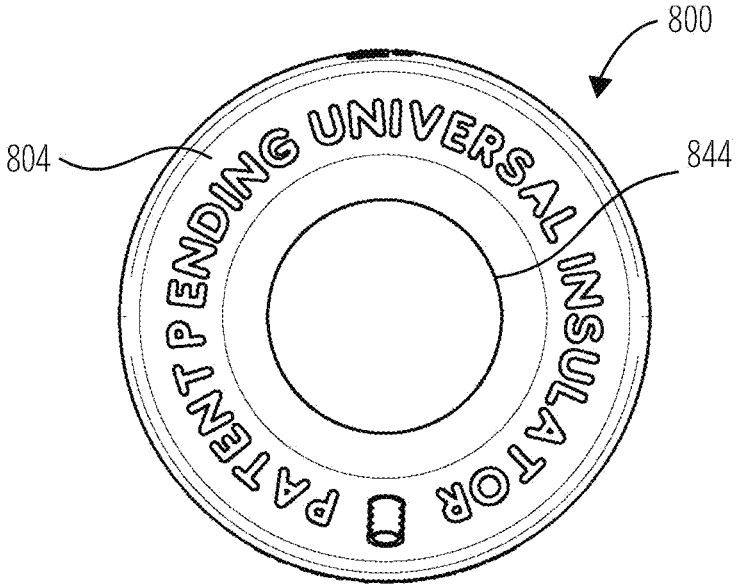
FIG. 8 is a bottom view of a collapsible beverage insulator, according to certain aspects of the present disclosure.

FIG. 8 is a bottom view of a collapsible beverage insulator 800, according to certain aspects of the present disclosure. The collapsible beverage insulator 800 can be the same as or similar to collapsible beverage insulator 700 of FIG. 7.

When viewed from the bottom, the second end 804 is seen, with its second opening 844. However, since the second opening 844 is smaller in diameter than the first opening, the first opening is not visible.

Figure 9:
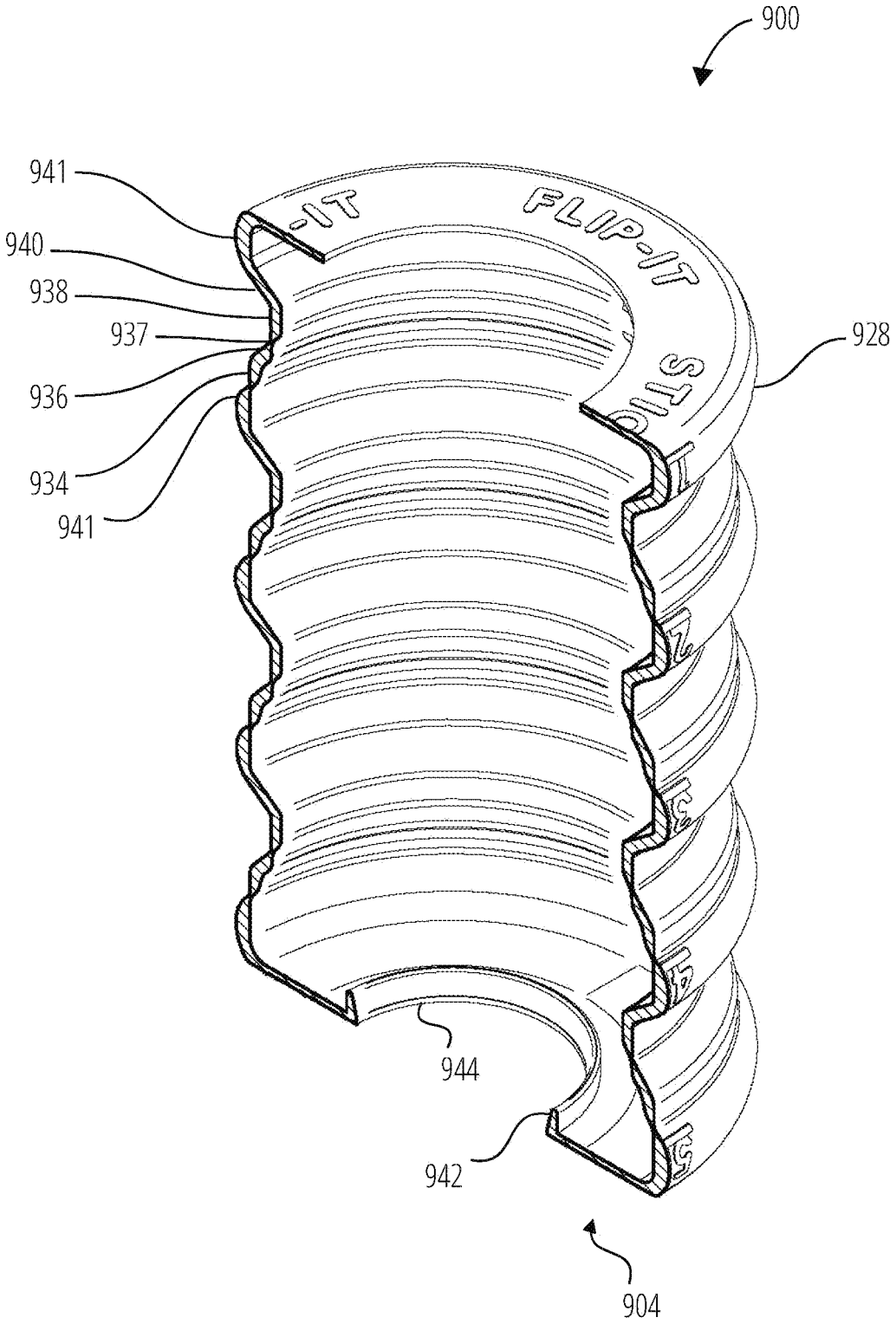
FIG. 9 is an isometric cutaway view of a collapsible beverage insulator, according to certain aspects of the present disclosure.

FIG. 9 is an isometric cutaway view of a collapsible beverage insulator 900, according to certain aspects of the present disclosure. Collapsible beverage insulator 900 can be the same as or similar to collapsible beverage insulator 100 of FIG. 1

The sidewall 928 of the collapsible beverage insulator 900 can include multiple collapsible zones, each of which can be made of multiple segments (e.g., wall portions). As depicted in FIG. 9, each collapsible zone includes a second wall portion 934, a third wall portion 936, a fifth wall portion 938, a sixth wall portion 940, and optionally a first wall portion 941. Any suitable number of wall portions can be used.

When in an expanded state, as depicted in FIG. 9, each of the wall portions 934, 936, 938, 940, first wall portion 941 are arranged axially spaced apart (e.g., not overlapping). When a collapsible zone is collapsed, one or more of the wall portions 934, 936, 938, 940, 941 can be folded over such that at least one wall portion 934, 936, 938, 940, 941 overlaps another. For example, when collapsed, third wall portion 936 can fold behind second wall portion 934, fifth wall portion 938 can fold behind third wall portion 936, and sixth wall portion 940 can optionally fold behind first wall portion 941. In some cases, first wall portion 941 can be considered as part of the collapsible zone, however in some cases first wall portion 941 can be considered as part of the sidewall 928 adjacent a collapsible zone.

The wall thicknesses and general geometry of the collapsible beverage insulator is established to accomplish a collapsing nature while maintaining structural integrity and shape. The collapsible beverage insulator design is comprised of a series of wall portions. In an implementation, where a first wall portion 941 is about 3 mm thick, has a top end with a thin wall, second wall portion 934, about 0.5 mm thick that has an angled wall, third wall portion 936, extending upward and inward that is about 2.3 mm thick, with an upper segment, fourth wall portion 937, that is about 0.6 mm thick that extends vertically into fifth wall portion 938 that is about 2 mm thick that extends into an angled up and outward sixth wall portion 940 that is about 2.5 mm thick. The combination of the wall thicknesses and angled wall shapes give the structure the ability to collapse at the thin points by flexing and using the thicker walls to remain stable. When collapsed, the angled third wall portion 936 and sixth wall portion 940, as well as fifth wall portion 938, nests inside of the first wall portion 941. This relationship of wall thicknesses creates a series of ratios that are geometrically sound for collapsing and maintaining structural integrity. In some cases, wall thicknesses are within 5%, 10%, or 15% of the provided values. In some cases, other wall thicknesses can be used. In some cases, additional or fewer segments (e.g., wall portions) can be used.

The following exemplary ratios correspond to the relative thicknesses of the respective joining walls according to some implementations of the present disclosure.

In some implementations of the present disclosure, the ratio between first wall portion 941 and second wall portion 934 is between about 0.1 and about 0.2. In some implementations of the present disclosure, the ratio between first wall portion 941 and second wall portion 934 is between about 0.13 and about 0.18. In some implementations of the present disclosure, the ratio between first wall portion 941 and second wall portion 934 is between about 0.16 and about 0.17. In some implementations of the present disclosure, the ratio between first wall portion 941 and second wall portion 934 is about 0.166.

In some implementations of the present disclosure, the ratio between second wall portion 934 and third wall portion 936 is between about 0.15 and about 0.27. In some implementations of the present disclosure, the ratio between second wall portion 934 and third wall portion 936 is between about 0.2 and about 0.24. In some implementations of the present disclosure, the ratio between second wall portion 934 and third wall portion 936 is between about 0.21 and about 0.22. In some implementations of the present disclosure, the ratio between second wall portion 934 and third wall portion 936 is about 0.217.

In some implementations of the present disclosure, the ratio between third wall portion 936 and fourth wall portion 937 is between about 0.2 and about 0.32. In some implementations of the present disclosure, the ratio between third wall portion 936 and fourth wall portion 937 is between about 0.24 and about 0.28. In some implementations of the present disclosure, the ratio between third wall portion 936 and fourth wall portion 937 is between about 0.25 and about 0.27. In some implementations of the present disclosure, the ratio between third wall portion 936 and fourth wall portion 937 is about 0.261.

In some implementations of the present disclosure, the ratio between fourth wall portion 937 and fifth wall portion 938 is between about 0.2 and about 0.4. In some implementations of the present disclosure, the ratio between fourth wall portion 937 and fifth wall portion 938 is between about 0.28 and about 0.32. In some implementations of the present disclosure, the ratio between fourth wall portion 937 and fifth wall portion 938 is between about 0.29 and about 0.31. In some implementations of the present disclosure, the ratio between fourth wall portion 937 and fifth wall portion 938 is about 0.3.

In some implementations of the present disclosure, the ratio between fifth wall portion 938 and sixth wall portion 940 is between about 0.75 and about 1.75. In some implementations of the present disclosure, the ratio between fifth wall portion 938 and sixth wall portion 940 is between about 1.0 and about 1.50. In some implementations of the present disclosure, the ratio between fifth wall portion 938 and sixth wall portion 940 is between about 1.2 and about 1.3. In some implementations of the present disclosure, the ratio between fifth wall portion 938 and sixth wall portion 940 is about 1.25.

In some implementations, the wall angles can differ to create a different shape such as an hourglass, or ball shape. In some implementations, the shapes use a combination of thicker and thinner conjoining walls to aid in flexing material at the thin points for collapsing purposes.

In some implementations, the walls are made of a mixture of different materials that create rigidity in the upright walls and flexibility in the angled walls or thin portions for folding. An example of this could be plastic or metal being used in the upright walls (e.g., first wall portion 941 and/or fifth wall portion 938) and silicone or rubber on the angled portions (e.g., third wall portion 936, fourth wall portion 937, and/or sixth wall portion 940) that flex to allow for folding into a collapsed position.

In some implementations, the number of collapsible zones can be as few as 1. The number of collapsible zones have no top limit (e.g., 2, 3, 4, 5, 6, 10, 25, or any suitable number).

In some implementations there may be additional gasket-like flanges (not shown) that extend from the vertical or horizontal walls of the collapsible beverage insulator inward (e.g., to about a radius of 52 mm). The beverage container can stretch the flanges and create smaller portions of insulation. These flanges can also be used to help support and center the beverage container within the collapsible beverage insulator. This creates rings of insulation rather than one large area of insulation across the beverage container. In some implementations, the flanges do not have to create an airtight seal and can be used to help stabilize the beverage container inside the sleeve. This may be done by an internal flange extending inward that does not create an airtight seal, such as by the inclusion of holes or other additional openings or not being circular in shape.

Collapsible beverage insulator 900 also includes a second opening 944 at the second end 904 that includes a lip 942. As described in further detail herein, the lip 942 can extend from the edge of the second opening 944 towards a center of the collapsible beverage insulator 900. In some cases, the lip 942 can be slightly angled to increase in diameter as it approaches the center of the collapsible beverage insulator 900 to create a funnel-like shape into which a projectile can be fit.

Figure 10:
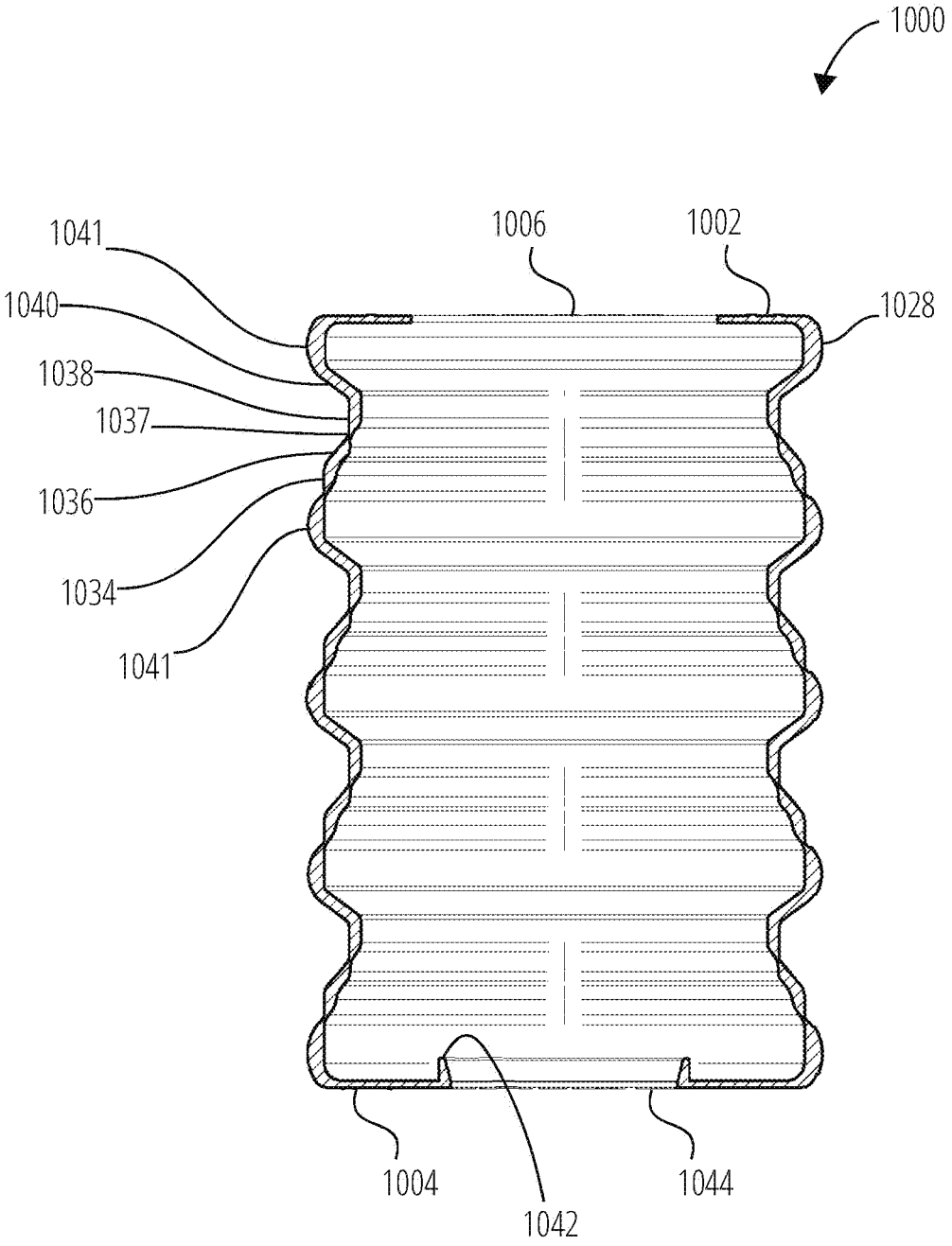
FIG. 10 is a front cutaway view of a collapsible beverage insulator, according to certain aspects of the present disclosure.

FIG. 10 is a front cutaway view of a collapsible beverage insulator 1000, according to certain aspects of the present disclosure. Collapsible beverage insulator 1000 can be the same as or similar to collapsible beverage insulator 900 of FIG. 9.

Collapsible beverage insulator 1000 includes a sidewall 1028 that includes a number of collapsible zones, each of which can include a first wall portion 1041, a second wall portion 1034, a third wall portion 1036, a fourth wall portion 1037, a fifth wall portion 1038, and a sixth wall portion 1040.

Collapsible beverage insulator 1000 can further include a second end 1004 having a second opening 1044. The second opening 1044 can include a lip 1042 extending therefrom.

Figure 11:
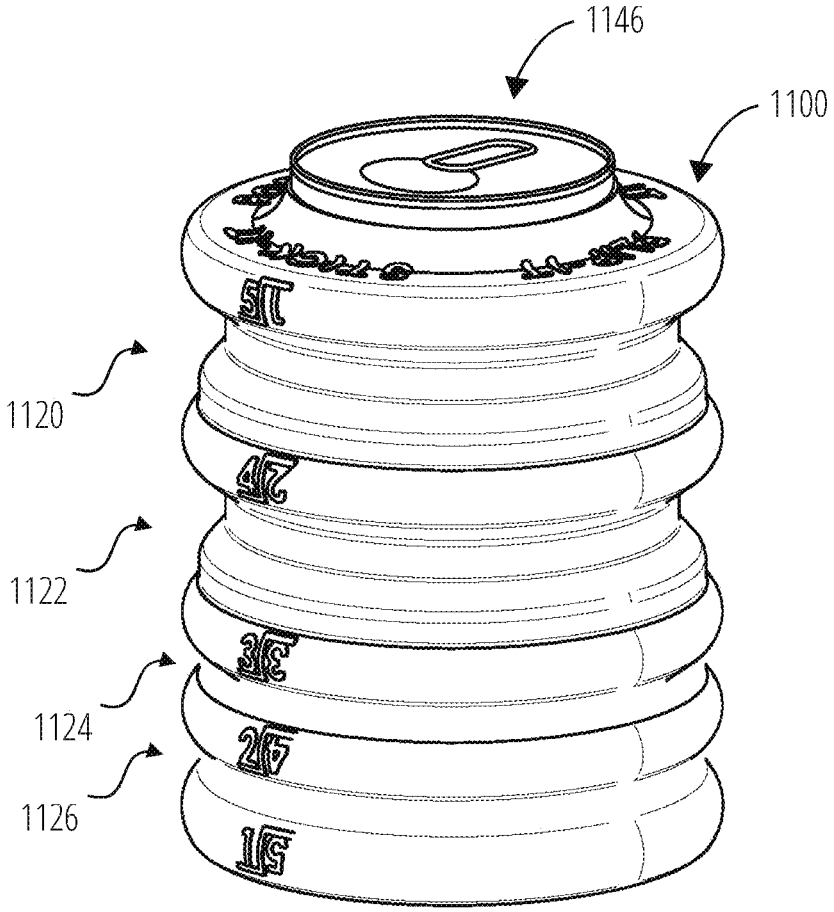
FIG. 11 is a view of a partially collapsed collapsible beverage insulator, according to certain aspects of the present disclosure.

FIG. 11 is a view of a partially collapsed collapsible beverage insulator 1100, according to certain aspects of the present disclosure. Collapsible beverage insulator 1100 can be the same as or similar to collapsible beverage insulator 100 of FIG. 1 after being partially collapsed.

A beverage can 1146 is depicted as being received by the collapsible beverage insulator 1100. To achieve a desired length of the collapsible beverage insulator 1100 to fit the beverage can 1146, some of the collapsible zones 1120, 1122, 1124, 1126 have been collapsed and some remain expanded. For example, first collapsible zone 1120 and second collapsible zone 1122 remain in expanded states while third collapsible zone 1124 and fourth collapsible zone 1126 are in collapsed states. This arrangement of collapsed and expanded collapsible zones permits beverage can 1146 to rest comfortably within collapsible beverage insulator 1100 while leaving sufficient portions of the beverage can 1146 out of the collapsible beverage insulator 1100 to facilitate drinking from the beverage can 1146. Additionally, by collapsing the two collapsible zones 1124, 1126 closest to the base of the beverage can 1146, the center of gravity of the collapsible beverage insulator 1100 is able to remain closer to the base of the beverage can 1146 (e.g., closer than if other collapsible zones were collapsed).

Figure 12:
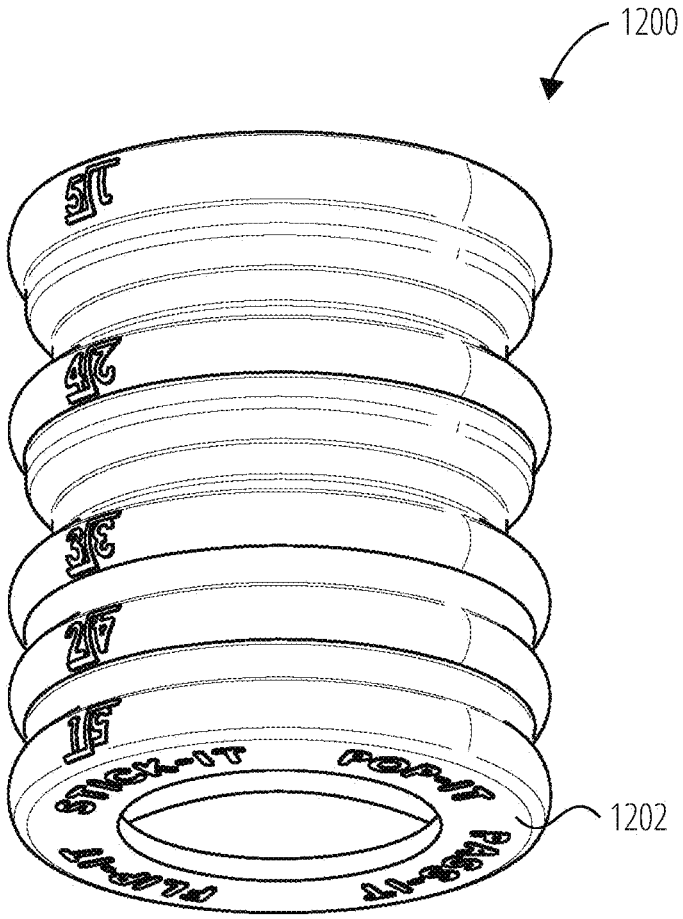
FIG. 12 is a view of a partially collapsed collapsible beverage insulator, according to certain aspects of the present disclosure.

FIG. 12 is a view of a partially collapsed collapsible beverage insulator 1200, according to certain aspects of the present disclosure. Collapsible beverage insulator 1200 can be the same as or similar to collapsible beverage insulator 1100 of FIG. 11, but with different collapsible zones collapsed.

As depicted in FIG. 12, collapsible beverage insulator 1200 is shown in an inverted state, with the first end 1202 facing downwards (e.g., towards the bottom of FIG. 12). Here, two collapsible zones are collapsed, similar to collapsible beverage insulator 1100 of FIG. 11, but here it is the two collapsible zones closest to the first end 1202. In such an arrangement, the center of gravity of the collapsible beverage insulator 1200 is pulled closer to the first end 1202. This location of the center of gravity of the collapsible beverage insulator 1200 can be beneficial for various reasons, such as to facilitate landing the collapsible beverage insulator 1200 with the first end 1202 facing downwards or to more evenly distribute weight when a bottom-heavy beverage container is placed within the first end collapsible beverage insulator 1200.

Figure 13:
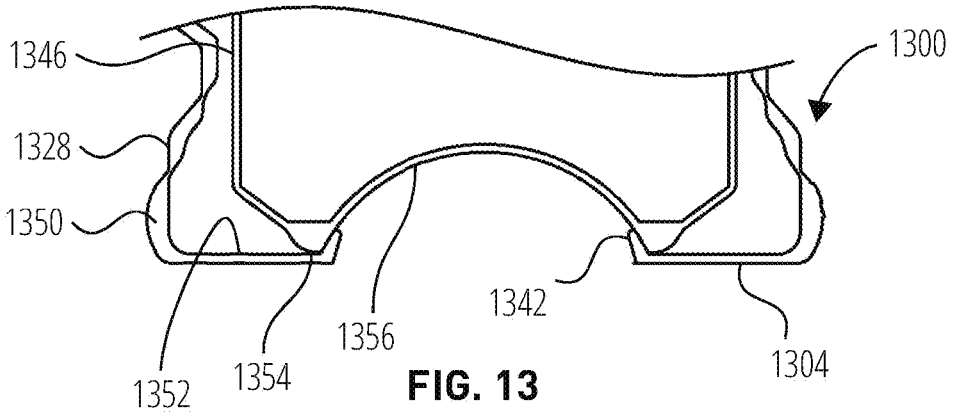
FIG. 13 is a partial front cutaway view of a beverage can in a collapsible beverage insulator, according to certain aspects of the present disclosure.

FIG. 13 is a partial front cutaway view of a beverage can 1346 in a collapsible beverage insulator 1300, according to certain aspects of the present disclosure. Collapsible beverage insulator 1300 can be the same as or similar to collapsible beverage insulator 1100 of FIG. 11.

When the beverage can 1346 is placed within the collapsible beverage insulator 1300, the lower rim 1354 of the beverage can 1346 can make contact with the inner surface 1352 of the second end 1304. In some cases, this contact is sufficient to create a desired seal with the second end 1304. In some cases, however, the second end 1304 includes a lip 1342 that extends towards the center of the collapsible beverage insulator 1300. This lip 1342 can be shaped to engage a lower concave surface 1356 of the beverage can 1346. As a result, lip 1342 can create an airtight or substantially airtight seal with beverage can 1346, thus establishing a sealed inner volume within the collapsible beverage insulator 1300. In some cases, instead of engaging a lower concave surface 1356, lip 1342 can be configured to contact a lower rim 1354 of the beverage can 1346, such as by extending radially outwards.

Additionally, in some cases, a collapsible beverage insulator 1300 can include an annular volume 1350 located within the sidewall 1328. In such cases, the sidewall 1328 can include an outer wall and an inner wall between which the annular volume 1350 can be located. In some cases, an access port or other opening (e.g., a removably scalable opening) can provide access to the annular volume 1350, such as to fill the annular volume 1350 with a fluid or to remove a fluid therefrom. The annular volume 1350 can be configured and used in various ways, such as described in further detail herein.

Figure 14:
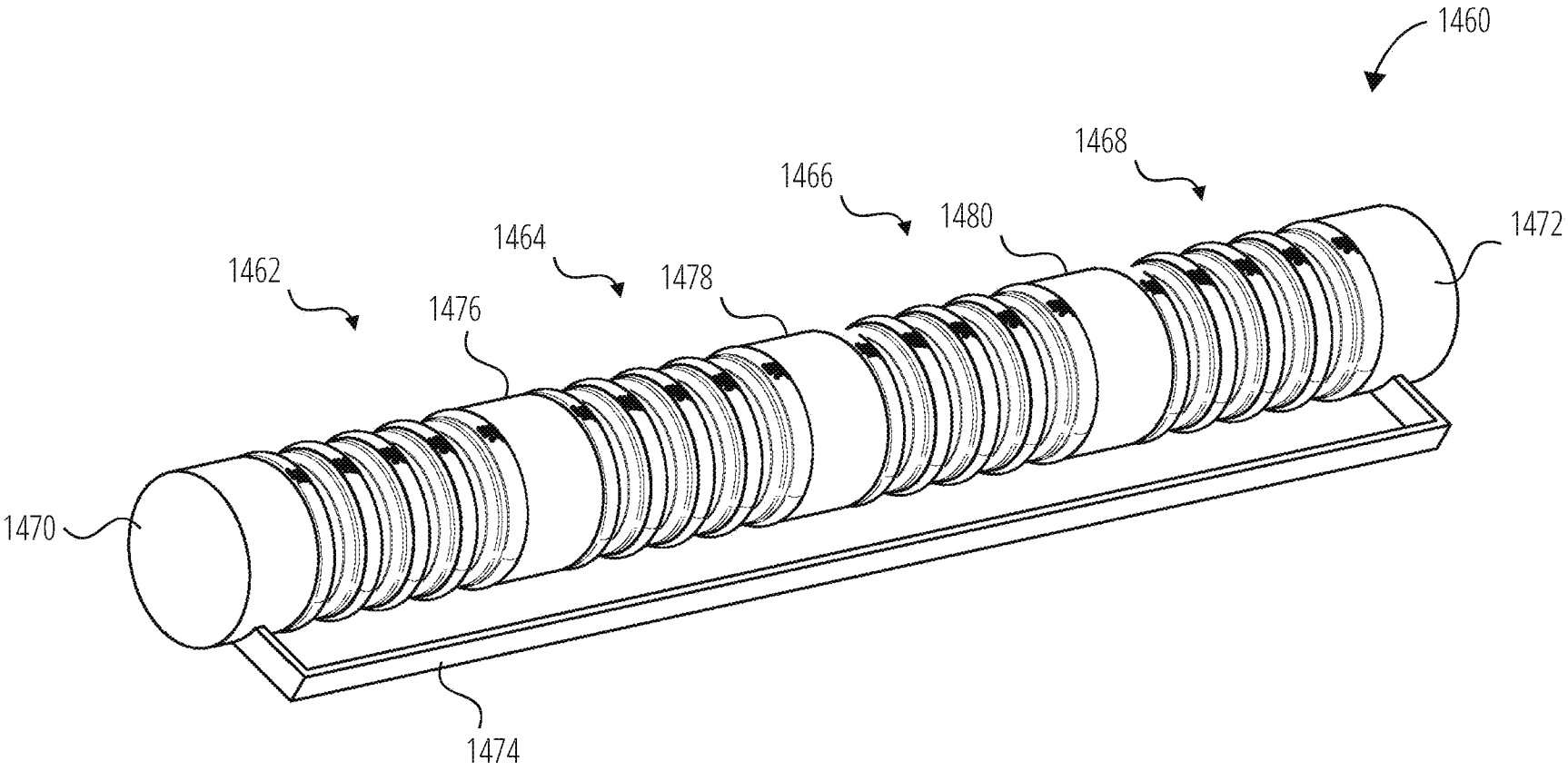
FIG. 14 is an axonometric view of a multi-insulator assembly, according to certain aspects of the present disclosure.

FIG. 14 is an axonometric view of a multi-insulator assembly 1460, according to certain aspects of the present disclosure. The multi-insulator assembly 1460 can include multiple collapsible beverage insulators 1462, 1464, 1466, 1468 (e.g., multiple instances of collapsible beverage insulator 100 of FIG. 1) axially coupled together. Each of the collapsible beverage insulators 1462, 1464, 1466, 1468 can be coupled to adjacent collapsible beverage insulators via axial couplers 1476, 1478, 1480. In some cases, the outermost ends of the collapsible beverage insulators at the ends of the multi-insulator assembly 1460 can be fit with endcaps 1470, 1472. In some cases, a handle 1474 can couple a first endcap 1470 with a second endcap 1472. The handle 1474 can be a stiff handle or a flexible handle (e.g., a strap), although other handles can be used. In some cases, handle 1474 can couple to one or more of the axial couplers 1476, 1478, 1480.

While the collapsible beverage insulator can work as an individual device, it may also be connected to one or more additional collapsible beverage insulators to create a higher volume insulating sleeve (e.g., the multi-insulator assembly 1460) that can hold multiple beverages. Each collapsible beverage insulator can be connected to another through methods of magnets, threaded attachment, snap lock, spool, and the like. In some cases, a collapsible beverage insulator can be directly coupled to another collapsible beverage insulator. In some cases, a collapsible beverage insulator can be coupled to another collapsible beverage insulator via an axial coupler. The connection can be strong enough to hold the weight of many collapsible beverage insulators connected together with weighted beverages inside. A sling or similar component (e.g., handle) can be attached to the ends of the entire connected multi-insulator assembly 1460 to use for carrying on one's shoulder or back, like a sling pack, to transport many beverages while keeping the beverages insulated. When a person is ready to enjoy a beverage, they can simply detach any one of the collapsible beverage insulators that make up the longer multi-insulator assembly 1460. In doing so, they will be taking a section out of the entire build of the multi-insulator assembly 1460 and will have a beverage ready to drink with insulation already attached. When the user is done with that beverage, they can again, simply re-attach that individual collapsible beverage insulator to the larger multi-insulator assembly 1460 for transportation to recycle, play a game, etc.

The attachment methods of each collapsible beverage insulator serve as a new way to create insulation across many beverages. Traditionally, a cooler is used where all beverages are insulated in the same cavity. That cavity cannot be adjusted for the number of beverages you want to insulate (e.g., sized down when only a few beverages are needed or sized up when additional beverages are needed). This creates wasted space for transportation and insulation. By creating a modular attachable and detachable multi-insulator assembly 1460 where one can attach individual collapsible beverage insulators together, one can optimize the amount of weight carried and space used for insulation. This arrangement also stops the user from interfering with the insulation of another beverage. For example, each time a cooler lid is opened, all beverages in that container are exposed to heat transfer and the cool air within the cooler and surrounding the various beverages in the cooler is permitted to at least partially escape. With individually insulated beverages as described with reference to a multi-insulator assembly 1460, a user can detach a single or multiple beverages without disturbing the insulation of other beverages.

The use of a collapsible beverage insulator that can be expanded to a length greater than that of the beverage container within or contracted to a length smaller than that of the beverage container within may be beneficial to the overall use of the multi-insulator assembly 1460. For example, when being coupled to a multi-insulator assembly 1460, the collapsible beverage insulator may be expanded sufficiently to allow a beverage container to fit entirely within the collapsible beverage insulator while permitting sufficient room to couple the collapsible beverage insulator to an end piece or another collapsible beverage insulator. Thereafter, when it is desired to consume the beverage, the collapsible beverage insulator can be removed from the multi-insulator assembly 1460 and can be partially collapsed to alter the length of the collapsible beverage insulator to make it easier to drink from the beverage container.

In other configurations where the user may not need to expand each collapsible beverage insulator beyond the length of a beverage container, collapsible beverage insulators can be connected together using other techniques, such as techniques that are built into the collapsible beverage insulator ends where they connect to each other while still holding the beverage container, or another device may be used to connect them. The connection method may vary using a fastening method of a screw, snap, lock, pressure, magnet, spool, spool and collar, and the like. In this case, the user can still remove a single beverage section of the entire multi-insulator assembly 1460 with the insulation for that beverage still intact and not interfere with the other beverage's insulation. This configuration may or may not require collapsible beverage insulators that can expand and collapse, rather just the ability to connect and disconnect many individually insulated beverages from one another using any suitable fastening method.

In some implementations, the connection method uses a spool or spool and collar to connect gasket ends of collapsible beverage insulators together. This connection method can use a collar to thread down and pinch a gasket end together creating an airtight seal as well as a strong hold, preventing the gasket from stretching around the face of a spool device.

The connection device may also contain a liquid within to freeze or heat up to help retain heat or lack of when connected to the collapsible beverage insulator. This connection device can act the same way or a similar way as a freezer pack works in a cooler.

The use of connection points at the ends of the collapsible beverage insulators can enable additional features, such as for holding a beverage in place. For example, one may want to removably adhere the beverage container to a surface so it does not get knocked over. A flat mat with an adhering surface on one side can be attached to the object (e.g., target surface) and on the opposing side can use the common collapsible beverage insulator connection point. The collapsible beverage insulator can then be connected to that connection point, making a holder for the beverage. An alternative is to make a direct connection point into whatever object to which you expect to attach the collapsible beverage insulator. An example of this could be in a table. Instead of making the table with a common cup holder, you would build the object with a relatively flat surface and the connection point where the collapsible beverage insulator can connect using the common connection method.

In some implementations of the present disclosure, the connection method of the spool and collar or other connection methods can serve to create a way to conceal a beverage from visibility and disguise it as a water bottle. The spool and collar can be in the shape of a water bottle cap, where a user can unscrew, unsnap, etc. To open the spool or collar to the cavity of the sleeve where a user can drink from without disconnecting the spool/collar from the collapsible beverage insulator.

In some implementations, the collapsible beverage insulator may be used as an insulator for other objects than a beverage, such as food, ice packs, etc.

In some implementations, the collapsible beverage insulator is made of food grade materials that are also dishwasher safe.

Figure 15:
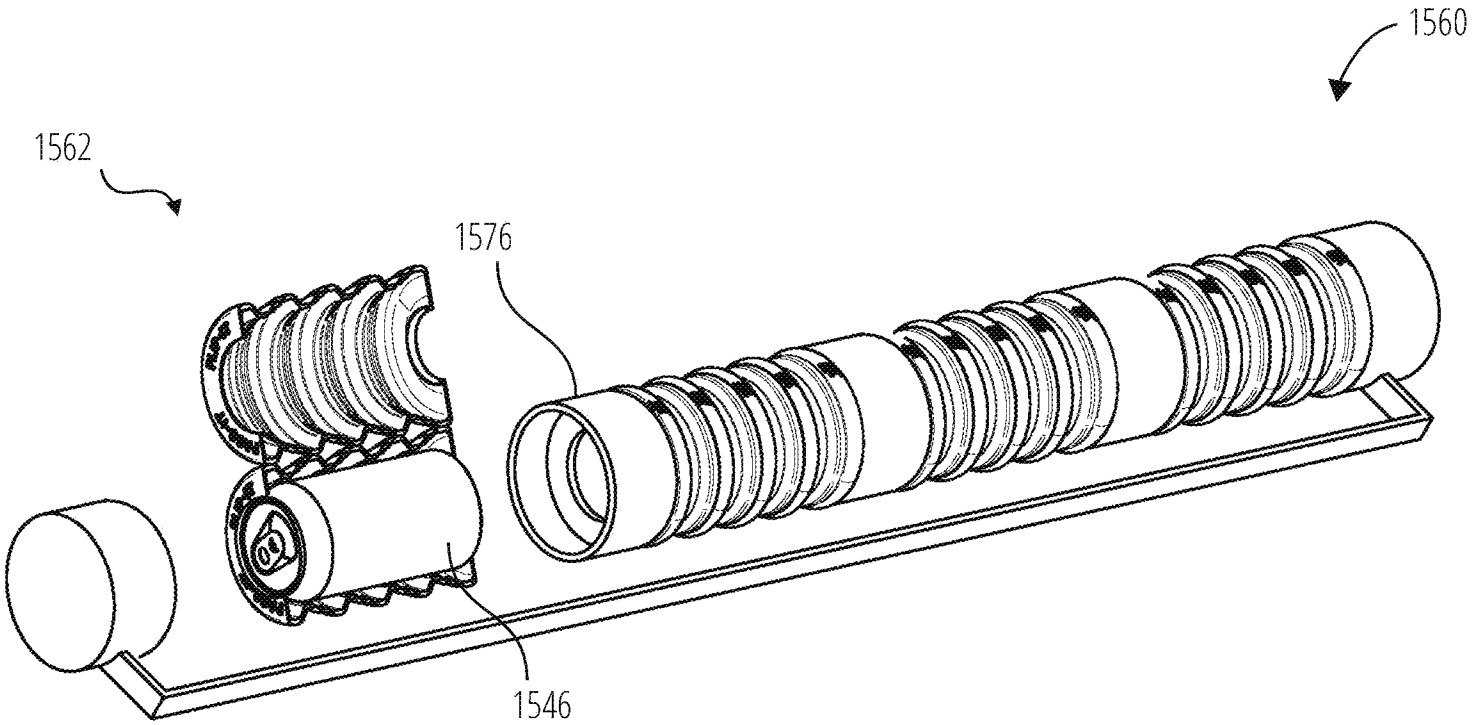
FIG. 15 is a partially exploded axonometric view of a multi-insulator assembly, according to certain aspects of the present disclosure.

FIG. 15 is a partially exploded axonometric view of a multi-insulator assembly 1560, according to certain aspects of the present disclosure. The multi-insulator assembly 1560 can be the same as or similar to multi-insulator assembly 1460 of FIG. 14, but with the first collapsible beverage insulator 1562 shown in partial exploded view with the beverage can 1546 therein. The first collapsible beverage insulator 1562 may be coupled to another collapsible beverage insulator via first coupler 1576.

Figure 16:
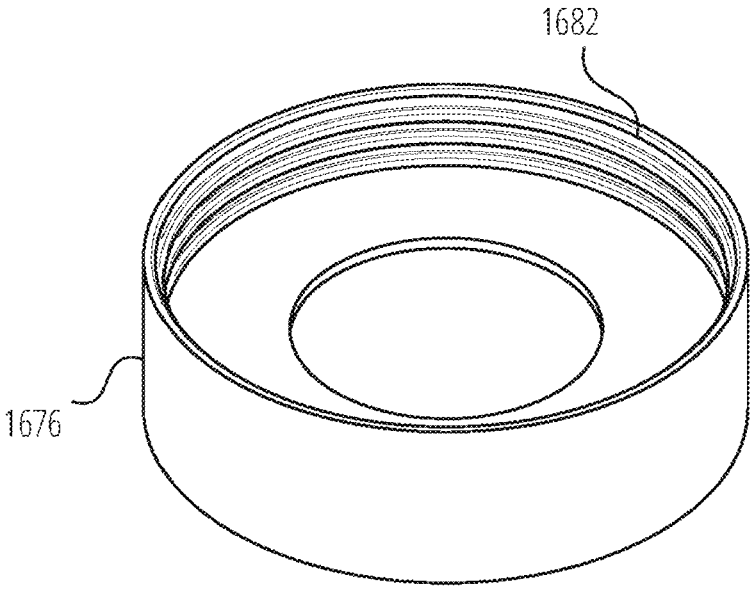
FIG. 16 is a view of an axial coupler, according to certain aspects of the present disclosure.

FIG. 16 is a view of an axial coupler 1676, according to certain aspects of the present disclosure. The axial coupler 1676 can be any suitable axial coupler, such as coupler 1476 of FIG. 14. The axial coupler 1676 can include a top portion and a bottom portion, each of which can couple to a different collapsible beverage insulator. As depicted in FIG. 16, the axial coupler 1676 makes use of a threaded region 1682 to couple the axial coupler 1676 to a collapsible beverage insulator. In some cases, an interior wall can separate the top portion from the bottom portion (e.g., to separate the interior volume of one collapsible beverage insulator from that of an adjacent collapsible beverage insulator). However, in some cases, such as depicted in FIG. 16, the interior wall can include an opening to permit passage of fluid (e.g., air) between collapsible beverage insulators.

Figure 17:
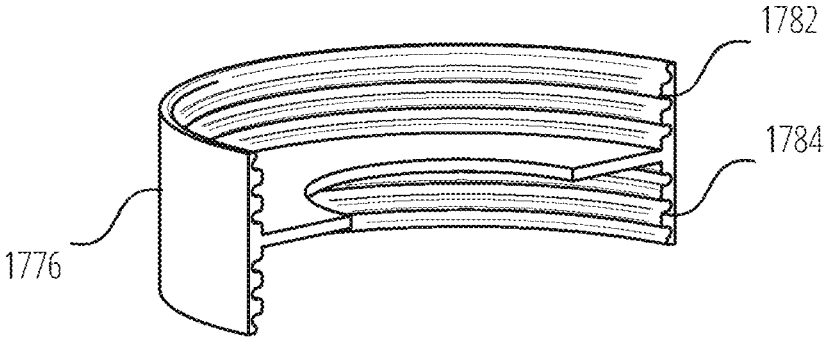
FIG. 17 is a cutaway view of an axial coupler, according to certain aspects of the present disclosure.

FIG. 17 is a cutaway view of an axial coupler 1776, according to certain aspects of the present disclosure. The axial coupler 1776 can be the same as or similar to axial coupler 1676 of FIG. 16. In the cutaway view, the first threaded region 1782 and second threaded region 1784 can be seen, for coupling to a first collapsible beverage insulator and second collapsible beverage insulator, respectively.

Figure 18:
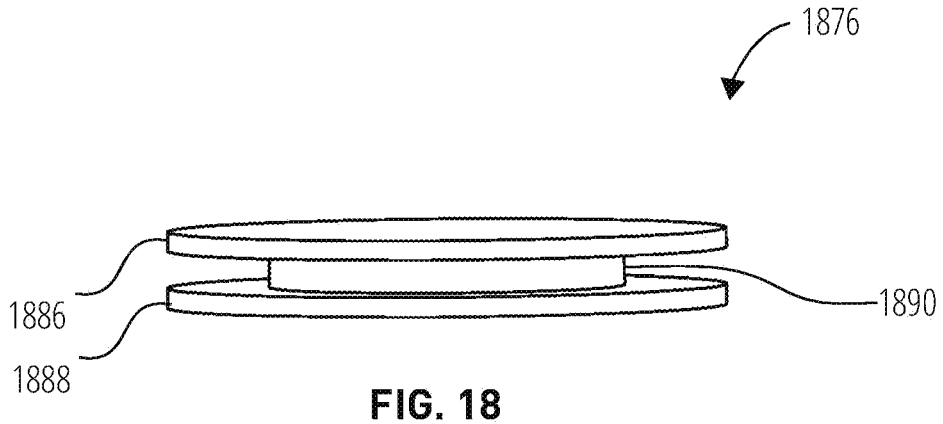
FIG. 18 is a view of a spool, according to certain aspects of the present disclosure.

FIG. 18 is a view of a spool 1876, according to certain aspects of the present disclosure. Spool 1876 can be a type of axial coupler. Spool 1876 can include a first flange 1886 and a second flange 1888 separated by a spool body 1890. The spool body 1890 can have a diameter that is smaller than that of an opening (or both openings) at the end(s) of the collapsible beverage insulator, but the flanges 1886, 1888 can have diameters that are slightly larger than the opening. Thus, flanges 1886, 1888 can be worked through the opening(s) (e.g., by stretching or flexing the opening), causing the spool body 1890 to remain within the opening. In some cases, a spool 1876 can be used on its own, although in some cases the spool 1876 can be used as an axial coupler. When used by itself, the spool 1876 can be free to move axially within the opening until one of the flanges 1886, 1888 contact the end of the collapsible beverage insulator. Thus, when pressure is not applied to force the spool 1876 against the insulator, air can be permitted to pass through the opening. However, when pressure is applied to force the spool 1876 against the collapsible beverage insulator, such as when the collapsible beverage insulator is tossed and lands on the spool 1876, an airtight or substantially airtight seal can be created, which can permit air pressure within the collapsible beverage insulator to increase in response to collapsing of collapsible zones.

Figure 19:
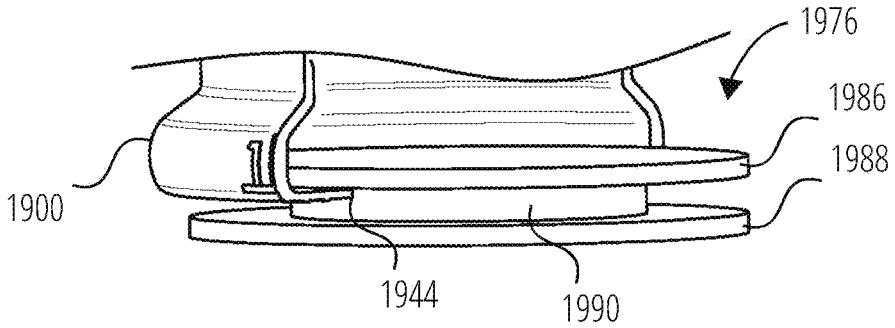
FIG. 19 is a partial cutaway view of a collapsible beverage insulator fit around a spool, according to certain aspects of the present disclosure.

FIG. 19 is a partial cutaway view of a collapsible beverage insulator 1900 fit around a spool 1976, according to certain aspects of the present disclosure. Spool 1976 can be the same as or similar to spool 1876 of FIG. 18. As seen in FIG. 18, the first flange 1986 has been inserted through the second opening 1944, leaving the spool body 1990 resting within the second opening 1944. If the collapsible beverage insulator 1900 is tossed and lands with the first end facing up, the second flange 1988 will contact a surface upon which the collapsible beverage insulator 1900 lands, thus forcing the second flange 1988 against the second end of the collapsible beverage insulator 1900 and creating an airtight or substantially airtight seal such that air cannot flow through the second opening 1944.

Figure 20:
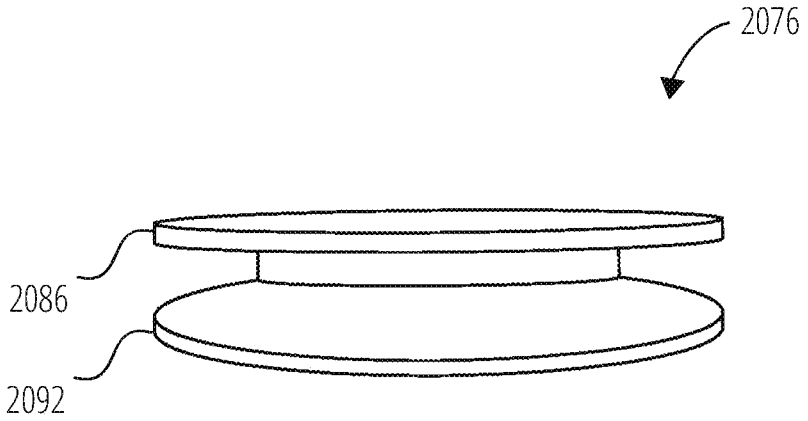
FIG. 20 is a view of a suction base for a collapsible beverage insulator, according to certain aspects of the present disclosure.

FIG. 20 is a view of a suction base 2092 for a collapsible beverage insulator, according to certain aspects of the present disclosure. The removable end attachment 2076 can include a first flange 2086, which can be similar to or the same as first flange 1986 of FIG. 19. However, instead of a second flange as used in a spool, the opposite end of the removable end attachment 2076 can be a suction base 2092. Thus, by inserting the first flange 2086 into an opening of a collapsible beverage insulator, that end of the collapsible beverage insulator can be provided with a suction base 2092 to facilitate securing the collapsible beverage insulator to certain surfaces.

Figure 21:
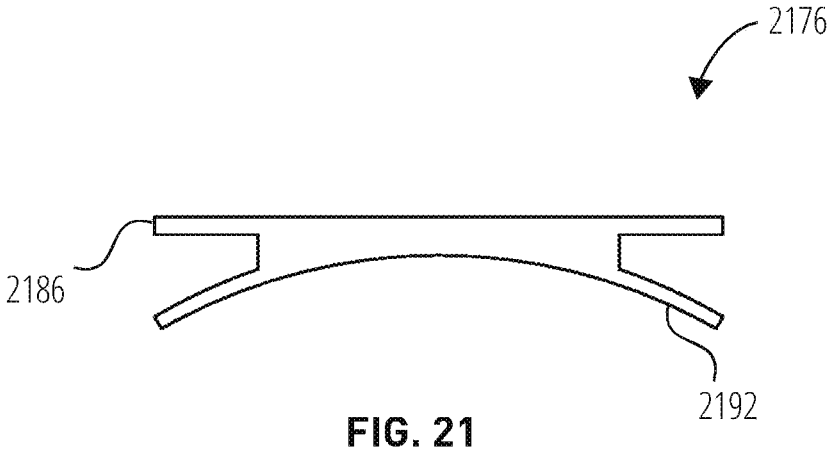
FIG. 21 is a front cutaway view of a suction base for a collapsible beverage insulator, according to certain aspects of the present disclosure.

FIG. 21 is a front cutaway view of a suction base 2192 for a collapsible beverage insulator, according to certain aspects of the present disclosure. The removable end attachment 2176 of FIG. 21 can be the same as or similar to the removable end attachment 2076 of FIG. 20. As seen in FIG. 21, the removable end attachment 2176 can include a first flange 2186 opposite a suction base 2192.

Figure 22:
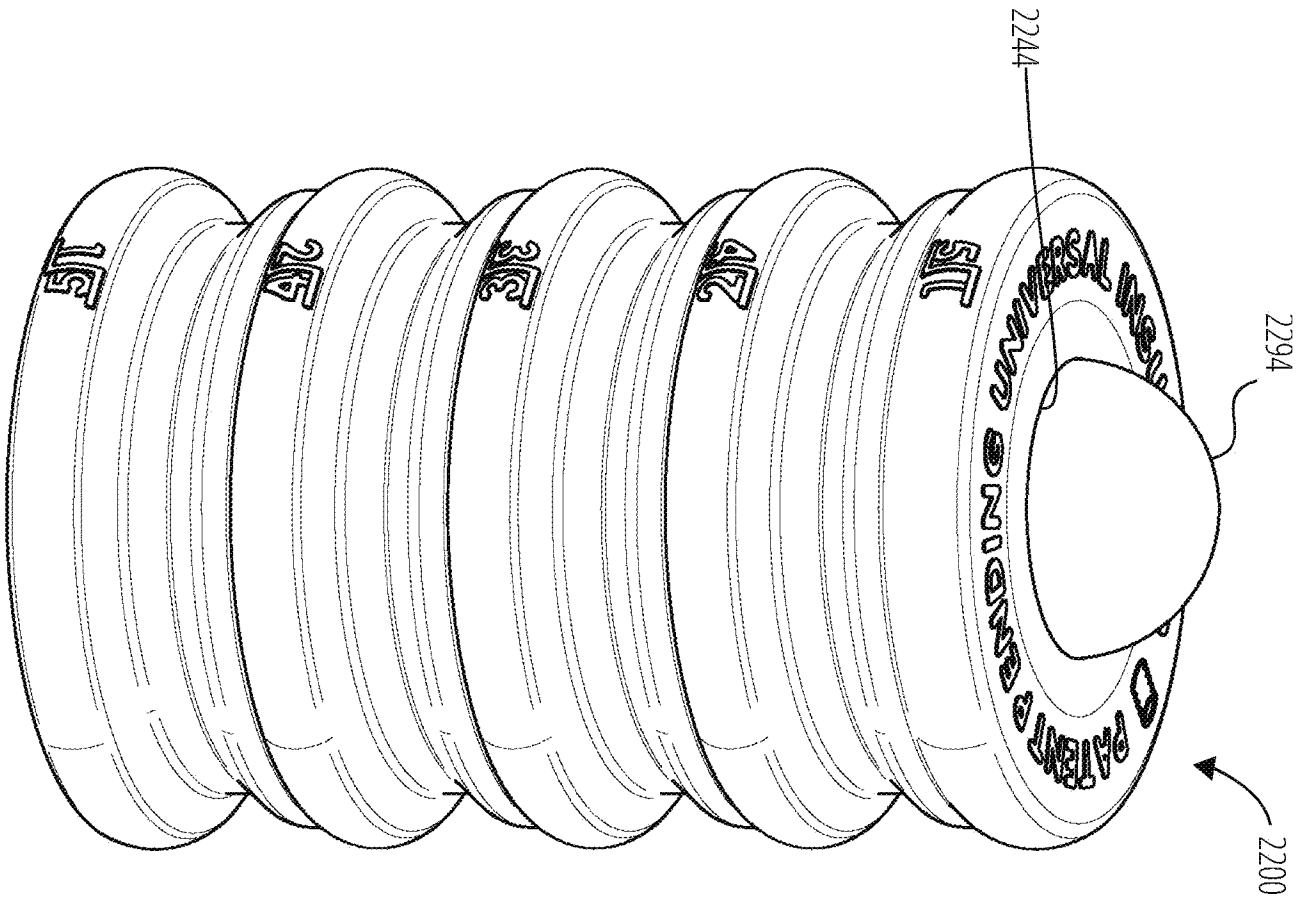
FIG. 22 is an axonometric view of a collapsible beverage insulator fit with a projectile, according to certain aspects of the present disclosure.

FIG. 22 is an axonometric view of a collapsible beverage insulator 2200 fit with a projectile 2294, according to certain aspects of the present disclosure. The collapsible beverage insulator 2200 can be the same as or similar to collapsible beverage insulator 100 of FIG. 1.

Any suitable projectile 2294 can be used. As depicted in FIG. 22, the projectile 2294 is spherical in shape, such as a ping pong ball. The second opening 2244 can be shaped to receive the projectile 2294, such as via an interference fit.

The collapsible beverage insulator 2200 of FIG. 22 can be tossed such that it lands with the second end pointing generally up and the projectile 2294 pointing generally up. If landing with sufficient force, one or more collapsible zones of the collapsible beverage insulator 2200 will collapse, which can cause sufficient air pressure to build within the collapsible beverage insulator 2200 to launch the projectile 2294 out of the second opening 2244.

Figure 23:
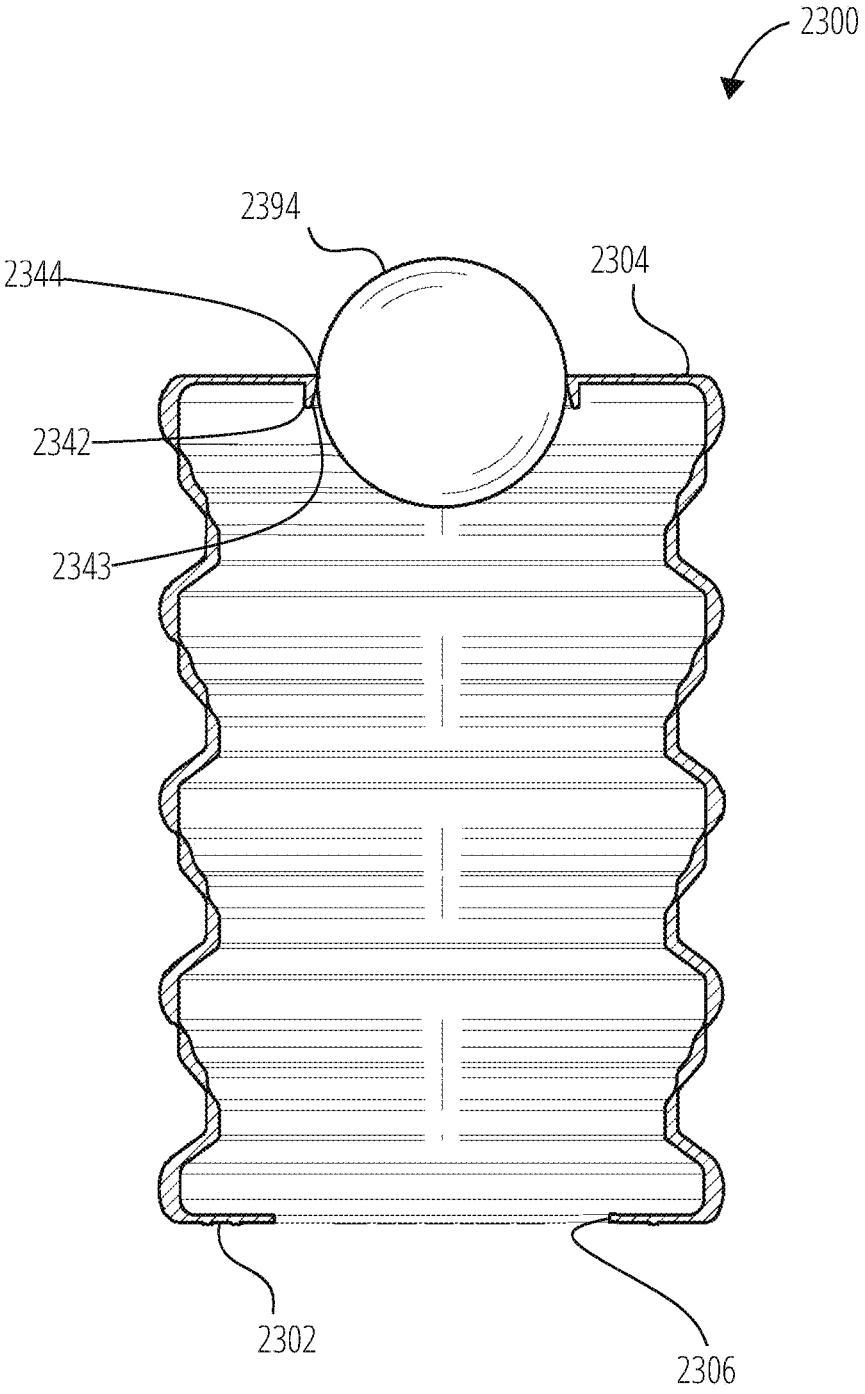
FIG. 23 is a front cutaway view of a collapsible beverage insulator fit with a projectile, according to certain aspects of the present disclosure.

FIG. 23 is a front cutaway view of a collapsible beverage insulator 2300 fit with a projectile 2394, according to certain aspects of the present disclosure. The collapsible beverage insulator 2300 can be the same as or similar to collapsible beverage insulator 2200 of FIG. 22.

As seen in FIG. 23, the projectile 2394 is fit within the second opening 2344. The lip 2342 can facilitate retaining the projectile 2394 within the second opening 2344.

In some cases, the lip 2342 can include an inclined surface 2343 that is inclined towards the second opening 2344. In such cases, a projectile 2394 located within the inner volume of the collapsible beverage insulator 2300 may be directed towards the center of the second opening 2344 (e.g., the center of an axial axis passing through the center of the second opening 2344) by force pushing the projectile 2394. Examples of how such force can be applied include manually (e.g., a user pressing the projectile 2394 in a direction from the first opening 2306 towards the second opening 2344), via gravitational (e.g., a projectile 2394 naturally falling onto the lip 2342 when the collapsible beverage insulator 2300 is oriented with the second end 2304 located below the first end 2302), or via centrifugal force (e.g., a projectile 2394 within the inner volume will naturally be pressed towards the second end 2304 when flipped end-over-end).

In some cases, the lip 2342 can be shaped to direct the projectile 2394 towards the second opening 2344, but can provide sufficient resistance to the projectile 2394 to stop the projectile 2394 from exiting the second opening 2344 until a threshold force has been applied. Such a threshold force can be greater than expected gravitational or centrifugal forces from general handling of the collapsible beverage insulator 2300, but less than the amount of force applied to a projectile 2394 retained at the second opening 2344 when a compression zone compresses (while the first opening 2306 is fully occluded or at least sufficiently occluded).

Figure 24:
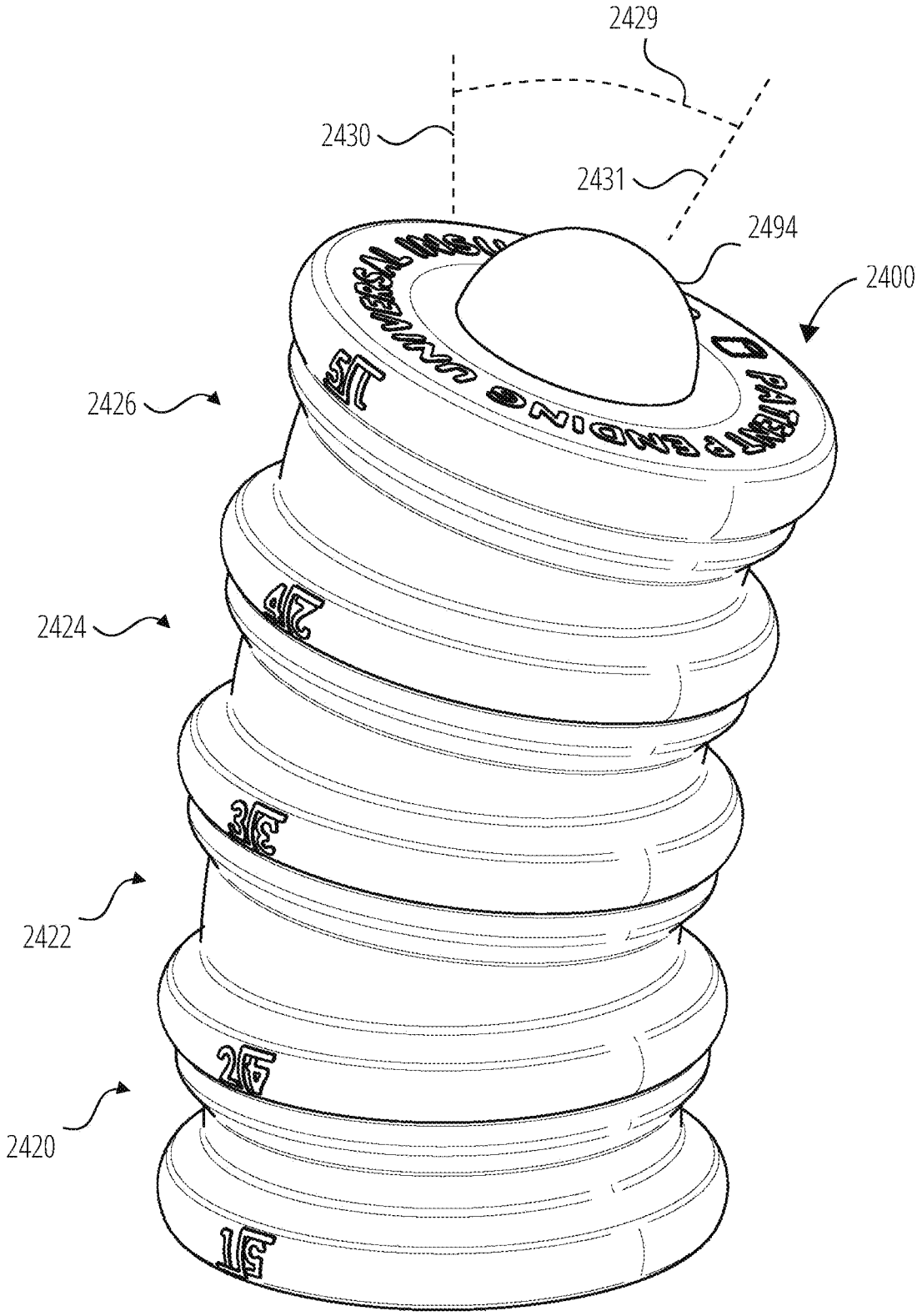
FIG. 24 is an axonometric view of a partially collapsed collapsible beverage insulator fit with a projectile, according to certain aspects of the present disclosure.

FIG. 24 is an axonometric view of a partially collapsed collapsible beverage insulator 2400 fit with a projectile 2494, according to certain aspects of the present disclosure. The collapsible beverage insulator 2400 can be collapsible beverage insulator 2200 of FIG. 22 after being partially collapsed.

As depicted in FIG. 22, the first collapsible zone 2420 is fully collapsed, and each of the second collapsible zone 2422, third collapsible zone 2424, and fourth collapsible zone 2426 are partially collapsed. When partially collapsed in this fashion, the collapsible beverage insulator 2400 can take on a directionality that is not along its traditional axial axis 2430 such that the projectile 2494, if ejected, would not travel along the axial axis 2430. Here, the collapsible beverage insulator 2400 is tilted by projectile angle 2429 such that a projectile direction 2431 in which the projectile 2494 will travel if ejected is angularly offset from the axial axis 2430.

Figure 25:
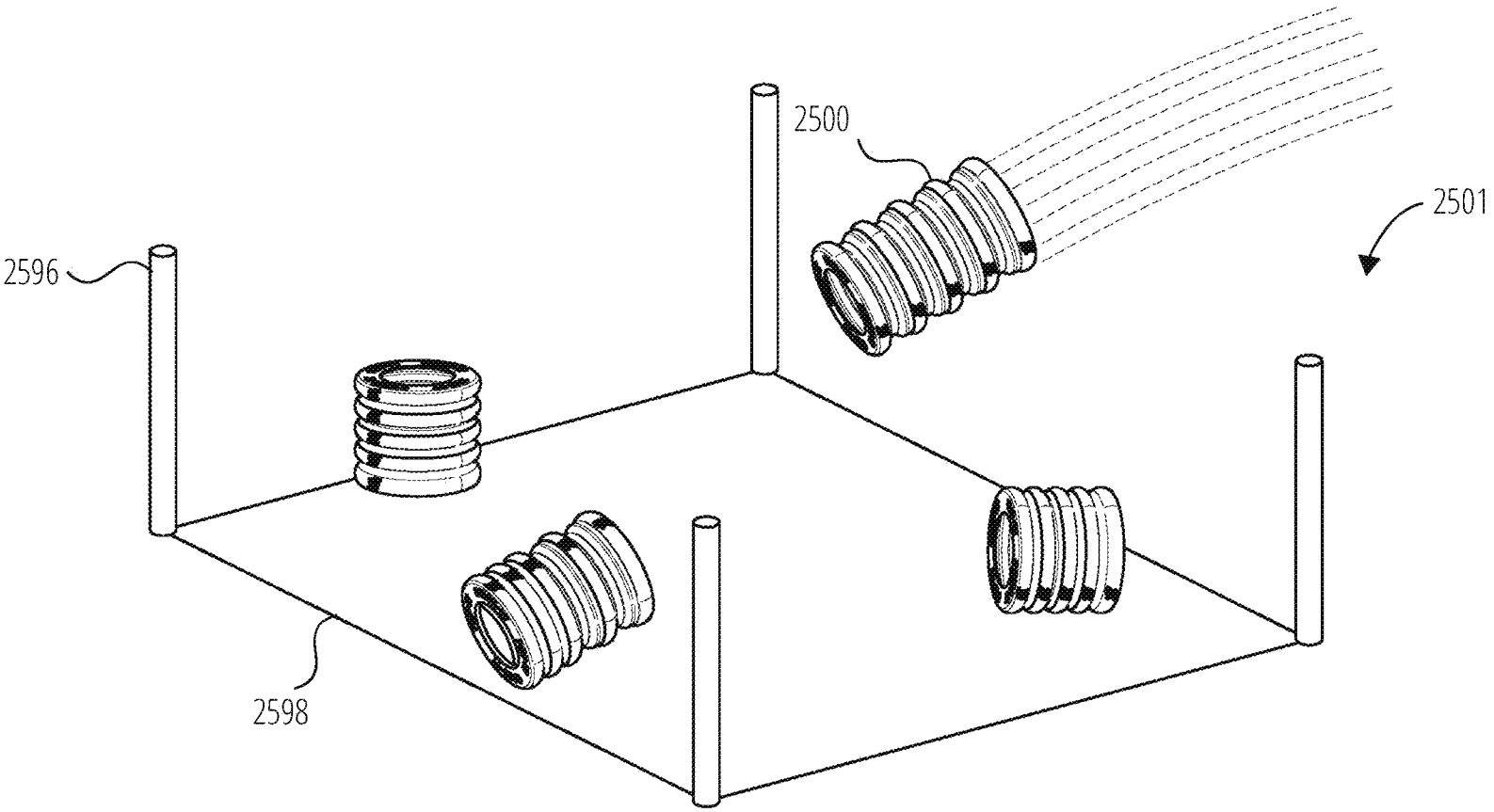
FIG. 25 is an axonometric view of a game target for use with collapsible beverage insulators, according to certain aspects of the present disclosure.

FIG. 25 is an axonometric view of a game target 2501 for use with collapsible beverage insulators 2500, according to certain aspects of the present disclosure. Each collapsible beverage insulator 2500 can be the same as or similar to collapsible beverage insulator 100 of FIG. 1.

A game can be played wherein a collapsible beverage insulator 2500 is tossed at a game target surface 2598. The game target surface 2598 can define a surface upon which the collapsible beverage insulator 2500 must land for the player to score points. In some cases, one or more game target poles 2596 can be used in conjunction with the game target surface 2598 (e.g., within the game target surface 2598 or along edges or corners of the game target surface 2598). The game target poles 2596 can be targets around which the player attempts to toss their collapsible beverage insulator 2500 to score additional points or otherwise affect gameplay.

In some implementations, using additional items like stakes (e.g., target poles) and rope to create a landing area may be used. An objective of the game can be to toss your collapsible beverage insulator 2500 into the air with at least one flipping/tossing rotation and land your collapsible beverage insulator 2500 in the landing zone (e.g., on the game target surface 2598), or over one of the stakes (e.g., game target poles 2596), optionally on one end with enough force to collapse the device. If playing with identifying ends, the goal can include specifically requiring your identifying end to land facing up. Points may only be awarded if the scoring landing position is done within the landing area. By using a landing area and multiple of the collapsible beverage insulators 2500, the game can follow suit with other games such as cornhole, horseshoes, etc. while bringing the new element of the collapsibility into the game. In some variations, additional elements of defensive strategies can be added by allowing players to knock already landed collapsible beverage insulators 2500 out of the landing area to affect scoring.

In some implementations, a mat can be used that can be a landing zone with identifying numbers or marks to indicate points. The mat may look like a target with a series of layered circles or may be a target with individual circles in different places around the mat.

In some implementations, the game mat may include stakes or an object that stands up around which the collapsible beverage insulator 2500 can land to earn points.

Figure 26:
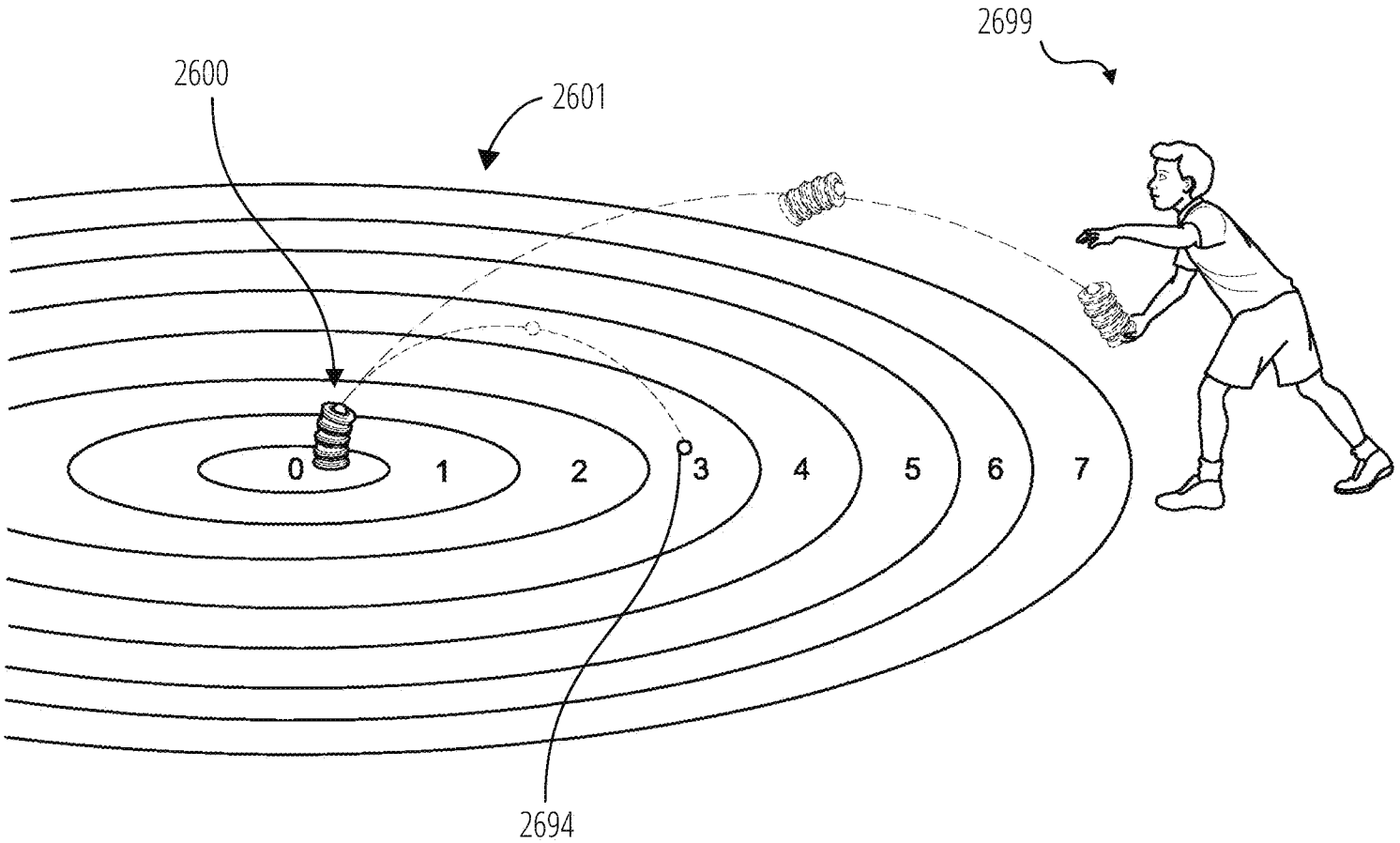
FIG. 26 is an axonometric view of a game target for use with collapsible beverage insulators, according to certain aspects of the present disclosure.

FIG. 26 is an axonometric view of a game target 2601 for use with collapsible beverage insulators 2600, according to certain aspects of the present disclosure. Each collapsible beverage insulator 2600 can be the same as or similar to collapsible beverage insulator 100 of FIG. 1.

The game target 2601 can be in the form of a target (e.g., a round target or other shaped target) with multiple scoring zones. The game target 2601 can be similar to an archery target or darts target, although other target styles can be used. The game target 2601 can be made of any suitable material or combination of materials, such as cloth, canvas, silicon, wood, rubber, or the like.

Certain games can be played by causing a projectile 2694 to be ejected from a collapsible beverage insulator 2600 towards the game target 2601. The goal of the game can be to hit the game target 2601, hit a particular scoring zone within the game target 2601, cause the projectile 2694 to stay on the game target 2601 or a scoring zone thereof, or the like. In some cases, the game target 2601 can be a relatively large target with respect to the collapsible beverage insulator 2600, allowing the collapsible beverage insulator 2600 to land within the confines of the game target 2601 and eject the projectile 2694 out onto another portion of the game target 2601, although this need not always be the case. In some cases, scoring can be based on both a landing location of the collapsible beverage insulator 2600 and a landing location of the projectile 2694.

The projectile 2694 can be caused to be ejected by any suitable technique, such as collapsing of a collapsible zone or deformation of a deformable sidewall while the end opposite the projectile 2694 is occluded. In some cases, collapsing of a collapsible zone or deformation of a deformable sidewall can be accomplished by tossing, flipping, or dropping the collapsible beverage insulator 2600. In other cases, a user may hold the collapsible beverage insulator 2600 and manually manipulate it, such as by slapping the end of the collapsible beverage insulator 2600 opposite the projectile 2694, pushing the two ends of the collapsible beverage insulator 2600 together, or squeezing the collapsible beverage insulator 2600.

As depicted in FIG. 26, a player 2699 is seen holding and then tossing the collapsible beverage insulator 2600 towards the center of the game target 2601. Upon landing, deformation of the sidewall of the collapsible beverage insulator 2600 and/or collapsing of one or more collapsible zones can cause the projectile 2694 to be expelled. As seen in FIG. 26, the projectile 2694 is seen falling onto a scoring zone denoted with the number "3". In such an example, the player 2699 may score three points. In the particular example seen in FIG. 26, the scoring zones increase in value the further they are from the center zone. Thus, a game may be played where the player 2699 tries to land the collapsible beverage insulator 2600 within the center scoring zone with sufficient force to expel the projectile 2694 as far as possible to score higher points. In some cases, no points are scored if the collapsible beverage insulator 2600 fails to land within the center scoring zone. In other cases, the number of points scored equal the value associated with the scoring zone in which the projectile 2694 lands subtracted by the value associated with the scoring zone in which the collapsible beverage insulator 2600 lands. In such an example, if the player 2699 tosses the collapsible beverage insulator 2600 and it lands in the give scoring zone, ejecting the projectile 2694 into the seven scoring zone, the player 2699 would score two points. Other gameplay rules and scoring rules can be used.

In some cases, the projectile 2694 and/or game target 2601 can be treated or otherwise configured to facilitate attachment of the projectile 2694 to the game target 2601. For example, in some cases the projectile 2694 and game target 2601 can include corresponding hook and loop elements (e.g., the game target 2601 can be made of a loop material and the projectile 2694 can include bands of hook material capable of removably attaching to the loop material). In another example, the projectile 2694 can include one or more pointed ends (e.g., a dart tip) capable of becoming temporarily embedded within the game target 2601 (e.g., by piercing a surface of the game target 2601 or by fitting within recesses designed to receive the one or more pointed ends, such as holes of a plastic or soft tip dart board). Other attachment techniques can include the use of magnets or magnetic elements, adhesives (e.g., repositionable adhesives), static electricity forces, or the like.

In some cases, the game target 2601 can be positioned horizontally with respect to the ground, however that need not always be the case. In some cases, the game target 2601 can be positioned non-horizontally with respect to the ground, such as at or approximately vertically (e.g., hung on a wall or door).

In some cases, a receptacle can be used in addition to, instead of, or as a game target 2601. Such a receptacle can be any container suitable for receiving a projectile 2694 and temporarily retaining the projectile 2694. Examples of suitable receptacles include cups, bowls, bags, additional collapsible beverage insulators 2600, and the like.

In some cases, a movable target can be used in addition to, instead of, or as a game target 2601. The game target 2601 can be any object that can be moved when hit by the projectile 2694. Examples of movable targets include blocks, rods, sticks, or other objects placed to fall or be moved away in response to being hit by the projectile 2694. In an example game, users may take turns flipping their collapsible beverage insulator 2600 to try and eject a projectile 2694 and knock over a block balancing on its edge (e.g., a domino standing on its short edge).

In some cases, a body-borne target can be used in addition to, instead of, or as a game target 2601. The body-borne target can be any suitable target that is worn by, held by, or otherwise borne by a user. Examples of body-borne targets include gloves, paddles, bats, clothing, accessories, and the like. In some cases, the body-borne target and/or projectile 2694 can be configured to temporarily couple to one another, such as described above with reference to game targets 2601, For example, a projectile 2694 with hook elements can temporarily attach to a paddle having a loop element surface upon contacting the paddle.

Figure 27:
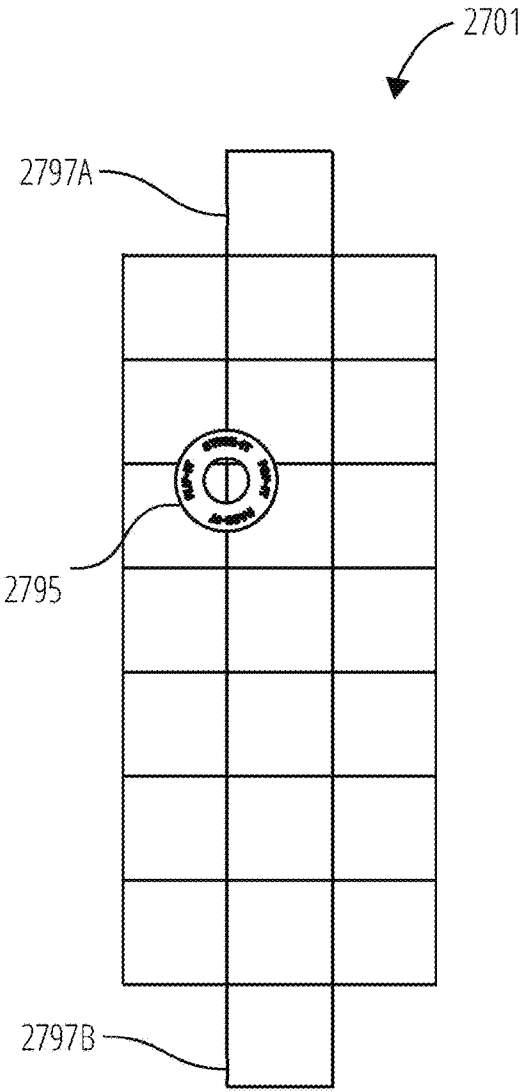
FIG. 27 is a top view of a two-person score board for use with collapsible beverage insulators, according to certain aspects of the present disclosure.

FIG. 27 is a top view of a two-person score board 2701 for use with collapsible beverage insulators, according to certain aspects of the present disclosure. The score board 2701 can be used with any suitable collapsible beverage insulators, such as collapsible beverage insulator 100 of FIG. 1.

The score board 2701 can include a number of zones in which a score token 2795 can be placed. The score token 2795 can begin at a central location, after which points scored by tossing a collapsible beverage insulator can be used to move the score token 2795 towards an end zone (e.g., first end zone 2797A or second end zone 2797B). For example, a first player, upon scoring points, may move the score token 2795 towards the second end zone 2797B. If the score token 2795 moves onto the second end zone 2797B, the game may conclude with the first player as the winner. Likewise, the second player may be attempting to score points to push the score token 2795 to the first end zone 2797A.

Some implementations of the game may use a game mat (e.g., score board 2701) to reflect points. The game mat can consist of a generally grid shape with an end zone on each end that differs from the rest of the grid. The mat can also have a center space that differs from the rest of the grid to help identify a starting position for the score token 2795. The grid is used to reflect the movement of a piece (e.g., the score token 2795) across the mat towards an opponent's end zone based on points scored using the collapsible beverage insulator. In this implementation, the score token 2795 starts in the middle and for each point scored, players can move the score token 2795 toward the opponent, one space at a time per point, until it reaches an endzone.

Figure 28:
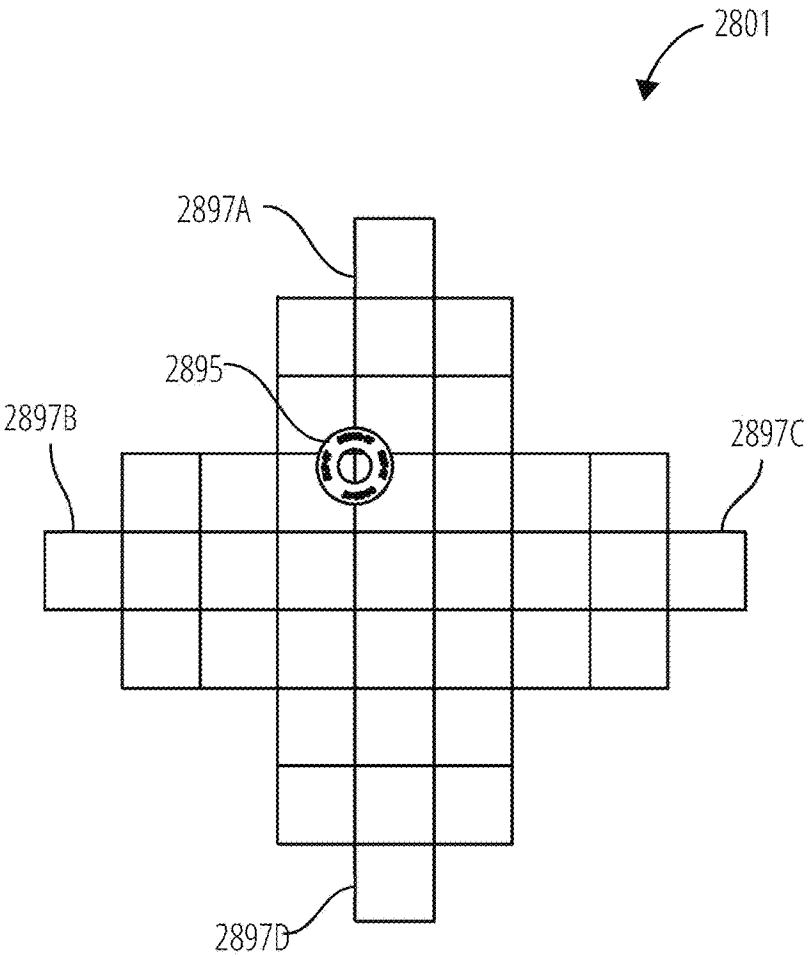
FIG. 28 is a top view of a four-player score board for use with collapsible beverage insulators, according to certain aspects of the present disclosure.

FIG. 28 is a top view of a four-player score board 2801 for use with collapsible beverage insulators, according to certain aspects of the present disclosure. The four-player score board 2801 can be similar to score board 2701 except usable with four different players or teams. In some cases, players can score points using collapsible beverage insulators to try and move the score token 2895 to their own end zone (e.g., first end zone 2897A, second end zone 2897B, third end zone 2897C, or fourth end zone 2897D). Thus, more than two players or teams can compete in a single game.

Figure 29:
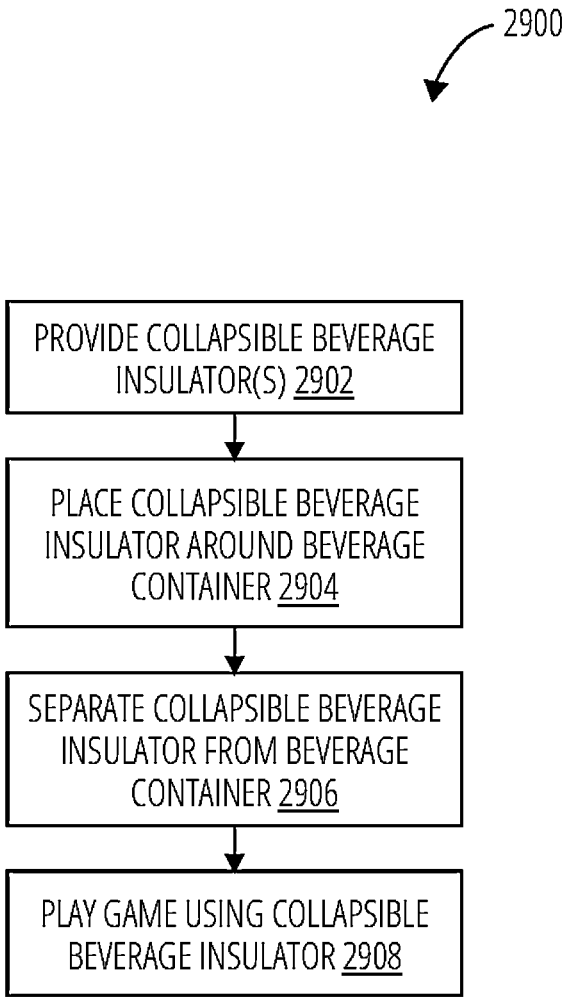
FIG. 29 is a flowchart depicting a process for using collapsible beverage insulators, according to certain aspects of the present disclosure.

FIG. 29 is a flowchart depicting a process 2900 for using collapsible beverage insulators, according to certain aspects of the present disclosure. Process 2900 can be performed using any suitable collapsible beverage insulators, such as collapsible beverage insulator 100 of FIG. 1.

At block 2902, one or more collapsible beverage insulators can be provided.

At block 2904, a collapsible beverage insulator is placed around a beverage container. Placing the collapsible beverage insulator around the beverage container can include opening the beverage container to begin consuming the beverage therein. The collapsible beverage insulator can provide insulation to the beverage container.

At block 2906, the collapsible beverage insulator is separated from the beverage container, such as by removing the beverage container from the collapsible beverage insulator.

At block 2908, the collapsible beverage insulator that was previously insulating the beverage container at block 2904 is used in the playing of a game.

Using the collapsible beverage insulator at block 2908 to play a game can include using the insulator in any of the various fashions as disclosed in further detail herein.

In an example, using the collapsible beverage insulator at block 2908 includes expanding the collapsible zones of the collapsible beverage insulator and tossing the collapsible beverage insulator to cause the collapsible beverage insulator to land on a surface. In some cases, the collapsible beverage insulator landing causes one or more collapsible zones to compress.

In another example, using the collapsible beverage insulator at block 2908 includes rolling the collapsible beverage insulator, such as towards a target. In some cases, prior to rolling the collapsible beverage insulator, a player can manually expand or collapse one or more of the collapsible zones to impart a directionality to the rolling.

Other examples of gameplay can be performed, such as described herein. In some cases, the beverage container from block 2904 or another beverage container can be placed within the collapsible beverage insulator after completion of block 2908 (e.g., after completion of a game or completion of a turn in a game).

In an example of a game variation, the game may be called and proceed as Standard Flip Lines.

Number of players: 2 or more

Objective: The objective of the game is to be the first team to finish flipping and drinking.

Game Setup: Two lines of players stand on opposite sides of a table. Each player has their own collapsible beverage insulator, which is used for flipping and landing.

Gameplay: The game starts with a cheers, then the first player on each line flips their collapsible beverage insulator up in the air with a flip in effort to land it on an end of the table. Once a player successfully lands their collapsible beverage insulator, they count the number of collapsible zones that are collapsed (or not collapsed) and drink that number of drinks or sips from their drink.

The game then continues by passing the collapsible beverage insulator to the next player in line on their side of the table, to expand the collapsible beverage insulator and perform the same process of flipping, landing, and drinking. All players in each line repeat the process until the last player in the line has finished flipping and drinking.

The first team to finish flipping and drinking wins the game.

Additional Optional Rules:

If a player fails to land their collapsible beverage insulator, they must pick it up and try again until they successfully land it.

The game can be played with or without a timer. If a timer is used, each player has a set amount of time to land their collapsible beverage insulator before moving to the next player in line.

If a player accidentally knocks over their drink, they must finish the remainder of their drink and start again with a new drink.

In an example of another game variation, the game may be called and proceed as Caddy Flip Battle-Battle Flip.

Number of players: 2-4+

Objective: The objective of the game is to move the point scoring object into the opponent's end of a grid game mat. The first person to get the object to the other end by flipping the collapsible beverage insulator and scoring points will win.

Game Setup: Players stand on opposite sides of a grid. A point scoring object (e.g., score token) starts in the middle of the game mat grid. Each player uses a collapsible beverage insulator to toss and flip in effort to land it on an end for a point.

Gameplay: When a player lands it on an end, they count the number of collapsible zones collapsed to reflect the number of points gained for that toss. When point(s) are scored, the player uses a game mat in the shape of a grid to move a point scoring object forward towards their opponent. Players can move the point scoring object in any direction on the grid. Players expand the collapsible beverage insulator after a toss to attempt to gain points. Players may choose to take turns flipping for a more relaxed version of the game or make it a race for an exciting version of the game. The point scoring object will go back and forth between players' ends of the grid as they play.

Additional Optional Rules: Players can choose to not alternate turns, rather, make it a race for an exciting version of the game.

In an example of another game variation, the game may be called and proceed as 2v2 Caddy Flip Battle—Battle Flip.

Number of players: 4

Objective: The objective of the game is to move the point scoring object to the opponent's end. Players can choose to pick a square on the grid to pass to create the "end zone" to win.

Game Setup: Two players on the same team stand on each end of the game mat for a total of 4 players. Players use the same general concept of tossing, landing and reflecting points.

Gameplay: When a player lands it on an end, they count the number of collapsible zones collapsed to reflect the number of points gained for that toss. When point(s) are scored, the player uses a game mat in the shape of a grid to move a point scoring object forward towards their opponent. Players can move the point scoring object in any direction on the grid. Players expand the collapsible beverage insulator after a toss to attempt to gain points. The point scoring object will go back and forth between players' ends of the grid as they play.

Additional Optional Rules: Players can choose to only move the point scoring object only move laterally and no diagonal moves.

In an example of another game variation, the game may be called and proceed as 2v2 Caddy Flip Battle-Battle Flip Cross.

Number of players: 4

Objective: The objective of the game is to move the point scoring object to the opponent's end. Players can choose to pick a square on the grid to pass to create the "end zone" to win.

Game Setup: Two players on the same team stand on two different ends of the game mat for a total of 4 players. Players use the same general concept of tossing, landing and reflecting points. The game mat used for the game is in a cross shape creating 4 specific endzones.

Gameplay: When a player lands it on an end, they count the number of collapsible zones collapsed to reflect the number of points gained for that toss. When point(s) are scored, the player uses a game mat in the shape of a grid to move a point scoring object forward towards their opponent. Players can move the point scoring object in any direction on the grid. Players expand the collapsible beverage insulator after a toss to attempt to gain points. The point scoring object will go back and forth between players' ends of the grid as they play.

Additional Optional Rules: Players can choose to only move the point scoring object only laterally and no diagonal moves.

In an example of another game variation, the game may be called and proceed as Free for All Caddy Flip Battle.

Number of players: 4+players

Objective: The objective of the game is to move the point scoring object to the opponent's end by flipping the collapsible beverage insulator and scoring points. The first player to reach the other person's end wins.

Game Setup: Players stand on opposite sides of the game mat grid. The point scoring object starts in the middle of the grid.

Gameplay: Players take turns or race using the collapsible beverage insulator to flip and land it. The number of points earned is determined by the number of collapsible zones that collapse upon landing. When points are earned, the player moves the point scoring object one space closer to the opponent's end of the grid. Players can move the point scoring object in any direction on the grid. Players expand the collapsible beverage insulator after a toss to attempt to gain points. The first player to move the point scoring object to the other person's end by flipping and scoring points wins.

Additional Optional Rules: There are no teams, and players may not interfere with one another's flips or point scoring object movements.

In an example of another game variation, the game may be called and proceed as Free for All Caddy Flip Battle Cross.

Number of players: 4+players

Objective: The objective of the game is to move the point scoring object to the opponent's end by flipping the collapsible beverage insulator and scoring points. The first player to reach the other person's end wins.

Game Setup: Players stand on different ends of the game mat cross, with two players on each end. The point scoring object starts in the middle of the grid.

Gameplay: Players take turns using the collapsible beverage insulator to flip and land it. The number of points earned is determined by the number of collapsible zones that collapse upon landing. When points are earned, the player moves the point scoring object one space closer to the opponent's end of the grid. Players can move the point scoring object in any direction on the grid. Players expand the collapsible beverage insulator after a toss to attempt to gain points. The first player to move the point scoring object to the other person's end by flipping and scoring points wins.

Additional Optional Rules: There are no teams, and players may not interfere with one another's flips or point scoring object movements. The game mat cross has four specific end zones for each player to aim for. Players may choose to only move the point scoring object laterally and not diagonally.

In an example of another game variation, the game may be called and proceed as Caddy Die.

Number of players: 2-4+

Objective: The objective of the game is to score points by tossing and landing a collapsible beverage insulator on a table and making it bounce off or land on the table and into a designated area on the opposing side. The first team to score a predetermined number of points, typically 21, wins the game.

Game Setup: The game makes use of a rectangular table and players sit diagonally across from each other. Teams are defined by the combination of two people standing on opposite sides of the table. Two collapsible beverage insulators are used at a time, one for each player that is on offense.

Gameplay: The game begins with a player on each team tossing their collapsible beverage insulator on to the opposite end of the table. If the collapsible beverage insulator bounces and lands on the opposing side, the team scores a point for every collapsible zone that is collapsed. If the collapsible beverage insulator bounces off the table, the teammate on the other end of the table from the thrower must catch it before it touches the ground. If they miss the catch, the opponent will get a point. For collapsible beverage insulators that land on the opposing side of the table, players use cancellation scoring to determine the final awarded points for that round.

Additional Optional Rules: Each team takes turns tossing the collapsible beverage insulator. When a player is catching a collapsible beverage insulator that has bounced off the table, they must catch with one hand only.

In addition to the standard rules, players can add variations such as requiring a bounce before landing on the opposite side, and allowing the use of certain numbers of collapsed collapsible zones, partial collapsed collapsible zones, or other landing positions to indicate that the tosser that lands it that way has to take a drink.

In an example of another game variation, the game may be called and proceed as Caddy Pop Die.

Number of players: 2-4+

Objective: The objective of the game is to score points by tossing and landing a collapsible beverage insulator that has a projectile inserted and landing it on the opposing side of a table to make the projectile eject and make the collapsible beverage insulator collapse. The first team to score a predetermined number of points, typically 21, wins the game.

Game Setup: The game makes use of a rectangular table and players sit diagonally across from each other. Teams are defined by the combination of one or two people standing on opposite sides of the table. Two collapsible beverage insulators are used individually or at the same time, one for each player that is on offense.

Gameplay: The game begins with a player on the same team tossing their collapsible beverage insulator on to the opposite side of the table. If the collapsible beverage insulator lands on its end on the opposing side, the team scores an additional point for every rib that is collapsed on the collapsible beverage insulator. If the projectile is ejected out of the collapsible beverage insulator, both teams try to catch the projectile. If the projectile is caught by the opposing team, they receive 1 point. If the projectile is not caught by the opposing team, the tossing team gets a point. If the projectile is caught by the tossing team, they receive two points. If the collapsible beverage insulator bounces off the table, the opposing team on the other end of the table from the tosser must catch it before it touches the ground. If they miss the catch, the tossing team will get a point. All points from landing, collapsing, ejecting the projectile and catching the projectile are summed up at the end of each turn. Cancellation scoring is used each turn.

Additional Optional Rules: Each team takes turns tossing the collapsible beverage insulator. When a player is catching the projectile or a collapsible beverage insulator that has bounced off the table, they must catch with one hand only.

In addition to the standard rules, players can add variations such as requiring the use of certain numbers of collapsed collapsible zones, partial collapsed collapsible zones, or other landing positions to indicate that the tosser that lands it that way has to take a drink.

In addition to the standard rules, players may play with drinks on each corner of the table. If the projectile ejects and hits a drink, that results in a point for the tosser. If the projectile lands inside one of the drinks, that results in 3 points for the tosser.

In some implementations of this game variant, the collapsible beverage insulator may have projectiles in both ends. The projectiles may differ in color to indicate a team's color. In this implementation, the objective stays the same to toss, land, collapse, eject, and catch.

In an example of another game variation, the game may be called and proceed as Caddy Toss.

Number of Players: 2+

Objective: The objective of the game is to toss the collapsible beverage insulator and land it on or in a target area, accumulating points and being the first to reach the target score.

Game Setup: To set up the game, players will need a collapsible beverage insulator and a target. The target can be a board with a hole or an upright stick(s) in the center or any other appropriate target. The board should be placed at a distance that is challenging but still achievable for the players to reach. Players should also agree on a point system and a target score to win the game.

Gameplay: Players will take turns tossing their collapsible beverage insulators, attempting to land it on the target. When a player successfully lands the collapsible beverage insulator on the target, they score points based on the designated point system such as the number of collapsible zones collapsed if landing upright or a specific end being upright and or whether or not the collapsible beverage insulator lands around one of the upright sticks. Players continue taking turns until one player reaches the target score and wins the game.

Additional Optional Rules: To add some variety and challenge to the game, players can agree to add Additional Optional Rules such as:

Foul Line: A line is drawn on the ground behind which players must stand when tossing the collapsible beverage insulator. If a player steps over the line during their toss, they forfeit their turn.

Blockade: Players can agree to place objects or obstacles between the throwing line and the target, adding an additional level of challenge.

Defense: Players can intentionally toss their collapsible beverage insulator to knock the opponents out of the landing area or knock it off an end to upset the number of points that the opponent has on the board. Players can use cancellation scoring to change the way scores are calculated.

In an example of another game variation, the game may be called and proceed as Caddy Pop Circle.

Number of players: 2 or more

Objective: To gain the most points by flipping and landing the collapsible beverage insulator on an end and catching the projectile when it is ejected from the collapsible beverage insulator due to pressure when collapsing.

Game Setup: Players stand in a circle around a central point, with one player designated as the tosser. The collapsible beverage insulator has a ball(s) (likely a ping pong ball), or ball-like projectile inserted into the gasket (or inside of the collapsible beverage insulator) of one or both ends.

Gameplay: The tosser throws the collapsible beverage insulator into the air, attempting to land it on a smooth surface and launch the ball out of the other end when it lands. If the ball is inside of the collapsible beverage insulator, the centripetal force of spinning will keep the ball pressed up to one gasket end. When the ball is ejected, the other players attempt to catch it. Each successful catch earns the player one point. The tosser gets a point for each collapsible zone that is collapsed on the collapsible beverage insulator if it still stands on an end.

If the ball is not caught, the tosser gets a point. After each round, the tosser rotates to the next player in the circle.

Additional Optional Rules:

The tosser must vary the flip or height of their throws to prevent predictability.

Players must catch the ball cleanly to earn a point.

Players may interfere with one another's attempts to catch the ball as a defensive strategy.

If the collapsible beverage insulator lands on its side, the tosser loses a point.

The first player to reach a predetermined number of points (such as 10) wins the game.

If playing with two projectiles in each end of the collapsible beverage insulator, the projectiles may be different colors or have a differing identifier. Players can have a designated color/identified projectile to catch to earn points.

If the players do not have a table or smooth ground, they may choose to use their hand or a paddle as a landing surface.

Players can play a version where they do not have to catch the projectile, and instead it is a race to grab it and return it to the center.

If playing without a smooth surface, players can use the spool shape attachment to insert into one end that will close the cavity when landing on an end and create pressure for the projectile to pop out.

In an example of another game variation, the game may be called and proceed as Caddy Pop Die.

Number of players: 2 or more

Objective: To gain the most points by flipping and landing the collapsible beverage insulator on an end and prevent the opposing team from catching the projectile when it is ejected from the collapsible beverage insulator due to pressure when collapsing.

Game Setup: Players stand on opposite sides of a table, with one player designated as the tosser. The collapsible beverage insulator has a ball(s) (likely a ping pong ball), or ball-like projectile inserted into the gasket (or inside of the collapsible beverage insulator) of one or both ends. Filled cups are placed on all 4 corners of the table.

Gameplay: The tosser throws the collapsible beverage insulator into the air, attempting to land it on a smooth surface on the opposite side of the table and launch the ball out of the other end when it lands. If the ball is inside of the collapsible beverage insulator, the centripetal force of spinning will keep the ball pressed up to one gasket end. When the ball is ejected, the opposing team players attempt to catch it. Each successful catch earns the catching team one point. The tosser gets a point for each collapsible zone that is collapsed on the collapsible beverage insulator if it still stands on an end.

If the ball is not caught, the tosser gets a point. After each round, the tosser rotates to the next opposing team.

If the ball is ejected and it hits one of the cups, the tossing team gets a point.

If the ball is ejected and it lands in one of the other team's cups, the tossing team gets 3 points.

Additional Optional Rules:

Two projectiles can be used and placed in opposing sides of the collapsible beverage insulator.

The tosser must vary their throws to prevent predictability.

Players must catch the ball cleanly to earn a point.

Players must catch the ball with one hand.

Players may not interfere with one another's attempts to catch the ball.

If the collapsible beverage insulator lands on its side, the tosser loses a point.

The first player to reach a predetermined number of points (such as 10) wins the game.

If playing with two projectiles in each end of the collapsible beverage insulator, the projectiles may be different colors or have a differing identifier. Players can have a designated color/identified projectile to catch to earn points.

If the players do not have a table or smooth ground, they may choose to use their hand or a paddle as a landing surface.

Players can play a version where they do not have to catch the projectile, and instead it is a race to grab it and return it to the table while other players drink.

If playing without a smooth surface, players can use the spool shape attachment to insert into one end that will close the cavity when landing on an end and create pressure for the projectile to pop out.

In an example of another game variation, the game may be called and proceed as Caddy Stack.

Number of players: 2+players

Objective and play: The objective of the game is to bounce a ball into the opening of a collapsible beverage insulator, then move the collapsible beverage insulator to the next player. With each ball bounced into the opening, the player collapses or expands a collapsible zone before passing to the next player. Two balls and sleeves are used at a time, where it is a race to bounce the ball in, expand or collapse collapsible zones until a specified number of collapsible zones are shown. Once a player gets to the specified position, they proceed to slap or stack the opponent's collapsible beverage insulator to indicate a loss for that opponent. The game can continue around a table of many players.

In any game variation, the use of marks or marks with an orientation, on inner or outer segments of collapsible zones may be used to help a user determine scores and points.

In any game variation, the use of differing identifying colors, ends, sides, etc. may be used to help a user determine scores, team, and points.

In any game variation, the use of the projectile may be used to add another element to the game.

In any game variation, the use of a spool device may be used to help with an airtight seal when landing the collapsible beverage insulator regardless of the landing surface.

In any game variation, the use of a spool with a suction cup bottom may be used to help create a relatively sturdy hold as compared to a flat or non-flat end of a collapsible beverage insulator. This suction cup can also create the ability for the collapsible beverage insulator to land on a surface that is vertical, slanted, or not horizontal.

In any game variation, the use of a specified landing zone may be used to give players a specific point to aim for and reward with points, etc.

In any game variation, the use of points can instead be recognized as "drinks" that need to be taken or passed out from a beverage.

In any game variation, the player tossing the collapsible beverage insulator has an opportunity to toss it higher to help increase the number of points they can score. Because the collapsible beverage insulator needs increased force when landing to collapse additional collapsible zones as well as create more pressure for the projectile to shoot further and faster, making it harder for an opponent to catch, the player will want to toss the collapsible beverage insulator higher. This process also comes with higher risk because with a high toss, it is significantly harder to control the flips and intentionally land it on an end, let alone the correct end if playing with colored ends. This makes the effort high risk but high reward.

Various gameplay variations are described herein. In some cases, modified versions of these gameplay variations can be achieved by modifying, removing, or adding rules, such as changing a score needed to win. In some cases, rules from any gameplay variation disclosed herein may be combined with rules from any other gameplay variation(s) disclosed herein to create new gameplay variations.

While process 2900 is described with various blocks in a particular order, in some cases process 2900 can include different blocks (e.g., fewer, more, or alternate blocks) and/or blocks in a different order. In an example where the collapsible beverage insulator is replaced with a collapsible sleeve, process 2900 can include providing a collapsible sleeve at block 2702, can not include block 2704 or block 2706, and can proceed with block 2708 by playing a game using the collapsible sleeve.

Figure 30:
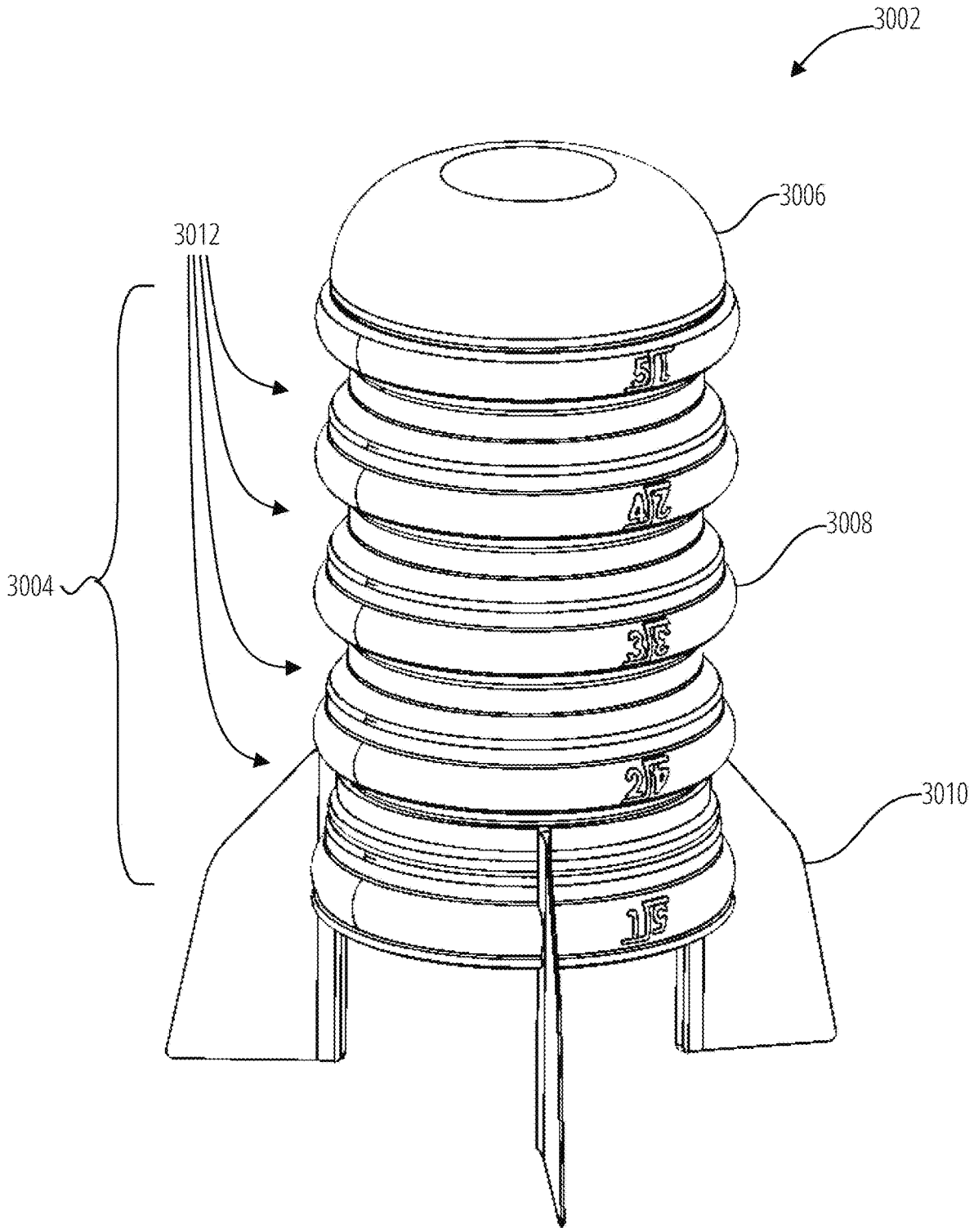
FIG. 30 is a three-dimensional projection of a collapsible game piece with fins and a truncated spheroid nose piece, according to certain aspects of the present disclosure.

FIG. 30 is a three-dimensional projection of a collapsible game piece 3002 with fins 3010 and a truncated spheroid nose piece 3006, according to certain aspects of the present disclosure. The collapsible game piece 3002 can include a main body 3004 with an attached set of fins 3010 and an attached nose piece 3006. The main body 3004 can be a collapsible beverage insulator as described herein, although that need not always be the case.

The main body 3004 can include a sidewall 3008, a projectile opening (not visible) and an accessory opening (not visible). As depicted in FIG. 30, the collapsible game piece 3002 includes a nose piece 3006 and a set of fins 3010 coupled to the main body 3004.

An interior volume can be defined by the sidewall 3008, the projectile end, and the nose end and/or the nose piece 3006.

The nose piece 3006 depicted in FIG. 30 is coupled to the sidewall 3008 via the accessory opening, although in some cases the nose piece 3006 is coupled to the sidewall 3008 in other fashions. Examples of ways to couple a nose piece 3006 to a sidewall 3008 include a threaded coupling, an interference fit, mating features, adhesives, and the like.

The nose piece 3006 takes on a truncated spheroid shape or a truncated spherical shape, although that need not always be the case. The truncated spheroid shape provides a safe, aerodynamically favorable (e.g., as compared to flat nose pieces) shape that still permits the collapsible game piece 3002 to land with the projectile opening facing upwards.

The sidewall 3008 can be any suitable sidewall as disclosed herein, such as sidewall 128 of FIG. 1. The sidewall 3008 includes one or more collapsible zone 3012.

A set of fins 3010 is removably coupled to the sidewall 3008. In some cases, the set of fins 3010 can be non-removably coupled to the sidewall 3008.

Figure 31:
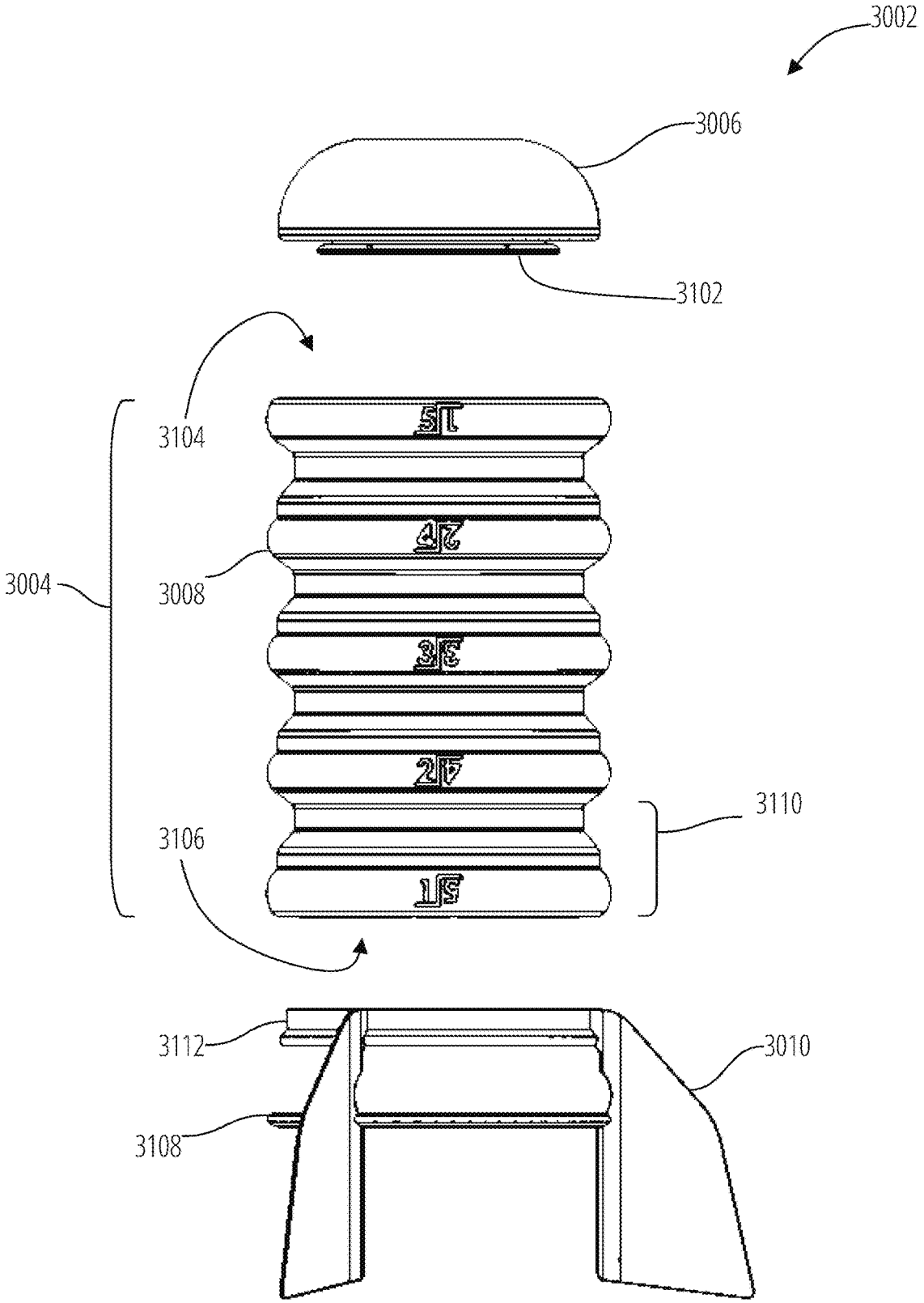
FIG. 31 is a front exploded view of the collapsible game piece of FIG. 30.

FIG. 31 is a front exploded view of the collapsible game piece 3002 of FIG. 30. The collapsible game piece 3002 includes a main body 3004, a nose piece 3006, and a set of fins 3010.

The main body 3004 includes a sidewall 3008, a nose end 3104, and a projectile end 3106. The nose end 3104 includes an accessory opening (not visible). The projectile end 3106 includes a projectile opening (not visible). The main body 3004 depicted in FIG. 30 is monolithically formed, although that need not always be the case.

The nose piece 3006 includes a retention lip 3102 that can fit within the accessory opening of the nose end 3104. The retention lip 3102 can have a diameter larger than the nose end 3104 such that the nose piece 3006 can be attached to the sidewall 3008 by stretching the accessory opening to fit around the retention lip 3102, then letting the accessory opening spring back to shape to secure the nose piece 3006 in the side wall 3008.

The set of fins 3010 can be designed to fit around the main body 3004 and can be attached in any suitable fashion. As depicted in FIG. 31, the set of fins 3010 includes a front retention ring 3112 and a rear retention ring 3108. The front retention ring 3112 is shaped to correspond to a portion of a first collapsible zone 3110. The rear retention ring 3108 is shaped to support the projectile end 3106 (e.g., from the bottom, as depicted in FIG. 31). Thus, the set of fins 3010 can be attached to the main body 3004 by compressing the main body 3004 and inserting it through the front retention ring 3112. Once released, the main body 3004 would expand to its original shape and be retained within the front retention ring 3112.

In some case, the set of fins 3010 can be attached to the main body 3004 by only a single retention ring, such as only rear retention ring 3108.

Figure 32:
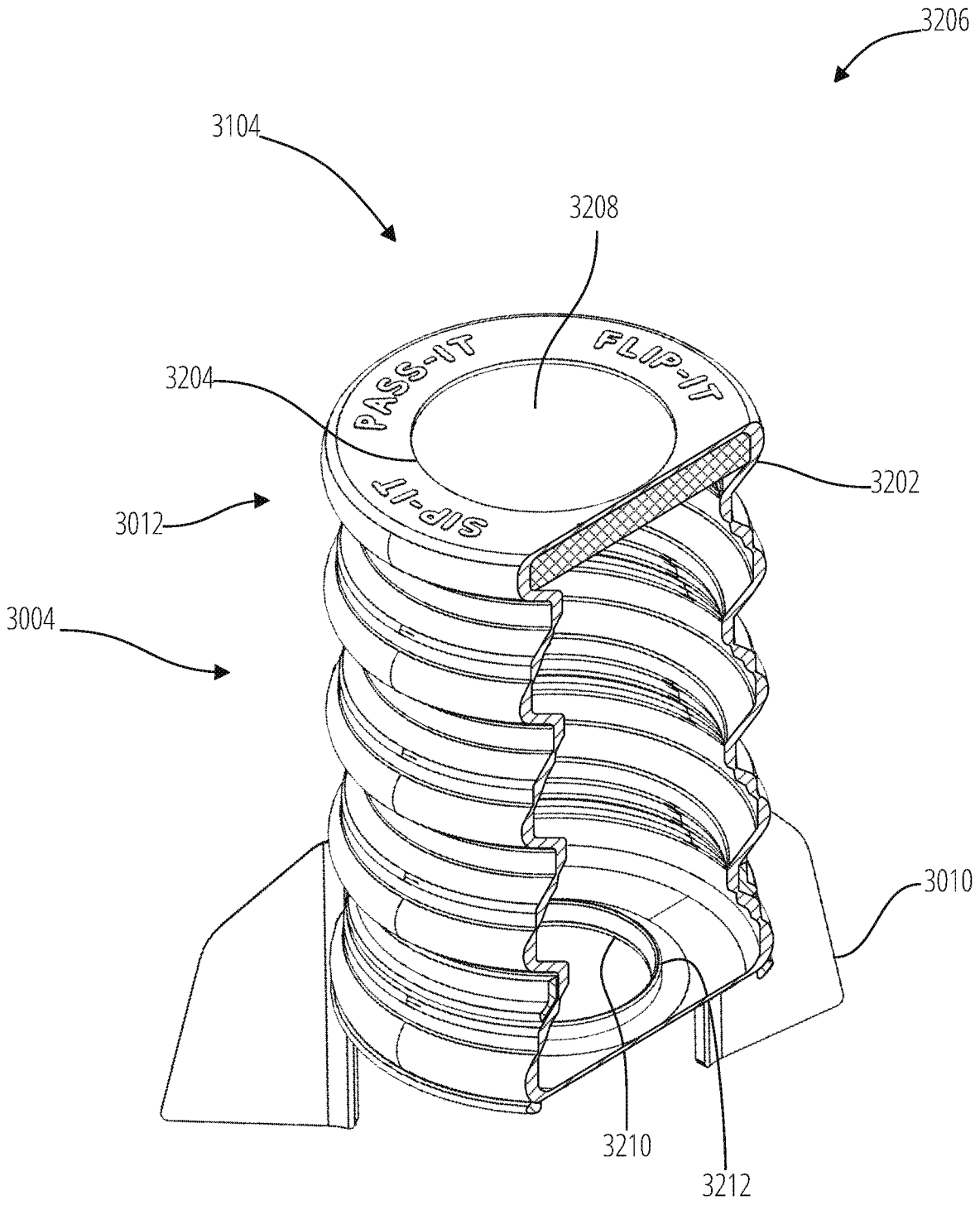
FIG. 32 is an isometric partial cut-away view of a collapsible game piece with a weighted, internal nose piece, according to certain aspects of the present disclosure.

FIG. 32 is an isometric partial cut-away view of a collapsible game piece 3206 with a weighted, internal nose piece 3202, according to certain aspects of the present disclosure. The collapsible game piece 3206 can be the same as collapsible game piece 3002, but with nose piece 3202 instead of nose piece 3006 of FIG. 30. The collapsible game piece 3206 includes a main body 3004, a nose piece 3202, and a set of fins 3010.

The main body 3004 includes a nose end 3104 having an accessory opening 3204. A flat face 3208 of the nose piece 3202 is visible through the accessory opening 3204 and can seal (e.g., fully seal or substantially seal) the accessory opening 3204 such that when the main body 3004 is compressed (e.g., one or more collapsible zones 3012 is collapsed), pressure builds up within the main body 3004 to eject a projectile from the projectile opening 3210. The nose piece 3202 can be located within a set of ridges of the collapsible zone 3012 nearest the accessory opening 3204. The nose piece 3202 can be weighted to move the center of gravity away from the projectile opening 3210.

Figure 33:
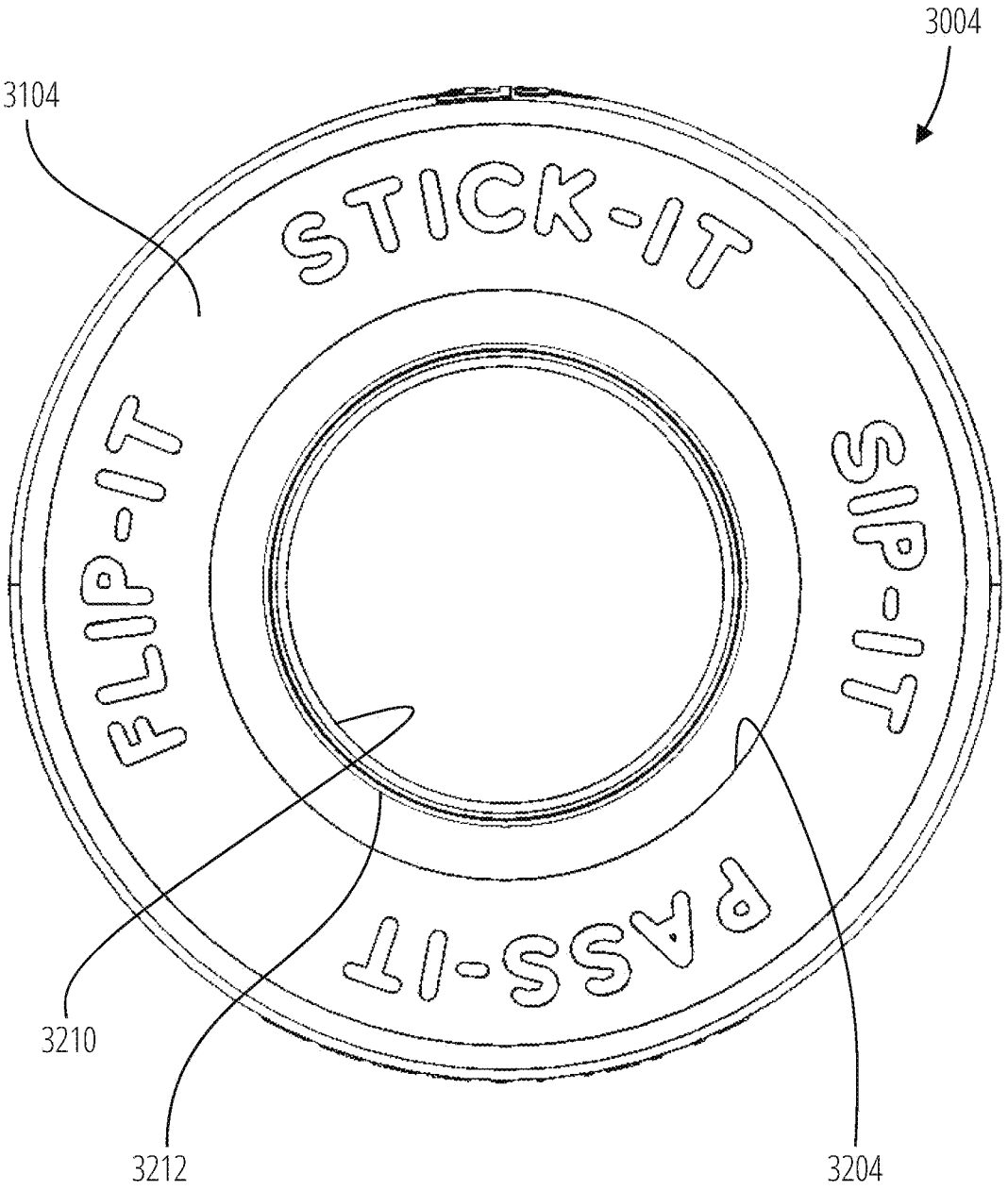
FIG. 33 is an end view of a main body of a collapsible game piece, according to certain aspects of the present disclosure.

FIG. 33 is an end view of a main body 3004 of a collapsible game piece (e.g., collapsible game piece 3002 of FIG. 30), according to certain aspects of the present disclosure. As depicted, the nose end 3104 is facing the viewer. The nose end 3104 includes an accessory opening 3204. A projectile opening 3210 is visible through the accessory opening 3204, as the accessory opening 3204 has a larger diameter than the projectile opening 3210. The projectile opening 3210 includes a lip 3212 to facilitate retaining a projectile within.

Figure 34:
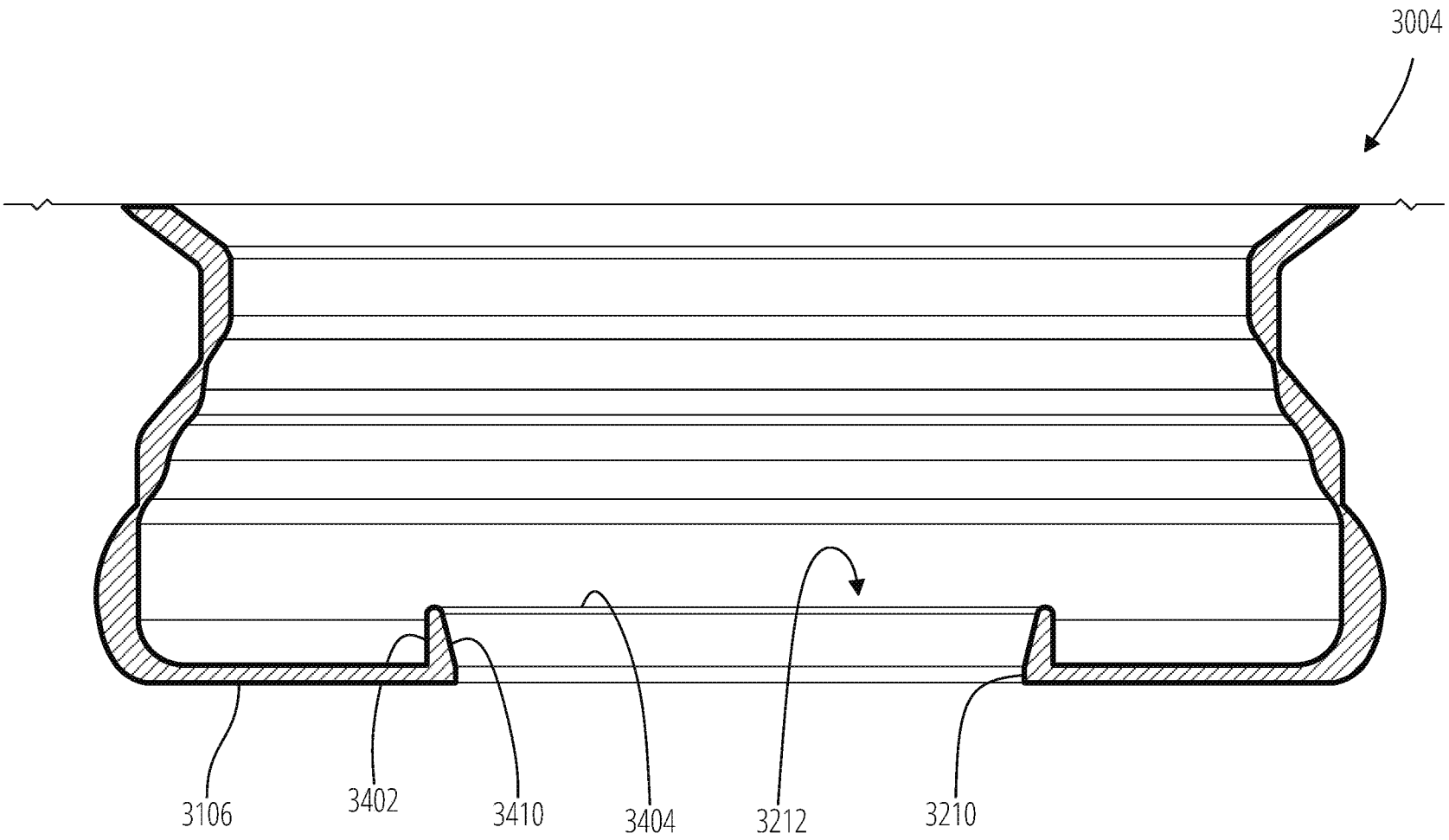
FIG. 34 is a front cutaway view of a portion of a main body of a collapsible game piece, according to certain aspects of the present disclosure.

FIG. 34 is a front cutaway view of a portion of a main body 3004 of a collapsible game piece, according to certain aspects of the present disclosure. The collapsible game piece can be collapsible game piece 3002 of FIG. 1. The projectile end 3106 includes a projectile opening 3210. A lip 3212 extends from the projectile opening 3210.

The lip 3212 can take various forms and have various profiles. The profile of the lip 3212 can be configured to help locate a projectile in a certain position and/or to help retain a projectile (e.g., increase the amount of pressure needed to eject the projectile). In some cases, the profile of the lip 3212 can be shaped to increase the amount of surface area touching the projectile when pressure is applied in a particular direction.

As depicted in FIG. 34, the lip 3212 has a profile that matches the diameter of the projectile opening 3210 at the projectile opening 3210, then gradually increases in diameter (e.g., linearly, parabolically, etc.) as it extends away from the projectile opening 3210, up to a lip rim 3404. The lip outer wall 3402 of the lip 3212 can extend perpendicularly or substantially perpendicularly away from the projectile end 3106 up to the lip rim 3404. This type of lip profile can have advantages. For example, the funnel-like shape directs projectiles in the main body 3004 towards the projectile opening 3210. When the projectile opening 3210 is slightly smaller than the diameter of the projectile, force applied to push the projectile through the projectile opening 3210 from within the main body 3004 can cause the projectile to be retained by the projectile opening 3210 (e.g., due to clastic deformation of the projectile opening 3210).

Figure 35:
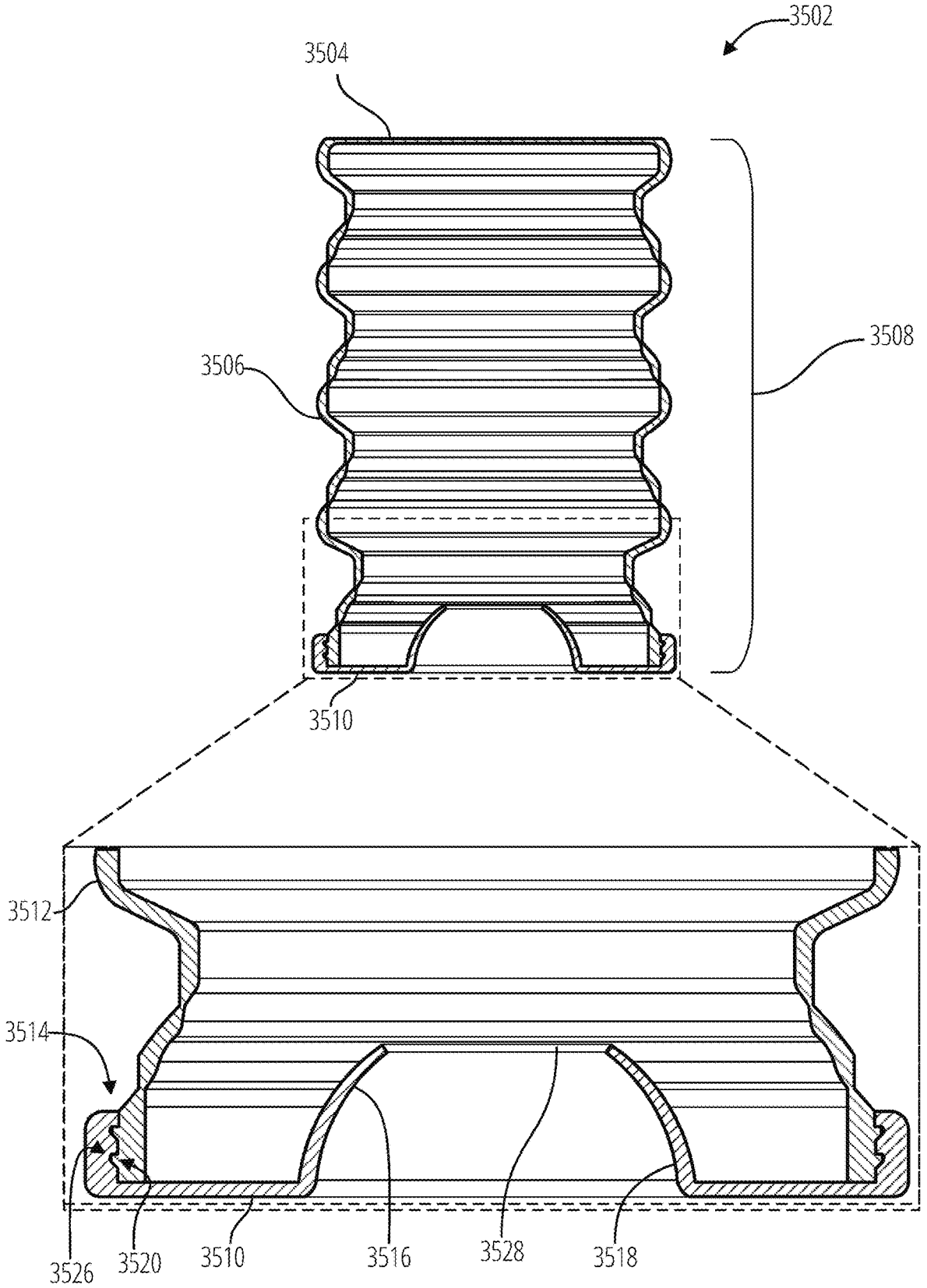
FIG. 35 is a cutaway front view and close-up cutaway front view of a collapsible game piece with a detachable projectile end, according to certain aspects of the present disclosure.

FIG. 35 is a cutaway front view and close-up cutaway front view of a collapsible game piece 3502 with a detachable projectile end 3510, according to certain aspects of the present disclosure. The collapsible game piece 3502 can be similar to the collapsible game piece 3002 of FIG. 30, but with slightly different components in a slightly different arrangement. The main body 3508 can be a collapsible beverage insulator as described herein, although that need not always be the case.

The main body 3508 includes an integral sidewall 3506 and nose end 3504 and a separable projectile end 3510. The nose end 3504 does not contain an accessory opening, and instead defines a solid end wall of the main body 3508. The projectile end 3510 can be removably coupled to the sidewall 3506 by a coupling 3514. The coupling 3514 depicted in FIG. 35 includes a pair of ridges ridge 3520 of the sidewall 3506 that engage a pair of corresponding valleys 3526 of the projectile end 3510. The clastic nature of the sidewall 3506 and/or projectile end 3510 permits the projectile end 3510 to be pressed onto or stretched over the ridges 3520 until the ridges 3520 engage the valleys 3526. Other coupling techniques, such as those described herein, can be used.

The collapsible game piece 3502 further includes an alternatively shaped lip 3516. The lip profile of the lip 3516 can be especially useful for retaining a projectile, especially a spherical projectile, while discouraging the projectile from being fully inserted into the main body 3508. The lip 3516 has a profile that matches the diameter of the projectile opening 3518 at the projectile opening 3518, then gradually decreases in diameter (e.g., spherically or parabolically) as it extends away from the projectile opening 3518, up to a lip rim 3528. The diameter of the projectile opening 3518 can be approximately the same as or slightly smaller than that of the projectile.

As a projectile is inserted into the projectile opening 3518, the projectile opening 3518 will start to be elastically deformed to fit around the projectile, and the projectile will eventually contact the lip 3516. Initially, the lip 3516 will provide some inherent pressure against further insertion. As the projectile continues to be pushed through the projectile opening 3518, increased pressure on the lip 3516 can cause elastic deformation of the lip 3516, permitting the projectile to further pass through the projectile opening 3518. Once the widest point of the projectile has passed through the projectile opening 3518 (e.g., once half of a spherical projectile has passed through the projectile opening 3518), the projectile opening 3518 will start to elastically rebound towards its natural diameter, thus closing around the projectile and applying some force to urge the projectile deeper into the main body 3508. The lip 3516, however, will prevent the projectile from being pushed fully into the main body 3508, thus retaining the projectile in a defined location between the lip 3516 and the projectile opening 3518. In some cases, the lip 3516 can further provide some force (e.g., through elastic deformation) to help urge the projectile out of the main body 3508, although that need not always be the case. The height and contour of the lip 3516, as well as the diameter of the projectile opening 3518, can be configured to ensure the projectile opening 3518 is at its natural diameter or slightly larger than its natural diameter when the projectile is seated in the lip 3516.

While a projectile is being retained by a projectile opening 3518 (e.g., retained by a projectile opening 3518 in conjunction with a lip 3516), pressure can build up within the main body 3508 (e.g., due to the collapsing of collapsible zones of the sidewall 3506) until sufficient pressure has been achieved to elastically deform the projectile opening 3518 sufficiently to eject the projectile. The diameter of the projectile opening 3518 and the elasticity or durometer hardness of the material used to make up the projectile opening 3518 can be configured to retain the projectile with different amounts of force, thus requiring different amounts of pressure to build up within the main body 3508 before the projectile is expelled. Thus, multiple versions of projectile end 3510 can be user-interchangeable to adjust how much pressure is needed to expel a projectile.

In some cases, the collapsible game piece 3502 of FIG. 35 can be beneficially used as a beverage insulator or container before or after attachment of the projectile end 3510 to use the collapsible game piece in gameplay.

Figure 36:
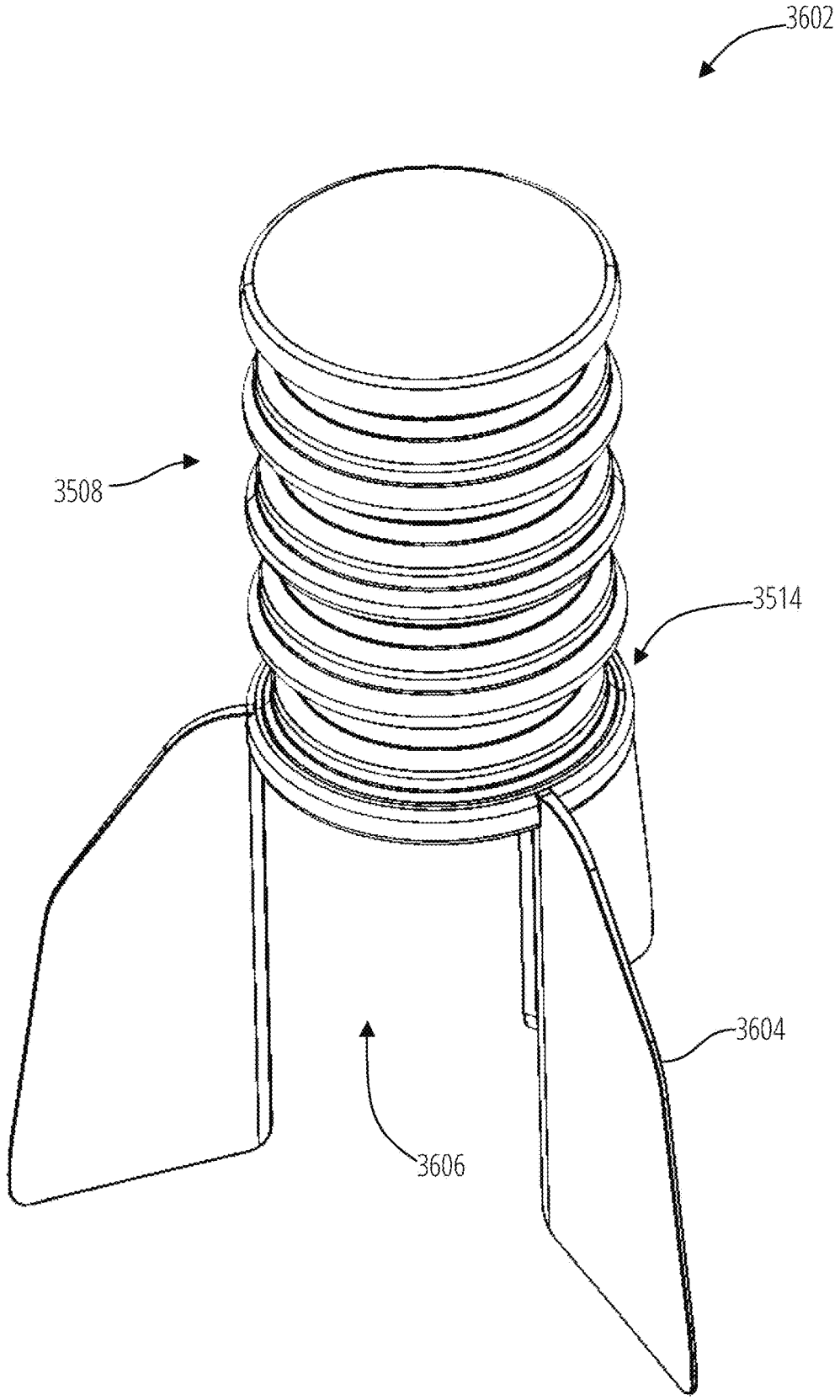
FIG. 36 is a three-dimensional projection of a collapsible game piece with detachable fins, according to certain aspects of the present disclosure.

FIG. 36 is a three-dimensional projection of a collapsible game piece 3602 with detachable fins 3604, according to certain aspects of the present disclosure. The collapsible game piece 3602 can be the collapsible game piece 3502 of FIG. 35, but with an alternate projectile end 3606 instead of projectile end 3510 of FIG. 35.

The projectile end 3606 can include a projectile opening (not visible) similar to that of the projectile end 3510 of FIG. 35. However, the projectile end 3606 can additionally include a set of fins 3604 extending away from the main body 3508. The projectile end 3606 is coupled to the main body 3508 at coupling 3514. In some cases, the projectile end 3606 can be made of a relatively stiff material, such as a hard plastic, optionally with a more elastic material being used to define the projectile opening and lip. In some cases, only the fins 3604 of the projectile end 3606 are made of a relatively stiff material, such as a hard plastic. As described in further detail herein, the fins 3604 can help improve the aerodynamics of the collapsible game piece 3602. In some cases, when fins 3604 are used, no weighted accessories are needed to encourage the collapsible game piece 3602 to land with the projectile opening facing upwards.

Figure 37:
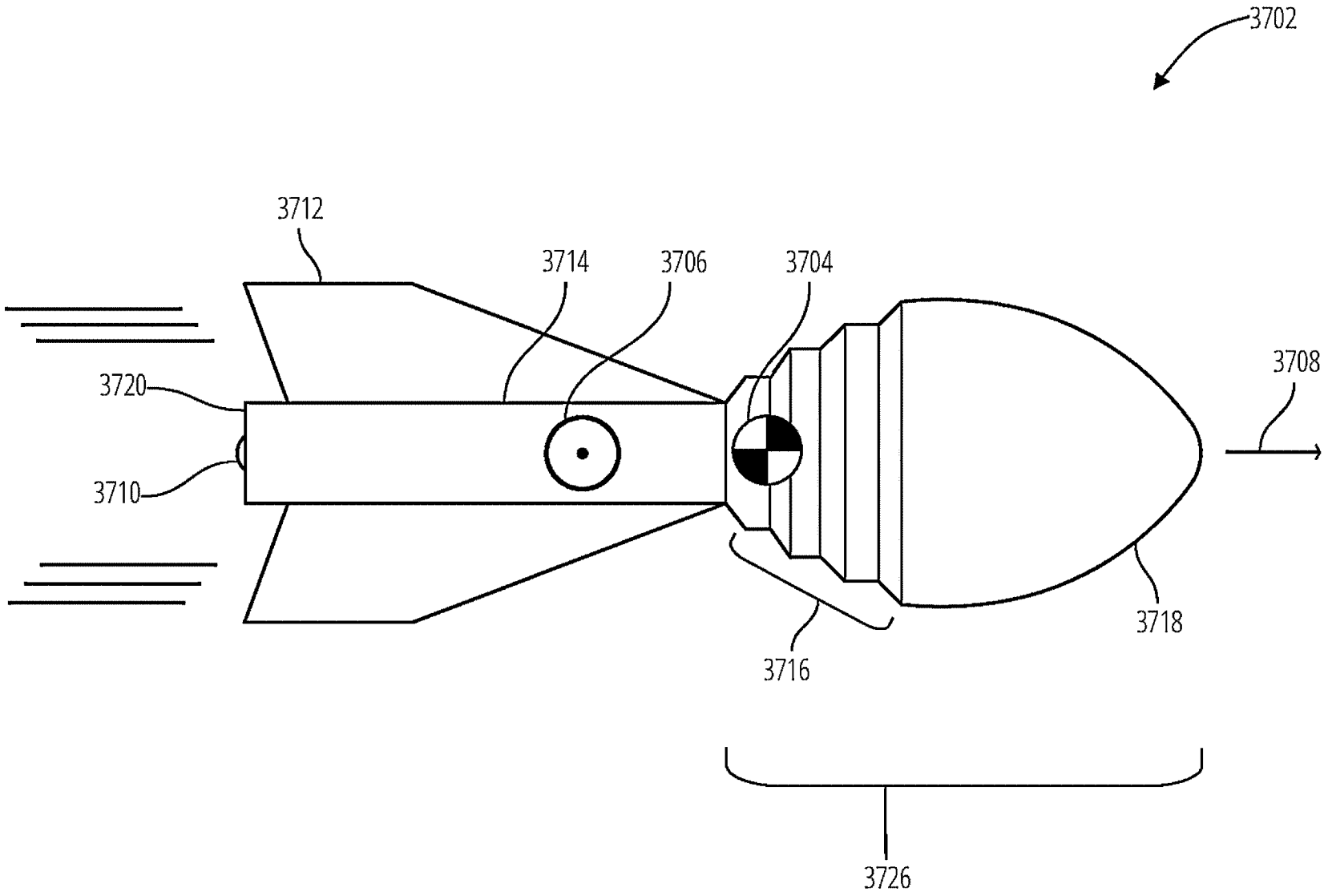
FIG. 37 is a side view of a collapsible game piece in flight, according to certain aspects of the present disclosure.

FIG. 37 is a side view of a collapsible game piece 3702 in flight, according to certain aspects of the present disclosure. The collapsible game piece 3702 can be similar to other collapsible game pieces depicted herein, except with a differently shaped main body 3726. The collapsible game piece 3702 is depicted flying in direction 3708. A projectile 3710 is retained within a projectile opening (and accompanying lip) of a projectile end 3720. The projectile opening and lip of the collapsible game piece 3702 may be the same as or similar to projectile opening 3518 and lip 3516 of FIG. 35.

The main body 3726 can have an ellipsoidal shape, with one or more collapsible zones 3716 and a nose end 3718. The one or more collapsible zones 3716 can move between an expanded state (as shown) and a collapsed state. When moving to the collapsed state, pressure will build within the main body 3726 and eject projectile 3710 from the projectile opening at the projectile end 3720.

The collapsible game piece 3702 can include a tail 3714 with fins 3712. The tail 3714 with fins 3712 can extend away from the nose end 3718, and can include the projectile end 3720. In some cases, the projectile end 3720 can be the rear-most part of the collapsible game piece 3702, although that need not always be the case. In some cases, the fins 3712 may extend rearward (e.g., away from the nose end 3718) past the projectile end 3720.

The collapsible game piece 3702 will naturally have a center of gravity 3704 defined by its distribution of mass and a center of pressure 3706, defined by its distribution of surface area. By configuring the collapsible game piece 3702 so the center of gravity 3704 is closer towards the front of the collapsible game piece 3702 (e.g., towards the nose end 3718) than the center of pressure 3706, the collapsible game piece 3702 will remain stable in flight. The use of fins 3712 can help move the center of pressure 3706 towards the rear of the collapsible game piece 3702. The use of a tail 3714 can help move the center of pressure 3706 towards the rear of the collapsible game piece 3702, and if light-weight enough, move the center of gravity 3704 towards the front of the collapsible game piece 3702.

When the nose end 3718 contacts a surface, the collapsible zone 3716 can collapse, and optionally the nose end 3718 can compress and/or deform, resulting in the ejection of the projectile 3710 from the projectile end 3720. In implementations where the nose end 3718 can compress and/or deform, the collapsible game piece 3702 can be considered to be a mixed collapsible/compressible game piece, as both collapsing of the one or more collapsible zones 3716 and compression of the nose end 3718 act to reduce the interior volume of the game piece and eject the projectile 3710.

Figure 38:
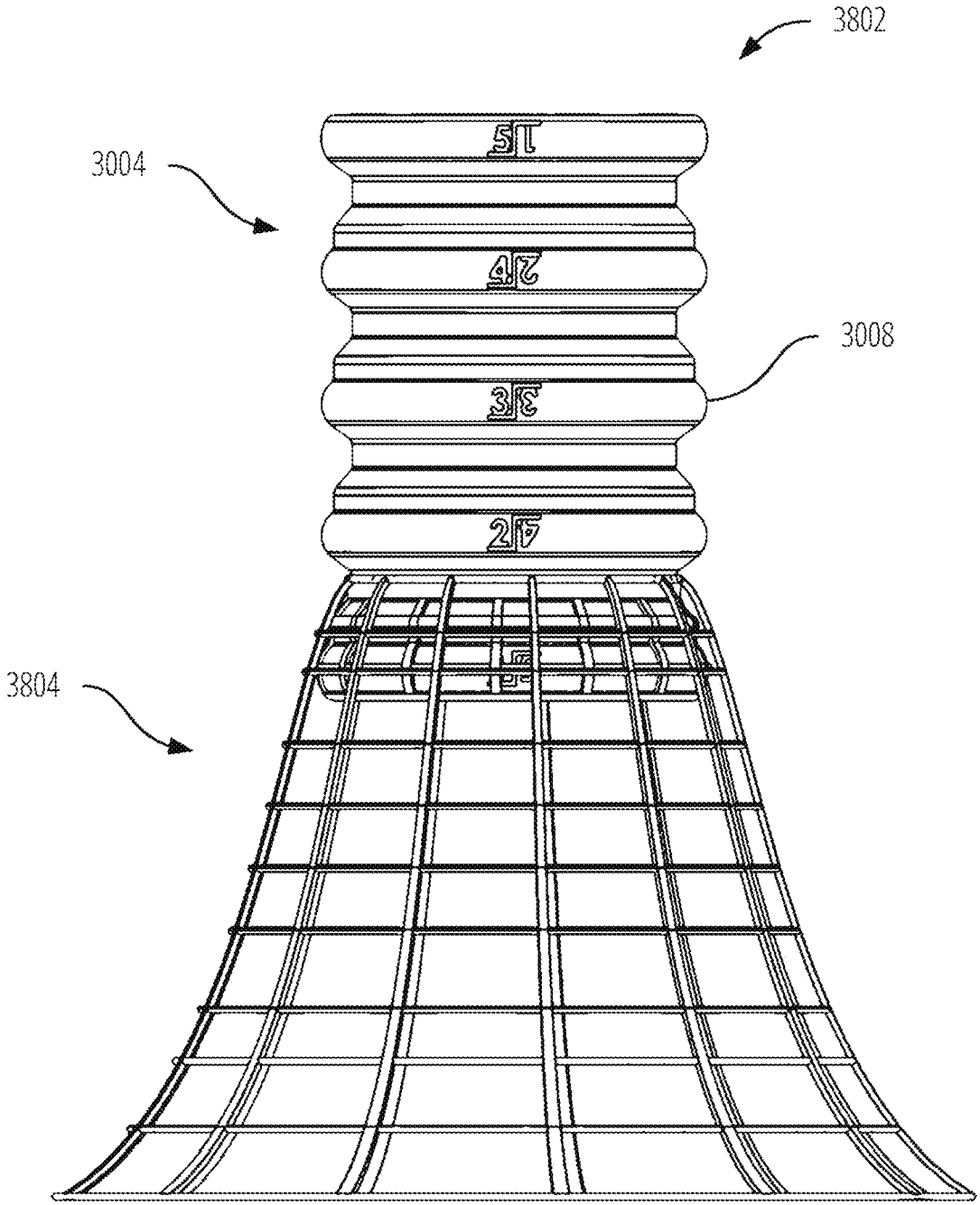
FIG. 38 is a front view of a collapsible game piece with a shuttlecock fin, according to certain aspects of the present disclosure.

FIG. 38 is a front view of a collapsible game piece 3802 with a shuttlecock fin 3804, according to certain aspects of the present disclosure. The collapsible game piece 3802 can be similar to the collapsible game piece 3002 of FIG. 30, except with a flat, weighted, internal nose piece instead of a truncated spheroid nose piece (e.g., truncated spheroid nose piece 3006 of FIG. 30) and with a single shuttlecock fin 3804 instead of fins (e.g., fins 3010 of FIG. 30).

The shuttlecock fin 3804 acts as a single fin extending away from the main body 3004 from near the projectile end. As depicted in FIG. 38, the shuttlecock fin 3804 is designed to be positioned around the sidewall 3008, such as similarly to how the fins 3010 fit around the sidewall 3008 of the collapsible game piece 3002 of FIG. 30.

As used herein, when fins are described, they are intended to include both multi-fin arrangements (e.g., fins 3010 of FIG. 30) and single-fin arrangements (e.g., shuttlecock fin 3804). As used herein, the term set of fins is intended to include one or more fins.

Figure 39:
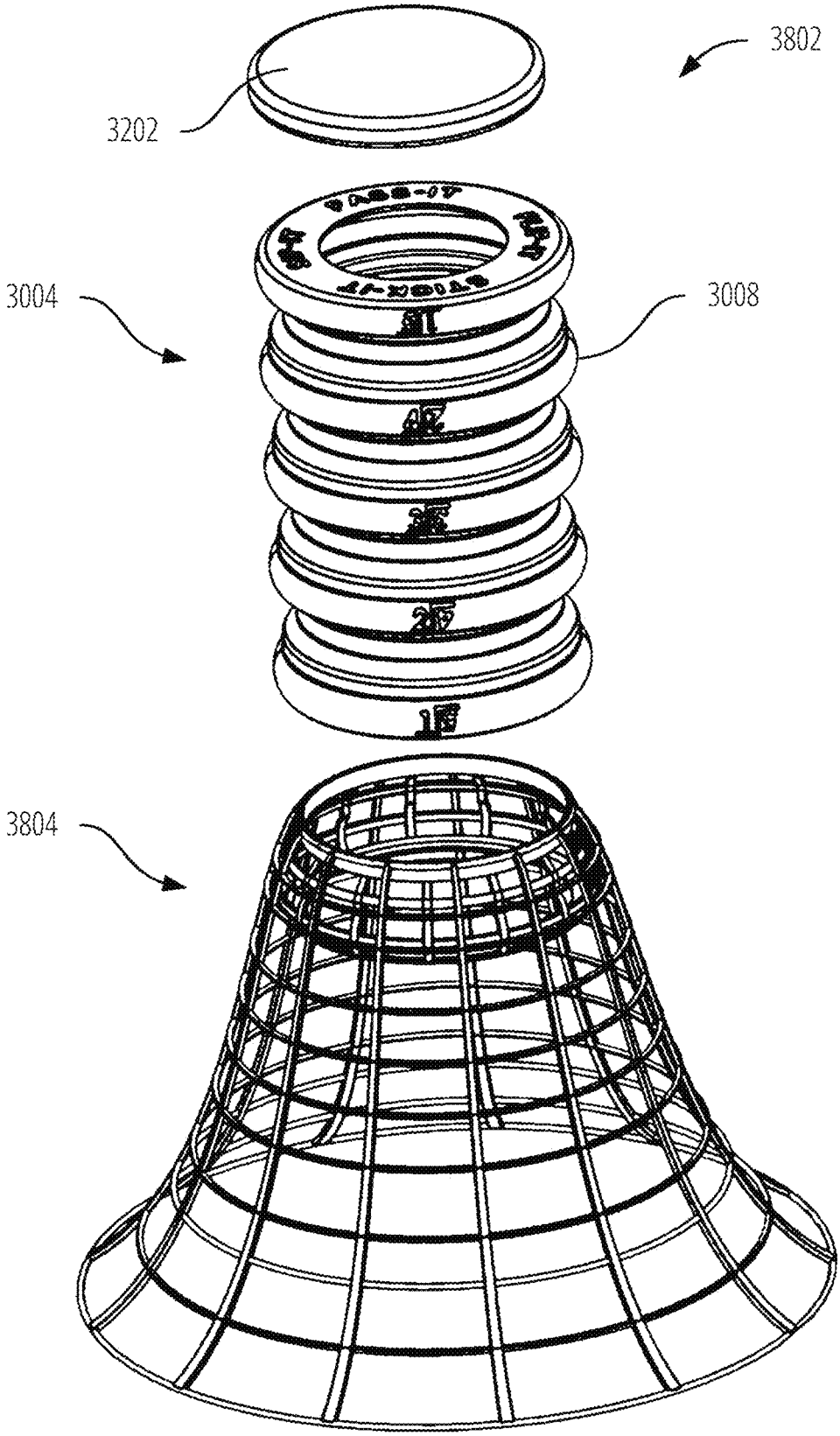
FIG. 39 is an exploded three-dimensional projection of the collapsible game piece of FIG. 38, according to certain aspects of the present disclosure.

FIG. 39 is an exploded three-dimensional projection of the collapsible game piece 3802 of FIG. 38, according to certain aspects of the present disclosure. The collapsible game piece 3802 can be similar to the collapsible game piece 3002 of FIG. 30, except with a flat, weighted nose piece 3806 that fits within the sidewall 3008 (similarly to how nose piece 3202 fits within the main body 3004 of the collapsible game piece 3206 of FIG. 32) instead of a truncated spheroid nose piece (e.g., truncated spheroid nose piece 3006 of FIG. 30) and with a single shuttlecock fin 3804 instead of fins (e.g., fins 3010 of FIG. 30).

The shuttlecock fin 3804 acts as a single fin extending away from the main body 3004 from near the projectile end.

The various collapsible game pieces described herein and depicted with reference to FIGS. 30-37 can be used to play games, including those described herein (e.g., the games described with reference to FIGS. 25-28). Additionally, various accessories and components (e.g., spools, suction bases, etc.), such as those described with reference to collapsible beverage insulators, can be used with (or, as necessary, adapted for) collapsible game pieces.

Figure 40:
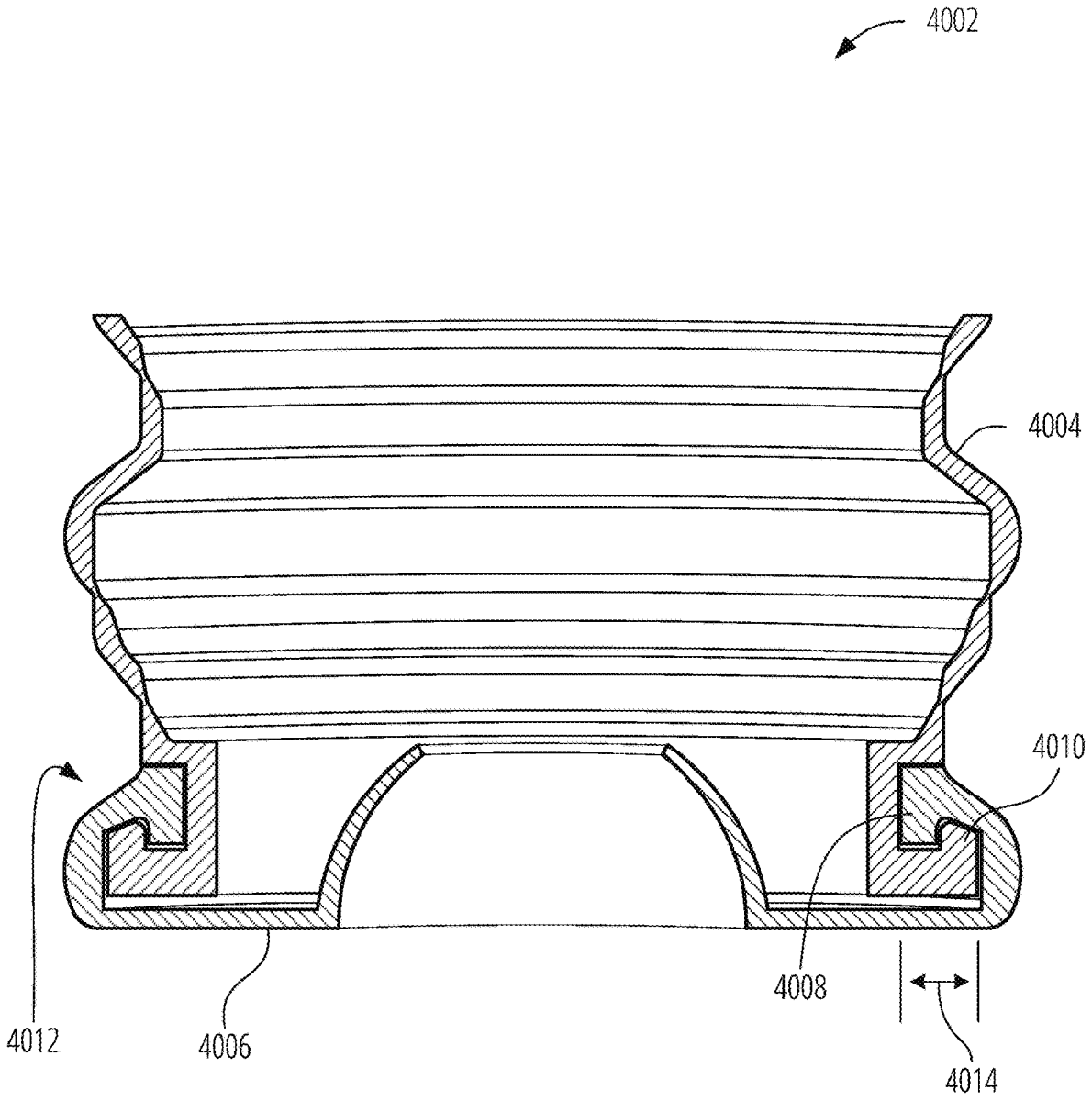
FIG. 40 is a cutaway front view of a portion of a collapsible game piece with a detachable projectile end, according to certain aspects of the present disclosure.

FIG. 40 is a cutaway front view of a portion of a collapsible game piece 4002 with a detachable projectile end 4006, according to certain aspects of the present disclosure. The collapsible game piece 4002 can be similar to the collapsible game piece 3502 of FIG. 35, but with a detachable projectile end 4006 that attaches differently than that of the collapsible game piece 3502 of FIG. 35. The collapsible game piece 4002 can be a collapsible beverage insulator as described herein, although that need not always be the case.

The detachable projectile end 4006 can attach to the sidewall 4004 at an attachment point 4012. The attachment point 4012 shown in FIG. 40 includes an inner lip 4010 of the sidewall 4004 that engages with an outer lip 4008 of the detachable projectile end 4006. The inner lip 4010 and outer lip 4008 can take the form of a hook shape or a "J" shape, although that need not always be the case. The outer lip 4008 and inner lip 4010 can overlap by a distance 4014 such that the detachable projectile end 4006 is engaged with the sidewall 4004 during use. In some cases, the outer lip 4008 and inner lip 4010 can overlap by at or approximately 1-3 mm. In some cases, the outer lip 4008 and inner lip 4010 overlap by between 1-20 mm. In some cases, the outer lip 4008 and inner lip 4010 overlap by about 2 mm, about 5 mm, about 8 mm, about 10 mm, about 15 mm, about 20 mm, or any other number therebetween.

The overlapping arrangement of the inner lip 4008 and outer lip 4010, especially when the detachable projectile end 4006 and sidewall 4004 are made of a elastomeric material, allow the detachable projectile end 4006 to easily attach to and detach from the sidewall 4004 by hand without tools, all while still ensuring the detachable projectile end 4006 remains securely attached to the sidewall 4004 during use.

In some cases, other or additional techniques can be used to removably couple the detachable projectile end 4006 to the sidewall 4004, such as threads, magnets, snaps, and the like.

Figure 41:
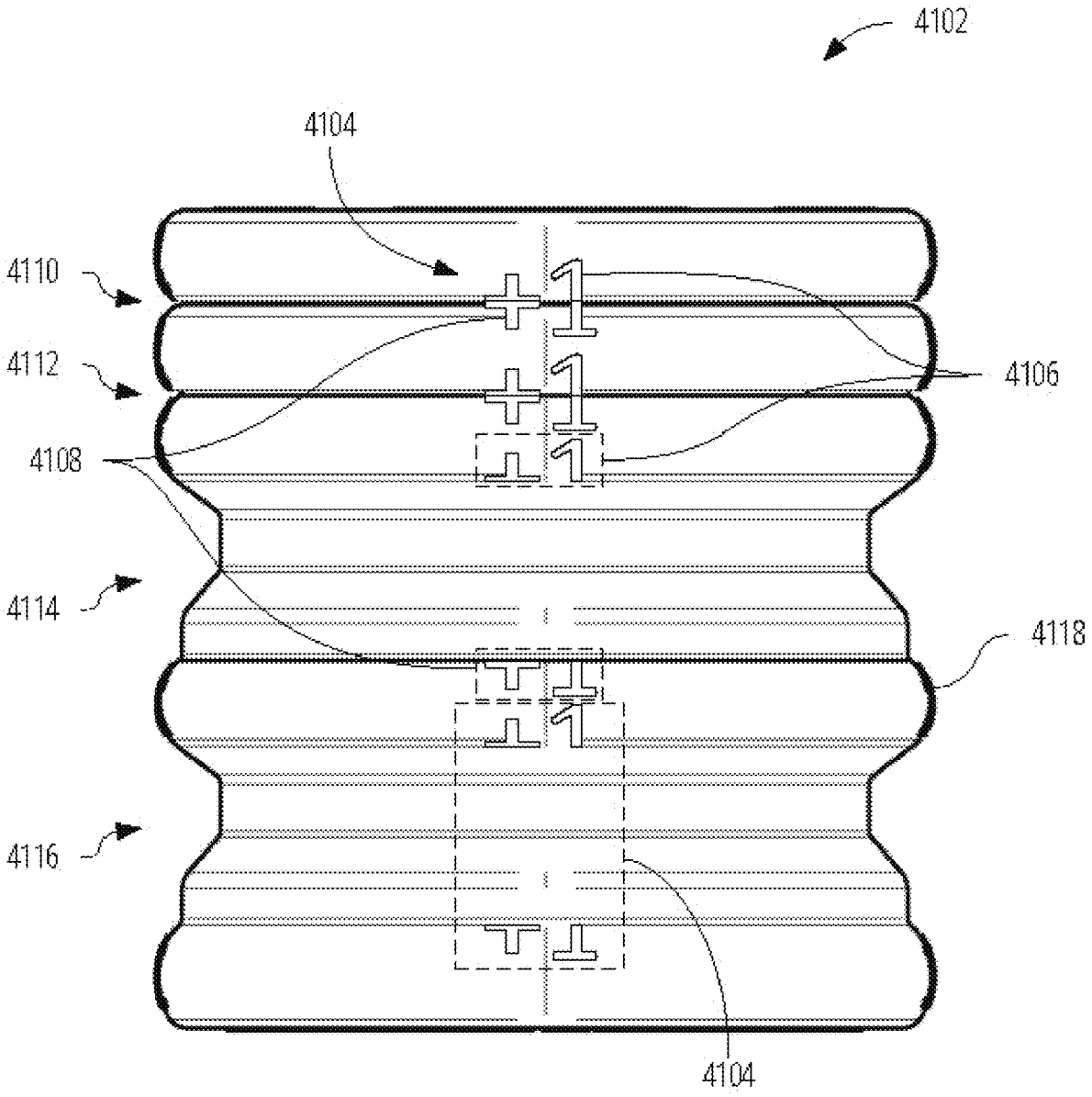
FIG. 41 is a front view of a collapsible game piece having separable indicators, according to certain aspects of the present disclosure.

FIG. 41 is a front view of a collapsible game piece 4102 having separable indicators 4104, according to certain aspects of the present disclosure. The collapsible game piece 4102 can be any suitable collapsible game piece, such as collapsible game piece 3002 of FIG. 30 or a collapsible beverage insulator 100 of FIG. 100. The collapsible game piece 4102 has a number of collapsible zones (e.g., a first collapsible zone 4110, a second collapsible zone 4112, a third collapsible zone 4114, and a fourth collapsible zone 4116).

The collapsible game piece 4010 as depicted in FIG. 41 includes four separable indicators 4104. Each separable indicator 4104 includes a first sub-indicator 4106 and a second sub-indicator 4108. As depicted in FIG. 41, the separable indicators 4104 are intended to create a "+1" indication when in a non-separated state.

Each first sub-indicator 4106 and second sub-indicator 4108 are positioned on the sidewall 4118 on regions of the sidewall that are externally visible when the collapsible zones 4110, 4112, 4114, 4116 are in a collapsed state. Each first sub-indicator 4106 and second sub-indicator 4108 of a single separable indicator 4104 are positioned on opposite sides of a collapsible zone (e.g., the separable indicator 4104 closest to the top of the page in FIG. 41 is separated by the first collapsible zone 4110).

Whenever a collapsible zone is in an expanded state, the first sub-indicator 4106 and second sub-indicator 4108 of a given separable indicator 4104 associated with that collapsible zone are visually separated from one another. However, when that same collapsible zone is in a collapsed state, the associated first sub-indicator 4106 and second sub-indicator 4108 are brought adjacent to one another, thus forming a combined visual element (e.g., an indicator or design). As depicted, the first and second separable indicators 4104 nearest the top of the page in FIG. 41 are in a non-separated state (also referred to as a "completed state") because the first collapsible zone 4110 and second collapsible zone 4112 are both collapsed. However, the remaining separable indicators 4104 are in a separated state (also referred to as an "incomplete state") because the third collapsible zone 4114 and the fourth collapsible zone 4116 are in an expanded state. Since only two out of the four separable indicators 4104 depicted in FIG. 41 are in a non-separated state, two out of the four "+1" indications are visible, thus indicating that a user is to take an action associated with "+1" twice (e.g., adding two points to a score).

Figure 42:
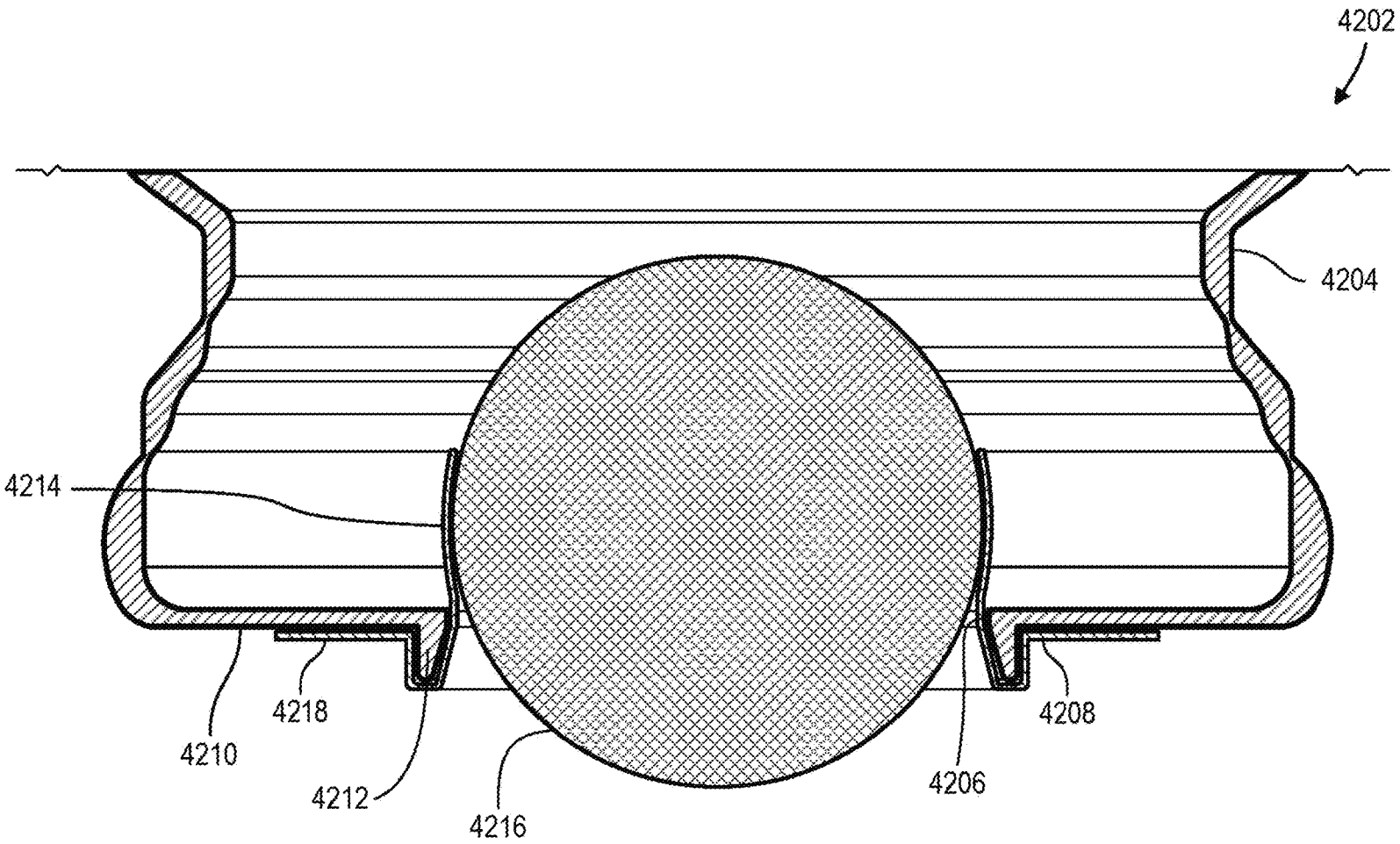
FIG. 42 is a front cutaway view of a portion of a main body of a collapsible game piece with a lip insert, according to certain aspects of the present disclosure.

FIG. 42 is a front cutaway view of a portion of a main body 4204 of a collapsible game piece 4202 with a lip insert 4208, according to certain aspects of the present disclosure. The collapsible game piece 4202 can be any suitable collapsible game piece, such as collapsible game piece 3002 of FIG. 30 or a collapsible beverage insulator 100 of FIG. 100.

The main body 4204 includes a projectile end 4210 with a projectile opening 4206. A lip insert 4208 is insertable through the projectile opening 4206 to establish a lip 4214 extending from the projectile opening 4206 towards the nose end of the main body 4204 (e.g., towards the top of the page as seen in FIG. 42). The lip insert 4208 can include a lip portion (e.g., lip 4214) and a retention portion 4218. The retention portion 4218 can be positioned on or at an outside surface of the projectile end 4210 to help retain the lip insert 4208 and stop the lip insert 4208 from being pushed fully through the projectile opening 4206, especially when a projectile 4216 is pushed into the projectile opening 4206 and contacts the lip 4214. The lip 4214 can have any suitable lip profile, such as those described with reference to FIGS. 34-35.

The projectile end 4210 can optionally include an additional lip 4212 extending from the projectile end 4210 (e.g., from the projectile end 4210 at the projectile opening 4206) in a direction away from the nose end (e.g., towards the bottom of the page as seen in FIG. 42). The additional lip 4212 can engage the lip insert 4208 to help retain the lip insert 4208 and prevent the lip insert 4208 from being pushed into the projectile opening 4206. In some cases, the additional lip 4212 can engage a corresponding feature of the lip insert 4208, although that need not always be the case. In some cases, the lip insert 4208 is sufficiently pliable and the additional lip 4212 is sufficiently rigid for the lip insert 4208 to stretch over the additional lip 4212.

Lip inserts 4208 can be made in various shapes and can be made of various materials to achieve different gameplay. For example, the amount of retention force that needs to be overcome to eject a projectile 4216 that is being retained by the lip insert 4208 can be increased or decreased depending on the elasticity of the lip insert 4208. As another example, different lip inserts 4208 having different thicknesses or otherwise having a different lip profile can be used to retain different types of projectiles, such as projectiles of different diameters. A set of lip inserts can be provided in a kit with the collapsible game piece 4202 to allow a user to select a desired lip insert 4208 from the set of lip inserts.

Figure 43:
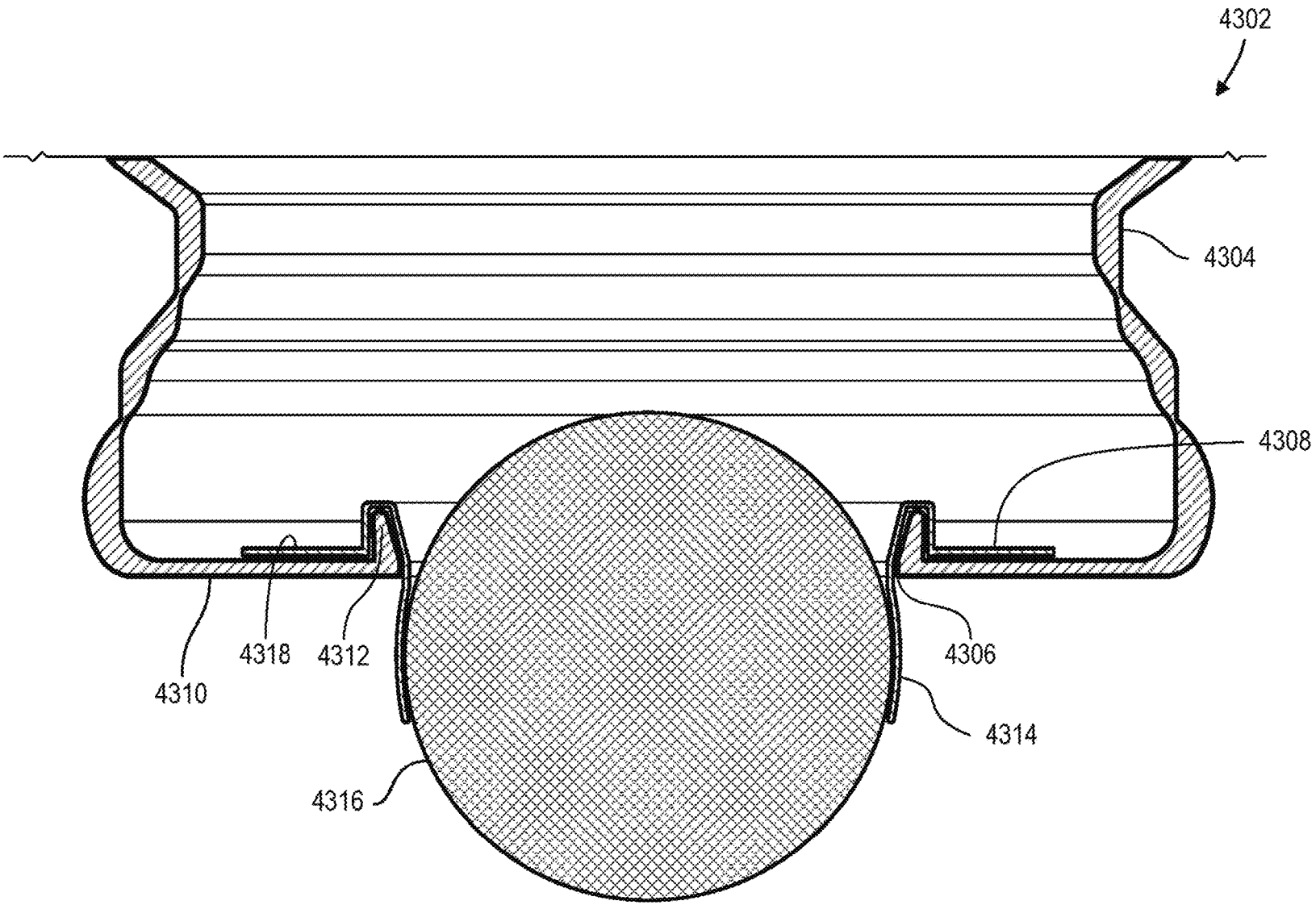
FIG. 43 is a front cutaway view of a portion of a main body of a collapsible game piece with an alternate lip insert, according to certain aspects of the present disclosure.

FIG. 43 is a front cutaway view of a portion of a main body 4304 of a collapsible game piece 4302 with a lip insert 4308, according to certain aspects of the present disclosure. The collapsible game piece 4302 can be any suitable collapsible game piece, such as collapsible game piece 3002 of FIG. 30 or a collapsible beverage insulator 100 of FIG. 100. The collapsible game piece 4302 can be the same as collapsible game piece 4202 of FIG. 42 but with an alternate lip insert 4314 configuration. As depicted in FIG. 43, the collapsible game piece 4302 includes a lip insert 4308 that creates a cradle for a projectile 4316 that is at least partially external to the main body 4304.

The main body 4304 includes a projectile end 4310 with a projectile opening 4306. A lip insert 4308 is insertable through the projectile opening 4306 to establish a lip 4314 extending from the projectile opening 4306 away from the nose end of the main body 4304 (e.g., towards the bottom of the page as seen in FIG. 43). The lip insert 4308 can include a lip portion (e.g., lip 4314) and a retention portion 4318. The retention portion 4318 can be positioned on or at an inner surface of the projectile end 4310 to help retain the lip insert 4308 and stop the lip insert 4308 from being pushed fully through the projectile opening 4306, especially when a projectile 4316 is ejected from the projectile opening 4306. The lip 4314 can have any suitable lip profile, such as those described with reference to FIGS. 34-35.

The projectile end 4310 can optionally include an additional lip 4312 extending from the projectile end 4310 (e.g., from the projectile end 4310 at the projectile opening 4306) in a direction towards the nose end (e.g., towards the top of the page as seen in FIG. 43). The additional lip 4312 can engage the lip insert 4308 to help retain the lip insert 4308 and prevent the lip insert 4308 from being pushed out of the projectile opening 4306. In some cases, the additional lip 4312 can engage a corresponding feature of the lip insert 4308, although that need not always be the case. In some cases, the lip insert 4308 is sufficiently pliable and the additional lip 4312 is sufficiently rigid for the lip insert 4308 to stretch over the additional lip 4312.

Lip inserts 4308 can be made in various shapes and can be made of various materials to achieve different gameplay. For example, the amount of retention force that needs to be overcome to eject a projectile 4316 that is being retained by the lip insert 4308 can be increased or decreased depending on the elasticity of the lip insert 4308. As another example, different lip inserts 4308 having different thicknesses or otherwise having a different lip profile can be used to retain different types of projectiles, such as projectiles of different diameters. A set of lip inserts can be provided in a kit with the collapsible game piece 4302 to allow a user to select a desired lip insert 4308 from the set of lip inserts.

The foregoing description of the implementations, including illustrated implementations, has been presented only for the purpose of illustration and description and is not intended to be exhaustive or limiting to the precise forms disclosed. Numerous modifications, adaptations, and uses thereof will be apparent to those skilled in the art. Numerous changes to the disclosed implementations can be made in accordance with the disclosure herein, without departing from the spirit or scope of the disclosure. Thus, the breadth and scope of the present disclosure should not be limited by any of the above described implementations.

Although certain aspects and features of the present disclosure have been illustrated and described with respect to one or more implementations, equivalent alterations and modifications will occur or be known to others skilled in the art upon the reading and understanding of this specification and the annexed drawings. In addition, while a particular feature may have been disclosed with respect to only one of several implementations, such feature may be combined with one or more other features of the other implementations as may be desired and advantageous for any given or particular application.

One or more elements or aspects or steps, or any portion (s) thereof, from one or more of any of the claims below can be combined with one or more elements or aspects or steps, or any portion(s) thereof, from one or more of any of the other claims below or combinations thereof, to form one or more additional implementations and/or claims of the present disclosure.

As used below, any reference to a series of implementations is to be understood as a reference to each of those implementations disjunctively (e.g., "Implementations 1-4" is to be understood as "Implementation 1, 2, 3, or 4").

Implementation 1 is a collapsible game piece, comprising: a main body having a projectile end, a nose end, and a sidewall, the sidewall coupling the projectile end and the nose end, the main body having an interior volume; a projectile opening in the projectile end for retaining a projectile, the projectile opening being elastically deformable to facilitate receiving the projectile and forming a substantially fluid-sealed interface around the projectile; wherein the sidewall includes at least one collapsible zone being movable between a collapsed state and an expanded state, wherein movement of the at least one collapsible zone from the expanded state to the collapsed state decreases a volume of the interior volume.

Implementation 2 is the collapsible game piece of implementation(s) 1, further comprising a nose piece coupled to the main body at or adjacent to the nose end.

Implementation 3 is the collapsible game piece of implementation(s) 2, wherein the nose piece restricts fluid flow out of the interior volume.

Implementation 4 is the collapsible game piece of implementation(s) 2 or 3, wherein the nose piece is positioned within the main body adjacent the nose end, the nose piece being weighted to move a center of gravity of the collapsible game piece towards the nose end.

Implementation 5 is the collapsible game piece of implementation(s) 2-4, wherein the nose end includes an accessory opening, the nose piece being removably coupled to the main body via the accessory opening.

Implementation 6 is the collapsible game piece of implementation(s) 5, wherein the nose piece is a conic nose piece, a truncated spheroid nose piece, a flat nose piece, a pointed nose piece, a suction cup nose piece, or a hook-and-loop nose piece.

Implementation 7 is the collapsible game piece of implementation(s) 1-6, wherein the nose end is removably coupled to the sidewall.

Implementation 8 is the collapsible game piece of implementation(s) 1-7, wherein the projectile end is removably coupled to the sidewall.

Implementation 9 is the collapsible game piece of implementation(s) 8, further comprising an alternate projectile end removably couplable to the sidewall after removal of the projectile end.

Implementation 10 is the collapsible game piece of implementation(s) 9, wherein the projectile end and the alternate projectile end require different levels of pressure within the interior volume to expel the projectile.

Implementation 11 is the collapsible game piece of implementation(s) 9 or 10, wherein only one of the projectile end and the alternate projectile end includes fins.

Implementation 12 is the collapsible game piece of implementation(s) 9-11, wherein the alternate projectile end includes an alternate projectile opening, a diameter of the projectile opening being different than an alternate diameter of the alternate projectile opening.

Implementation 13 is the collapsible game piece of implementation(s) 1-12, further comprising a set of fins positionable around the main body, the set of fins including a first retention ring positioned to contact the projectile end. In some implementations, the set of fins further includes a second retention ring positionable about the sidewall. In some cases, the set of fins includes a single, shuttlecock fin.

Implementation 14 is the collapsible game piece of implementation(s) 1-13, further comprising a lip extending from the projectile opening towards the nose end. In some cases, the the lip is part of a lip insert that is removable from and insertable into the projectile opening. In some cases, the game piece further includes an additional lip extending from the projectile opening away from the nose end, the additional lip engaging the lip when the lip is inserted into the projectile opening.

Implementation 15 is the collapsible game piece of implementation(s) 14, wherein a diameter of the lip increases as the lip extends towards the nose end.

Implementation 16 is the collapsible game piece of implementation(s) 14, wherein a diameter of the lip decreases as the lip extends towards the nose end.

Implementation 17 is the collapsible game piece of implementation(s) 16, wherein the projectile has a defined diameter, a diameter of the projectile opening being smaller than the defined diameter.

Implementation 18 is the collapsible game piece of implementation(s) 17, wherein a lip profile of the lip is configured to (i) restrict the projectile from being fully inserted through the projectile opening, and (ii) permit the projectile to be inserted over halfway through the projectile opening.

Implementation 19 is the collapsible game piece of implementation(s) 1-18, wherein the projectile end, the nose end, and the sidewall are formed of a continuous, elastomeric material.

Implementation 20 is the collapsible game piece of implementation(s) 1-19, further comprising a design located on the sidewall, the design having a hidable design element, the hidable design element being visible when the at least one collapsible zone is in the expanded state and being hidden when the at least one collapsible zone is in the collapsed state.

Implementation 21 is the collapsible game piece of implementation(s) 1-20, wherein the at least one collapsible zone includes at least a plurality of collapsible zones, wherein each of the plurality of collapsible zones is individually collapsible such that the plurality of collapsible zones collectively defines a plurality of possible states of collapsing for the sidewall, and wherein the sidewall includes a design having a plurality of indicators, each of the plurality of indicators associated with a respective one of the plurality of possible states of collapsing for the sidewall such that collapsing of any given combination of the plurality of collapsible zones is associated with a respective indicator of the plurality of indicators of the design.

Implementation 22 is a game kit comprising: the collapsible game piece of implementation(s) 1-21; and one or more additional components, the one or more additional components including (i) one or more alternate projectile ends different from the projectile end; (ii) one or more alternate sidewalls different from the sidewall; (iii) one or more alternate nose ends different from the nose end; (iv) one or more nose pieces; (v) one or more tails; (vi) one or more sets of fins; or (vii) any combination of (i)-(vi)

Implementation 23 is a game piece, comprising: a projectile end having a projectile opening, the projectile opening being configured to aid in retaining a projectile in at least a portion of the projectile end; a nose end; and a sidewall coupling the projectile end with the nose end thereby defining an interior volume of the game piece, the sidewall having a movable zone that is movable between a first state and a second state.

Implementation 24 is the game piece of implementation(s) 23, wherein the projectile opening is elastically deformable to aid in receiving the projectile at least partially therein.

Implementation 25 is the game piece of implementation(s) 23 or 24, wherein the projectile opening is configured to form a generally sealed interface around the projectile.

Implementation 26 is the game piece of implementation(s) 23-25, wherein the movable zone is a compressible zone, a collapsible zone, or a combination thereof.

Implementation 27 is the game piece of implementation(s) 23-26, wherein movement of the movable zone from the first state to the second state causes the interior volume of the game piece to decrease.

Implementation 28 is the game piece of implementation(s) 23-27, wherein the first state of the movable zone is an expanded state, and the second state of the movable zone is a collapsed state.

Implementation 29 is the game piece of implementation(s) 23-28, wherein the first state of the movable zone is an expanded state, and the second state of the movable zone is a compressed state.

Implementation 30 is the game piece of implementation(s) 23-29, wherein the projectile opening has an opening durometer hardness that is lower than a projectile durometer hardness of the projectile.

Implementation 31 is the game piece of implementation(s) 23-30, further comprising a nose piece coupled to the sidewall at or adjacent to the nose end.

Implementation 32 is the game piece of implementation(s) 31, wherein the nose piece restricts fluid flow out of the interior volume.

Implementation 33 is the game piece of implementation(s) 31 or 32, wherein the nose piece is positioned within the interior volume adjacent the nose end, the nose piece being weighted to place a center of gravity of the game piece closer to the nose end than the projectile end.

Implementation 34 is the game piece of implementation(s) 31-33, wherein the nose end includes an accessory opening, the nose piece being removably coupled to the sidewall via the accessory opening.

Implementation 35 is the game piece of implementation(s) 34, wherein the nose piece is a conic nose piece, a truncated spheroid nose piece, a flat nose piece, a pointed nose piece, a suction cup nose piece, or a hook-and-loop nose piece.

Implementation 36 is the game piece of implementation(s) 23-35, wherein the nose end is removably coupled to the sidewall.

Implementation 37 is the game piece of implementation(s) 23-36, wherein the projectile end is removably coupled to the sidewall.

Implementation 38 is the game piece of implementation(s) 37, further comprising an alternate projectile end removably couplable to the sidewall after removal of the projectile end.

Implementation 39 is the game piece of implementation(s) 38, wherein the projectile end and the alternate projectile end require different levels of pressure within the interior volume to expel the projectile.

Implementation 40 is the game piece of implementation(s) 38 or 39, wherein only one of the projectile end and the alternate projectile end includes fins.

Implementation 41 is the game piece of implementation(s) 38-40, wherein the alternate projectile end includes an alternate projectile opening, a diameter of the projectile opening being different than an alternate diameter of the alternate projectile opening.

Implementation 42 is the game piece of implementation(s) 23-41, further comprising a set of fins, the set of fins including a first retention ring positioned to contact the projectile end. In some cases, the set of fins includes a second retention ring positionable around the sidewall. In some cases, the set of fins includes a single, shuttlecock fin.

Implementation 43 is the game piece of implementation(s) 23-42, further comprising a lip extending from the projectile opening towards the nose end. In some cases, the the lip is part of a lip insert that is removable from and insertable into the projectile opening. In some cases, the game piece further includes an additional lip extending from the projectile opening away from the nose end, the additional lip engaging the lip when the lip is inserted into the projectile opening.

Implementation 44 is the game piece of implementation(s) 43, wherein a diameter of the lip increases as the lip extends towards the nose end.

Implementation 45 is the game piece of implementation(s) 43, wherein a diameter of the lip decreases as the lip extends towards the nose end.

Implementation 46 is the game piece of implementation(s) 45, wherein the projectile has a defined diameter, a diameter of the projectile opening being smaller than the defined diameter.

Implementation 47 is the game piece of implementation(s) 46, wherein a lip profile of the lip is configured to (i) restrict the projectile from being fully inserted through the projectile opening, and (ii) permit the projectile to be inserted over halfway through the projectile opening.

Implementation 48 is the game piece of implementation(s) 23-47, wherein the projectile end, the nose end, and the sidewall are formed of a continuous, elastomeric material.

Implementation 49 is the game piece of implementation(s) 23-48, further comprising a design located on the sidewall, the design having a hidable design element, the hidable design element being visible when the movable zone is in the expanded state and being hidden when the movable zone is in the collapsed state.

Implementation 50 is the game piece of implementation(s) 23-49, wherein the movable zone includes at least a plurality of collapsible zones, wherein each of the plurality of collapsible zones is individually collapsible such that the plurality of collapsible zones collectively defines a plurality of possible states of collapsing for the sidewall, and wherein the sidewall includes a design having a plurality of indicators, each of the plurality of indicators associated with a respective one of the plurality of possible states of collapsing for the sidewall such that collapsing of any given combination of the plurality of collapsible zones is associated with a respective indicator of the plurality of indicators of the design.

Implementation 51 is a game kit comprising: the game piece of implementation(s) 23-50; and one or more additional components, the one or more additional components including (i) one or more alternate projectile ends different from the projectile end; (ii) one or more alternate sidewalls different from the sidewall; (iii) one or more alternate nose ends different from the nose end; (iv) one or more nose pieces; (v) one or more tails; (vi) one or more sets of fins; or (vii) any combination of (i)-(vi).

Implementation 52 is the game piece of implementation(s) 1-51, wherein the movable zone is a collapsible zone movable between a collapsed state and expanded state, the game piece further comprising a separable indicator located on the sidewall, the separable indicator including a first sub-indicator and a second sub-indicator separated by the collapsible zone such that the first sub-indicator and second sub-indicator are separated when the collapsible zone is in the expanded state and are adjacent when the collapsible zone is in the collapsed state.

Implementation 53 is the game piece of implementation(s) 1-52, further comprising a lip extending from the projectile opening away from the nose end.

Implementation 54 is the game piece of implementation 53, wherein the lip is part of a lip insert that is removable and insertable into the projectile opening.

Implementation 55 is the game piece of implementation 54, further comprising an additional lip extending from the projectile opening towards the nose end, the additional lip engaging the lip when the lip is inserted into the projectile opening.

What is claimed is:

1. A game piece comprising:

a projectile end having a projectile opening, the projectile opening being configured to aid in retaining a projectile in at least a portion of the projectile end;

a nose end; and a sidewall coupling the projectile end with the nose end thereby defining an interior volume of the game piece, the sidewall having a movable zone that is movable between a first state and a second state, wherein at least one of the nose end and the projectile end is removably coupled to the sidewall.

2. The game piece of claim 1, wherein the projectile opening is elastically deformable to aid in receiving the projectile at least partially therein.

3. The game piece of claim 1, wherein the projectile opening is configured to form a generally sealed interface around the projectile.

4. The game piece of claim 1, wherein the movable zone is a compressible zone, a collapsible zone, or a combination thereof.

5. The game piece of claim 1, wherein the projectile opening has an opening durometer hardness that is lower than a projectile durometer hardness of the projectile.

6. The game piece of claim 1, further comprising a nose piece coupled to the sidewall at or adjacent to the nose end, the nose piece restricting fluid flow out of the interior volume.

7. The game piece of claim 1, further comprising a nose piece coupled to the sidewall at or adjacent to the nose end, the nose piece being positioned within the interior volume adjacent the nose end, the nose piece being weighted to place a center of gravity of the game piece closer to the nose end than the projectile end.

8. The game piece of claim 1, further comprising a nose piece coupled to the sidewall at or adjacent to the nose end, the nose end including an accessory opening, the nose piece being removably coupled to the sidewall via the accessory opening.

9. The game piece of claim 1, further comprising a nose piece coupled to the sidewall at or adjacent to the nose end, the nose piece being a conic nose piece, a truncated spheroid nose piece, a flat nose piece, a pointed nose piece, a suction cup nose piece, or a hook-and-loop nose piece.

10. The game piece of claim 1, further comprising an alternate projectile end removably couplable to the sidewall after removal of the projectile end.

11. The game piece of claim 10, wherein (i) the projectile end and the alternate projectile end require different levels of pressure within the interior volume to expel the projectile; (ii) only one of the projectile end and the alternate projectile end includes fins;

(iii) the alternate projectile end includes an alternate projectile opening, a diameter of the projectile opening being different than an alternate diameter of the alternate projectile opening; or (iv) any combination of (i)-(iii).

12. The game piece of claim 1, further comprising a set of fins, the set of fins including a first retention ring positioned to contact the projectile end.

13. The game piece of claim 12, further comprising a second retention ring positionable around the sidewall.

14. The game piece of claim 12, wherein the set of fins includes a single, shuttlecock fin.

15. The game piece of claim 1, further comprising a lip extending from the projectile opening towards the nose end.

16. The game piece of claim 15, wherein the projectile has a defined diameter, a diameter of the projectile opening being smaller than the defined diameter, wherein a lip profile of the lip is configured to (i) restrict the projectile from being fully inserted through the projectile opening, (ii) permit the projectile to be inserted over halfway through the projectile opening, (iii) permit the projectile to be inserted beyond the diameter of the projectile, or (iv) any combination thereof.

17. The game piece of claim 15, wherein a lip profile of the lip is configured to (i) restrict the projectile from being fully inserted through the projectile opening and (ii) grip the projectile with enough pressure to hold the projectile securely.

18. The game piece of claim 15, wherein the lip is part of a lip insert that is removable from and insertable into the projectile opening.

19. The game piece of claim 18, further including an additional lip extending from the projectile opening away from the nose end, the additional lip engaging the lip when the lip is inserted into the projectile opening.

20. The game piece of claim 1, further comprising a lip extending from the projectile opening away from the nose end, the lip being part of a lip insert that is removable and insertable into the projectile opening.

21. The game piece of claim 20, further comprising an additional lip extending from the projectile opening towards the nose end, the additional lip engaging the lip when the lip is inserted into the projectile opening.

22. The game piece of claim 1, wherein the projectile end includes an outer lip that engages an inner lip of the sidewall to removably couple the projectile end to the sidewall.

23. The game piece of claim 1, wherein the nose end is non-removably coupled to the sidewall.

24. The game piece of claim 1, further comprising a design located on the sidewall, the design having a hidable design element, the hidable design element being visible when the movable zone is in the first state and being hidden when the movable zone is in the second state.

25. The game piece of claim 1, wherein the movable zone includes at least a plurality of collapsible zones, wherein each of the plurality of collapsible zones is individually collapsible such that the plurality of collapsible zones collectively defines a plurality of possible states of collapsing for the sidewall, and wherein the sidewall includes a design having a plurality of indicators, each of the plurality of indicators associated with a respective one of the plurality of possible states of collapsing for the sidewall such that collapsing of any given combination of the plurality of collapsible zones is associated with a respective indicators of the plurality of indicators of the design.

26. A game kit comprising:

the game piece of claim 1; and one or more additional components, the one or more additional components including (i) one or more alternate projectile ends different from the projectile end; (ii) one or more alternate sidewalls different from the sidewall; (iii) one or more alternate nose ends different from the nose end; (iv) one or more nose pieces;

(v) one or more tails; (vi) one or more sets of fins; or (vii) any combination of (i)-(vi).

27. The game piece of claim 1, further comprising a fin coupled to the sidewall and extending therefrom.

28. The game piece of claim 27, wherein the fin is configured to be used to catch a projectile therein.

29. The game piece of claim 1, wherein the movable zone is a collapsible zone movable between a collapsed state and expanded state, the game piece further comprising a separable indicator located on the sidewall, the separable indicator including a first sub-indicator and a second sub-indicator separated by the collapsible zone such that the first sub-indicator and second sub-indicator are separated when the collapsible zone is in the expanded state and are adjacent when the collapsible zone is in the collapsed state.

30. A game piece comprising:

a projectile end having a projectile opening, the projectile opening being configured to aid in retaining a projectile in at least a portion of the projectile end;

a nose end;

a sidewall coupling the projectile end with the nose end thereby defining an interior volume of the game piece, the sidewall having a movable zone that is movable between a first state and a second state; and a design located on the sidewall, the design having an indicator associated with the movable zone such that the design when the movable zone is in the first state is distinguishable from the design when the movable zone is in the second state.

31. The game piece of claim 30, wherein the movable zone includes at least a plurality of collapsible zones, wherein each of the plurality of collapsible zones is individually collapsible such that the plurality of collapsible zones collectively defines a plurality of possible states of collapsing for the sidewall.

32. The game piece of claim 31, wherein the design includes a plurality of indicators including the indicator, and wherein each of the plurality of indicators is associated with a respective one of the plurality of possible states of collapsing for the sidewall such that collapsing of any given combination of the plurality of collapsible zones is associated with a respective indicator of the plurality of indicators of the design.

33. The game piece of claim 30, wherein the movable zone is a collapsible zone movable between a collapsed state and expanded state, the indicator including a first sub-indicator and a second sub-indicator separated by the collapsible zone such that the first sub-indicator and second sub-indicator are separated when the collapsible zone is in the expanded state and are adjacent when the collapsible zone is in the collapsed state.

34. The game piece of claim 30, wherein the design includes a hidable design element, the hidable design element being visible when the movable zone is in the first state and being hidden when the movable zone is in the second state.

35. A game piece comprising:

a projectile end having a projectile opening, the projectile opening being configured to aid in retaining a projectile in at least a portion of the projectile end;

a nose end;

a sidewall coupling the projectile end with the nose end thereby defining an interior volume of the game piece, the sidewall having a movable zone that is movable between a first state and a second state; and a fin coupled to the sidewall and extending therefrom.

36. The game piece of claim 35, wherein the fin is configured to be used to catch a projectile therein.

37. A game kit, comprising:

a game piece, including:

a projectile end having a projectile opening, the projectile opening being configured to aid in retaining a projectile in at least a portion of the projectile end;

a nose end; and a sidewall coupling the projectile end with the nose end thereby defining an interior volume of the game piece, the sidewall having a movable zone that is movable between a first state and a second state; and one or more additional components, the one or more additional components including (i) one or more alternate projectile ends different from the projectile end; (ii) one or more alternate sidewalls different from the sidewall; (iii) one or more alternate nose ends different from the nose end; (iv) one or more nose pieces;

(v) one or more tails; (vi) one or more sets of fins; or (vii) any combination of (i)-(vi).

38. A game piece comprising:

a projectile end having a projectile opening, the projectile opening being configured to aid in retaining a projectile in at least a portion of the projectile end;

a weighted nose end; and a sidewall coupling the projectile end with the nose end thereby defining an interior volume of the game piece, the sidewall having a movable zone that is movable between a first state and a second state, wherein the weighted nose end is weighted to place a center of gravity of the game piece closer to the nose end than the projectile end such that the game piece will tend to land on the weighted nose end with the projectile opening facing upwards.

39. The game piece of claim 38, wherein the weighted nose end includes (i) a region of material heavier than material of the sidewall, (ii) a thickened region of material of the nose end, (iii) a weight insertable within the interior volume of the game piece, (iv) a weighted nose piece, or (v) any combination of (i)-(iv), and a weighted nose piece coupled to the nose end.

40. A game piece comprising:

a projectile end having a projectile opening, the projectile opening being configured to aid in retaining a projectile in at least a portion of the projectile end;

a nose end;

a sidewall coupling the projectile end with the nose end thereby defining an interior volume of the game piece, the sidewall having a movable zone that is movable between a first state and a second state; and a removable lip extending from the projectile opening (a) towards the nose end or (b) away from the nose end, the lip being configured to (i) restrict the projectile from being fully inserted through the projectile opening and (ii) grip the projectile with enough pressure to hold the projectile securely.

41. A game piece comprising:

a projectile end having a projectile opening, the projectile opening being configured to aid in retaining a projectile in at least a portion of the projectile end;

a nose end including a nose opening;

a sidewall coupling the projectile end with the nose end thereby defining an interior volume of the game piece, the sidewall having a movable zone that is movable between a first state and a second state; and a nose piece removably coupled to the sidewall via the nose opening, the nose opening providing a passageway into or out of the interior volume.

42. The game piece of claim 41, wherein nose piece restricts fluid flow out of the interior volume.

43. The game piece of claim 1, wherein the nose end is a weighted nose end, the weighted nose end being weighted to place a center of gravity of the game piece closer to the nose end than the projectile end such that the game piece will tend to land on the weighted nose end with the projectile opening facing upwards.

44. The game piece of claim 30, wherein the nose end is a weighted nose end, the weighted nose end being weighted to place a center of gravity of the game piece closer to the nose end than the projectile end such that the game piece will tend to land on the weighted nose end with the projectile opening facing upwards.

45. The game piece of claim 30, further comprising at least one fin coupled to the sidewall.

46. The game piece of claim 45, wherein the at least one fin includes a first retention ring positioned to contact the projectile end.

47. The game piece of claim 35, wherein the nose end is a weighted nose end, the weighted nose end being weighted to place a center of gravity of the game piece closer to the nose end than the projectile end such that the game piece will tend to land on the weighted nose end with the projectile opening facing upwards.

48. The game kit of claim 37, wherein the nose end is a weighted nose end, the weighted nose end being weighted to place a center of gravity of the game piece closer to the nose end than the projectile end such that the game piece will tend to land on the weighted nose end with the projectile opening facing upwards.

49. The game kit of claim 37, wherein the one or more additional components includes the one or more sets of fins.

50. The game kit of claim 49, wherein the one or more sets of fins includes a first retention ring positioned to contact the projectile end.

51. The game piece of claim 38, further comprising at least one fin coupled to the sidewall.

52. The game piece of claim 51, wherein the at least one fin includes a first retention ring positioned to contact the projectile end.

53. The game piece of claim 40, further comprising a design located on the sidewall, the design having a hidable design element, the hidable design element being visible when the movable zone is in the first state and being hidden when the movable zone is in the second state.

54. The game piece of claim 40, wherein the nose end is a weighted nose end, the weighted nose end being weighted to place a center of gravity of the game piece closer to the nose end than the projectile end such that the game piece will tend to land on the weighted nose end with the projectile opening facing upwards.

55. The game piece of claim 40, further comprising at least one fin coupled to the sidewall.

56. The game piece of claim 55, wherein the at least one fin includes a first retention ring positioned to contact the projectile end.

* * * * *